US007192695B2

(12) United States Patent
Sakai et al.

(10) Patent No.: US 7,192,695 B2
(45) Date of Patent: Mar. 20, 2007

(54) IMAGE FORMING METHOD USING PHOTOTHERMOGRAPHIC MATERIAL

(75) Inventors: Minoru Sakai, Kanagawa (JP); Fumito Nariyuki, Kanagawa (JP); Yasuhiro Yoshioka, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 0 days.

(21) Appl. No.: 11/133,302

(22) Filed: May 20, 2005

(65) Prior Publication Data

US 2005/0221237 A1 Oct. 6, 2005

Related U.S. Application Data

(63) Continuation-in-part of application No. 10/811,956, filed on Mar. 30, 2004, now abandoned.

(30) Foreign Application Priority Data

Apr. 3, 2003 (JP) ..... 2003-100301
Apr. 23, 2003 (JP) ..... 2003-118784
Apr. 24, 2003 (JP) ..... 2003-119513

(51) Int. Cl.
*G03C 1/498* (2006.01)
*G03C 5/29* (2006.01)

(52) U.S. Cl. ..... 430/351; 430/353; 430/566; 430/619

(58) Field of Classification Search ..... 430/353, 430/619, 566, 351
See application file for complete search history.

(56) References Cited

U.S. PATENT DOCUMENTS

| | | | | |
|---|---|---|---|---|
| 6,146,823 | A | 11/2000 | Katoh | |
| 6,376,166 | B1 | 4/2002 | Oya et al. | |
| 6,699,649 | B2 | 3/2004 | Nishijima et al. | |
| 6,958,209 | B2 * | 10/2005 | Morita et al. | 430/619 |
| 7,005,251 | B2 * | 2/2006 | Kashiwagi et al. | 430/619 |
| 2004/0115569 | A1 * | 6/2004 | Kashiwagi et al. | 430/336 |
| 2004/0229175 | A1 * | 11/2004 | Goto | 430/542 |

FOREIGN PATENT DOCUMENTS

| | | |
|---|---|---|
| EP | 1278101 A | 1/2003 |

* cited by examiner

*Primary Examiner*—Richard L. Schilling
(74) *Attorney, Agent, or Firm*—Margaret A. Burke; Sheldon J. Moss

(57) ABSTRACT

An image forming method comprising by imagewise exposing a photothermographic material comprising at least a photosensitive silver halide, a non-photosensitive organic silver salt, a reducing agent, and a binder, on at least one surface of a support, and thermally developing the photothermographic material at a line speed of 20 mm/sec or higher using an image forming apparatus, wherein the reducing agent is a bisphenol compound which has at a meso-position a substituent with ring structure or a substituent having an unsaturated bond.

16 Claims, No Drawings

IMAGE FORMING METHOD USING PHOTOTHERMOGRAPHIC MATERIAL

CROSS-REFERENCE TO RELATED APPLICATION

This application is a continuation-in-part of earlier filed application Ser. No. 10/811,956 filed on Mar. 30, 2004, now abandoned, the disclosure of which is incorporated by reference herein, which claims priority under 35 USC 119 from Japanese Patent Application Nos. 2003-100301, 2003-118784 and 2003-119513, the disclosures of which are incorporated by reference herein.

BACKGROUND OF THE INVENTION

1. Field of the Invention

The present invention relates to an image forming method using a photothermographic material, and particularly to an image forming method using a photothermographic material which can be thermally developed stably and quickly.

2. Description of the Related Art

In recent years, it has been strongly desired in the field of films for medical imaging and for graphic arts to reduce the amount of used processing liquid waste in consideration of environmental protection and space saving. For this reason, technology regarding photothermographic materials as films for medical imaging and for photographic applications, which are capable of efficient exposure with a laser image setter or a laser imager and capable of forming a clear black-toned image with high resolution and high sharpness is desired. Such photothermographic materials can eliminate use of liquid processing chemicals and can provide users with a thermal development system which is simpler and does not contaminate the environment.

Although similar requirements also exist in the field of general image forming materials, an image for medical imaging requires a particularly high image quality excellent in sharpness and granularity because a delicate image representation is desirable. Also an image of blue-black tone is preferred in consideration of easy diagnosis. Currently various hard copy systems utilizing pigments or dyes, such as ink jet printers and electrophotographic systems, are available as general image forming systems, but they are not satisfactory as output systems for medical images.

On the other hand, thermal image forming systems utilizing organic silver salts are described, for example, in U.S. Pat. Nos. 3,152,904 and 3,457,075, as well as in "Thermally Processed Silver Systems", written by D. H. Klosterboer, appearing in "Imaging Processes and Materials", Neblette, 8th edition, edited by J. Sturge, V. Warlworth, and A. Shepp, Chapter 9, pages 279 to 291, 1989. A photothermographic material generally comprises a photosensitive layer in which a catalytically active amount of photocatalyst (for example, a silver halide), a reducing agent, a reducible silver salt (for example, an organic silver salt) and, if necessary, a toner for controlling the color tone of a developed silver image are dispersed in a matrix of a binder. The photothermographic material, when heated at high temperature (for example, 80° C. or higher) after image exposure, forms a black-toned silver image by an oxidation/reduction reaction between the silver halide or the reducible silver salt (functioning as an oxidizer) and the reducing agent. The oxidation/reduction reaction is promoted by a catalytic effect of a latent image formed by exposure on silver halide. Accordingly, a black-toned silver image is formed in an exposed area. Such materials are disclosed in many documents including, for example, U.S. Pat. No. 2,910,377 and Japanese Patent Application Publication (JP-B) No. 43-4924. Further, Fuji Medical Dry Laser Imager FMP-DPL is an example of a practical medical image forming system using a photothermographic material that has been marketed.

In production of a thermographic system using an organic silver salt, two methods are available. In one method, a solvent coating is adopted and in the other method a coating liquid containing polymer fine particles as a main binder in an aqueous dispersion is applied and dried. In the latter method, since no necessity arises for a process of solvent recovery or the like, a production facility is simple and the method is advantageous for mass production.

As described above, various improvements have been applied to photothermographic materials from the viewpoints of environmental considerations, cost, and photographic properties. However, there remains room for improvement in thermal developing speed. In general, quick processing of photographed images is desired in the medical field or other fields in order to obtain the results of diagnosis quickly.

In order to conduct thermal developing treatment quickly, it is necessary to increase the speed of thermal development, and Japanese Patent Application Laidpen (JP-A) Nos. 2002-156727 and 2001-264929 state that it is effective to use a development accelerator. The use of the development accelerator can increase development speed. However, in continuous thermal developing treatment of plural sheets of the photothermographic material, an increase in fogging, variation in sensitivity or variation in Dmax may be caused between images obtained at the initial stage and images obtained after the continuous treatment. Thus, improvement has been desired.

When it suddenly becomes necessary to output an image at the scene of emergency care, or some other scene, it is desired to shorten the start-up time of an image forming apparatus, which is an amount of time from a state in which a power supply of the apparatus is shut off to a state in which the apparatus can start thermal development. Conventionally, this has been attempted by quickening a rise in temperature of heater plates of a thermal developing portion by setting a temperature thereof to a temperature higher than the temperature for development immediately after the apparatus is started up, and quickly bringing the heater plate temperature close to the set temperature by monitoring and feeding back the heater plate temperature. However, there are problems in that, for example, variation in photographic properties becomes large due to large variation in temperature when hunting for the appropriate temperature. Thus, improvement has been desired.

SUMMARY OF THE INVENTION

An object of the present invention is to provide an image forming method using a photothermographic material which can be thermally developed quickly. This object can be achieved according to the following aspects of the invention.

An aspect of the present invention is to provide an image forming method comprising by imagewise exposing a photothermographic material comprising at least a photosensitive silver halide, a non-photosensitive organic silver salt, a reducing agent, and a binder, on at least one surface of a support, wherein the reducing agent is at least one selected from compounds represented by the following formulae (R1) or (R2), and thermally developing the photothermographic material at a line speed of 20 mm/sec or higher using an image forming apparatus:

Formula (R1)

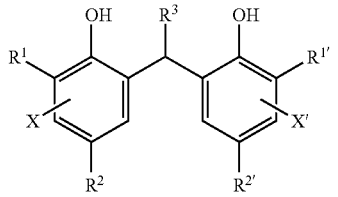

In formula (R1), $R^1$ and $R^{1'}$ each independently represent an alkyl group having 1 to 20 carbon atoms, $R^2$ and $R^{2'}$ each independently represent a hydrogen atom, or a substituent which can be substituted for a hydrogen atom on a benzene ring, $R^3$ represents a substituent which can form a 3- to 7-membered ring which includes atoms selected from carbon, oxygen, nitrogen, sulfur and phosphorus atoms, and X and X' each independently represent a hydrogen atom, or a substituent which can be substituted for a hydrogen atom on a benzene ring.

Formula (R2)

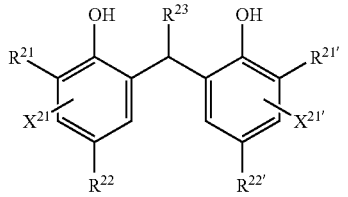

In formula (R2), $R^{21}$ and $R^{21'}$ each independently represent an alkyl group having 1 to 20 carbon atoms, $R^{22}$ and $R^{22'}$ each independently represent a hydrogen atom, or a substituent which can be substituted for a hydrogen atom on a benzene ring, $R^{23}$ represents an alkenyl group, or an alkyl group having a substituent having an unsaturated bond, $X^{21}$ and $X^{21'}$ each independently represent a hydrogen atom, or a substituent which can be substituted for a hydrogen atom on a benzene ring.

DETAILED DESCRIPTION OF THE INVENTION

According to the present invention, an image forming method using a photothermographic material which, in particularly, is excellent in processing stability during high-speed thermal development and exhibits little incease of fogging and little change in sensitivity and in maximum density (Dmax) when plural sheets of the material are continuously thermally developed, is provided.

Conventionally, there has been a problem in that when an image is formed just after starting up i.e., activating an image forming apparatus, variation in sensitivity and image tone increases, and stable images cannot be outputted. As a result of clarifying the cause, it was found that one of the causes was that, in addition to stability of temperature of a plate heater of a thermal developing portion, stability of temperature of an exposure portion affects sensitivity. Another problem was also found in that when the storage period after production of photothermographic material until the time of using the material becomes longer, the variation becomes even larger.

The invention will be explained in detail below.

1. Photothermographic Material

The photothermographic material in the present invention has an image forming layer comprising at least a photosensitive silver halide, a non-photosensitive organic silver salt, a reducing agent and a binder, on at least one surface of a support. And preferably, the image forming layer may carry thereon a surface protective layer. A back layer, a back protective layer or the like may be disposed on an opposite surface of the photothermographic material.

Further, the photothermographic material of the invention is characterized in that the aforementioned reducing agent is at least one compound selected from compounds represented by the following formulae (R1) and (R2), and that a line speed of thermal development is 20 mm/sec or higher.

The constitutions and preferable components of the aforementioned layers will be described in detail below.

1-1. Reducing Agent

A reducing agent in the present invention means the compound, which can reduce a silver ion to form developed silver by thermal development and can be selected among reducing agents explained below.

1) Reducing Agent Represented by Formula (1)

Formula (R1) will be described in detail below.

Formula (R1)

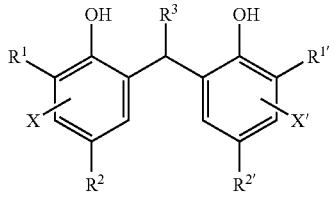

(1) $R^1$ and $R^{1'}$ $R^1$ and $R^{1'}$ each independently represent a substituted or unsubstituted alkyl group having 1 to 20 carbon atoms. The substituent of alkyl group is not particularly limited but preferred examples thereof include an aryl group, a hydroxy group, an akloxy group, an aryloxy group, an alkylthio group, an arylthio group, an acylamino group, a sulfonamide group, a sulfonyl group, a phosphonyl group, a phosphoryl group, an acyl group, a carbamoyl group, an ester group, an ureido group, an urethane group, a halogen atom and the like.

$R^1$ and $R^{1'}$ preferably is a secondary or tertiary alkyl group having 3 to 15 carbon atoms. As specific examples, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group and the like can be described. $R^1$ and $R^{1'}$ more preferably is a tertiary alkyl group having 4 to 12 carbon atoms and still more preferably is a t-butyl group, a t-amyl group and a 1-methylcyclohexyl group and most preferably is a t-butyl group.

(2) $R^2$ and $R^{2'}$, X and X'

$R^2$ and $R^{2'}$ each independently represent a hydrogen atom or a group capable of substituting for a hydrogen atom on a benzene ring and X and X' each independently represent a hydrogen atom or a group capable of substituting for a hydrogen atom on a benzene ring. Preferred examples of the group capable of substituting for a hydrogen atom on a benzene ring include an alkyl group, an aryl group, a halogen atom, an alkoxy group, an acylamino group and the like.

$R^2$ and $R^{2'}$ each preferably represent an alkyl group having 1 to 20 carbon atoms and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group and the like. Of these, more preferred are a methyl group, an ethyl group, a propyl group, an isopropyl group and a t-butyl group.

X and X' each preferably represent a hydrogen atom, a halogen atom and an alkyl group, and more preferably a hydrogen atom.

(3) $R^3$ $R^3$ represents substituent forming a 3- to 7-membered ring which includes atoms selected from carbon, oxygen, nitrogen, sulfur and phosphorus atoms. The ring may consist of carbon atoms or may be a heterocyclic group which consists of a carbon atom and the hetero atom described above. $R^3$ preferably is a group having 3 to 20 carbon atoms and forming a 5 or 6 membered carbon ring or hetero ring, and more preferably a group forming a ring which consists of a carbon atom or a group forming a ring which consists of a carbon atom and an oxygen atom.

These rings may have unsaturated bond.

These rings may have substituents. And the ring including the substituents preferably has 2 to 30 carbon atoms in total.

As examples of substituent represented by $R^3$, a halogen atom, an alkyl group, an alkenyl group, an alkynyl group, a cycloalkyl group, an aryl group, an alkoxy group, an alkylthio group, an aryloxy group, an arylthio group, an allyloxy group, an allylthio group, an acylamino group, a sulfonamide group, a sulfonyl group, a sulfonyl group, a carbonyl group, an oxycarbonyl group, a carbamoyl group, a sulfamoyl group, a heterocyclic group, an amino group, a hydroxy group and the like are described.

As specific examples of the ring group represented by $R^3$, a cyclopropyl group, a cyclobutyl group, a cyclopentyl group, a cyclohexyl group, a cycloheptyl group, a 2-norbornyl group, a 2-[2,2,2]-bicyclooctyl group, a 2-adamantyl group, a 2-cyclopentenyl group, a 2-cyclohexenyl group, a 3-cyclohexenyl group, a 2-tetrahydrofuranyl group, a 2-dihydrofuranyl group, a 2-tetrahydropyranyl group, a 3-dihydropyranyl group, a 2-pyyrolidine group, 2-piperidine group, a 3-tetrahydrothiopyranyl group, a 3-tetrahydrophosphoran group and the like are described. Specific examples of the ring group represented by $R^3$ preferably are a cycloalkyl group, a cycloalkenyl group and a heterocyclic group each having 1 to 15 carbon atoms. As a cycloalkyl group preferred is a cyclohexyl group and a cyclopentyl group. And as a cycloalkenyl group preferred is a 2-cyclohexenyl group, a 3-cyclohexenyl group and 3-cyclopentenyl group. As a heterocyclic group preferred is a 2-tetrahydrofuranyl group, a 2-tetrahydropyranyl group and a 3-tetrahydropyranyl group. $R^3$ most preferably is a cyclohexyl group, a 3-cyclohexenyl group and a 3-cyclopentenyl group.

Specific examples of the compound represented by formula (R1) are illustrated below, but the invention is not limited thereto.

R1-1

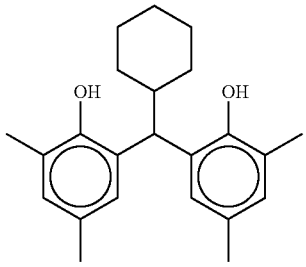

R1-2

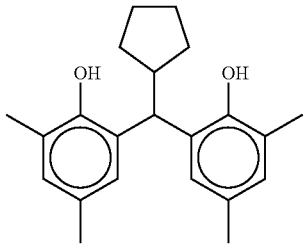

R1-3

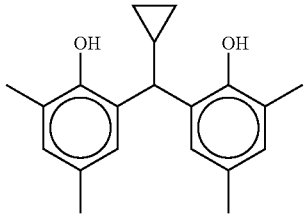

R1-4

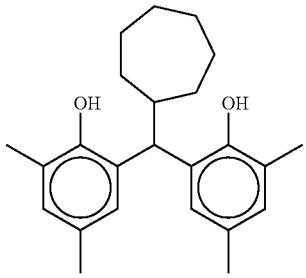

R1-5

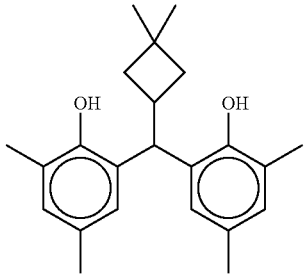

R1-6

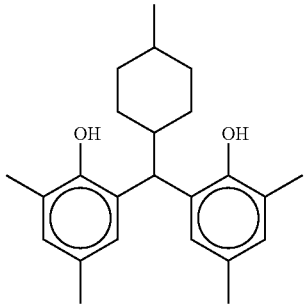

-continued
R1-7
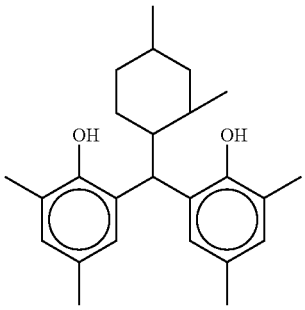
R1-8
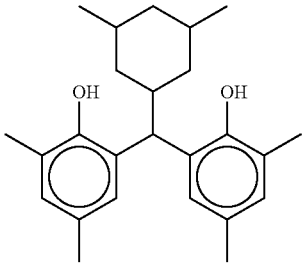
R1-9
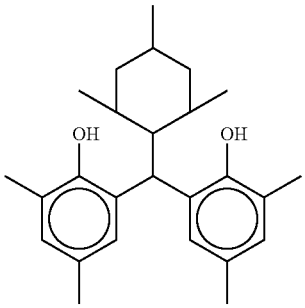
R1-10
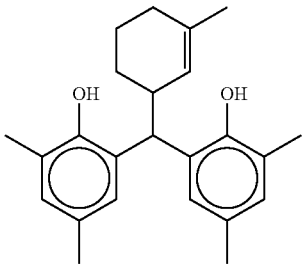
R1-11
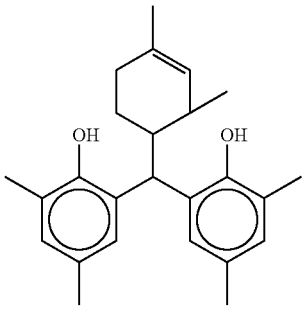
-continued
R1-12
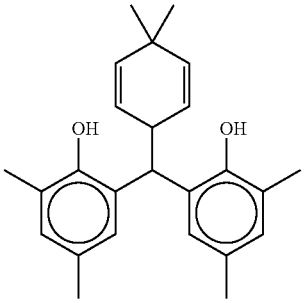
R1-13
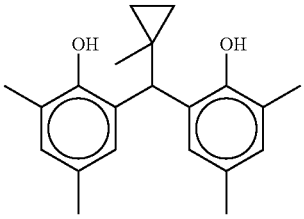
R1-14
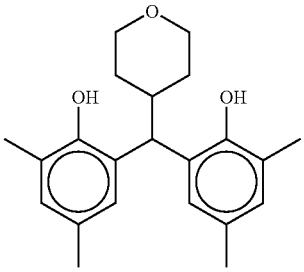
R1-15
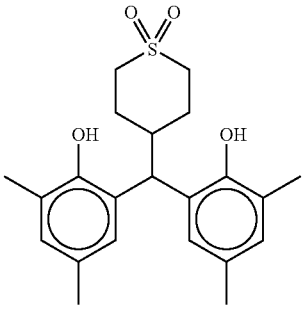
R1-16
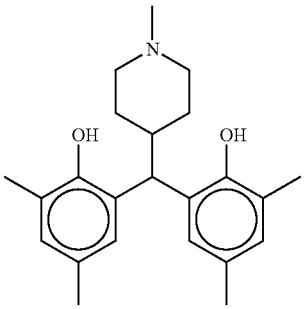

-continued
R1-17
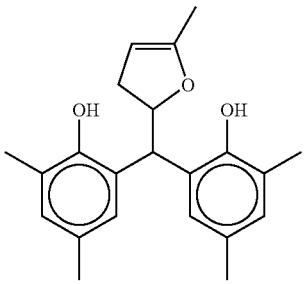
R1-18
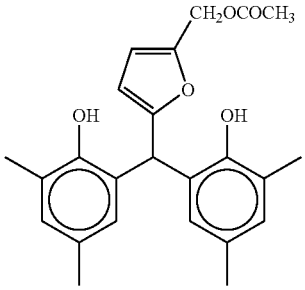
R1-19
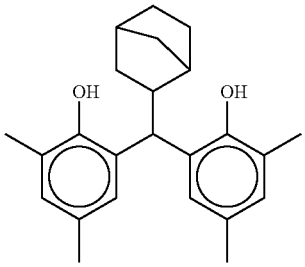
R1-20
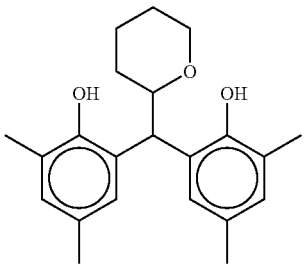
R1-21
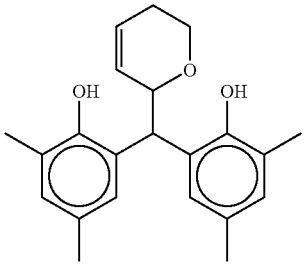
-continued
R1-22
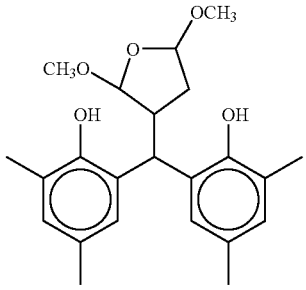
R1-23
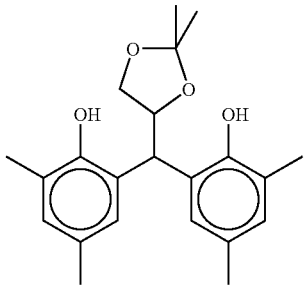
R1-24
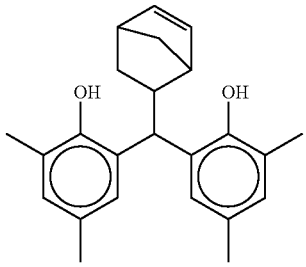
R1-25
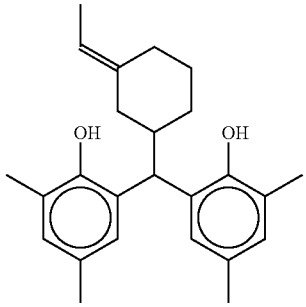
R1-26
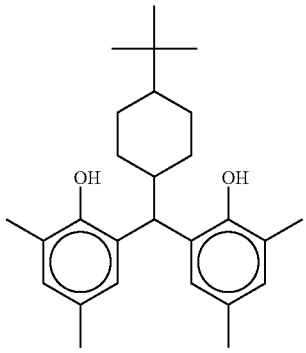

-continued
R1-27
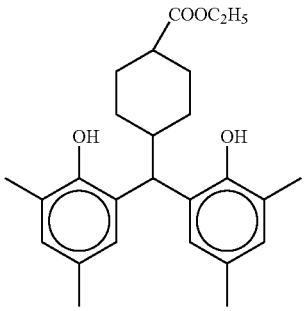
R1-28
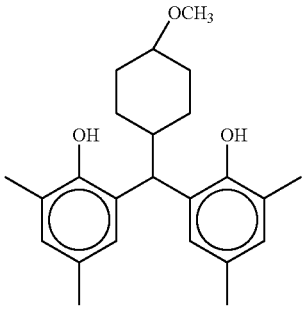
R1-29
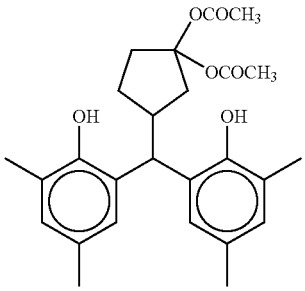
R1-30
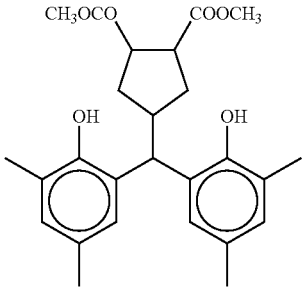
R1-31
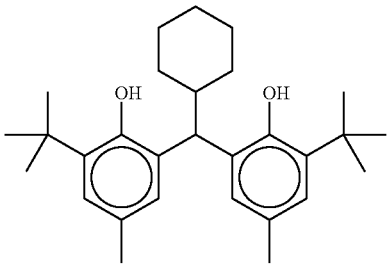
-continued
R1-32
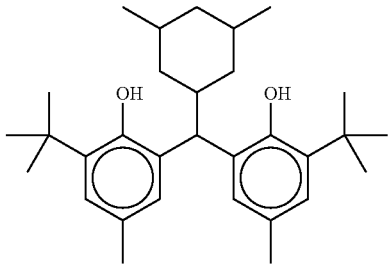
R1-33
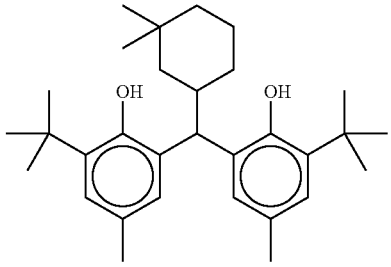
R1-34
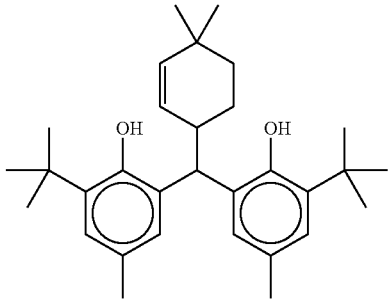
R1-35
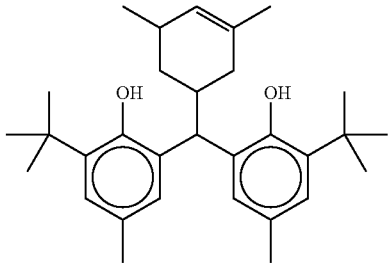
R1-36
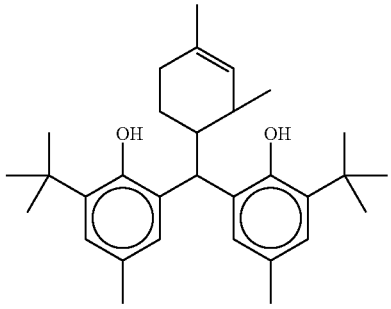

-continued
R1-37
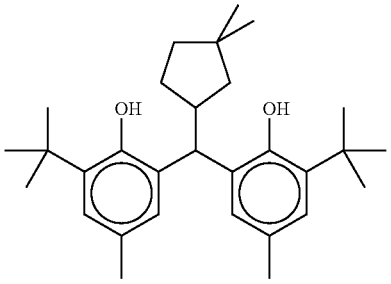
R1-38
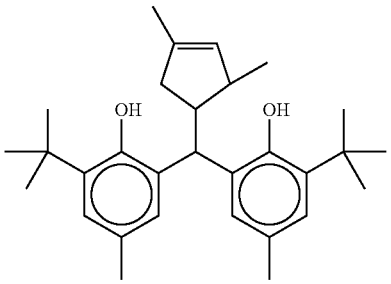
R1-39
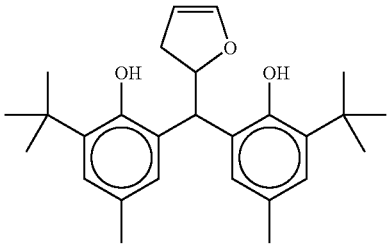
R1-40
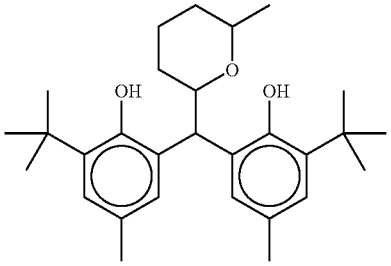
R1-41
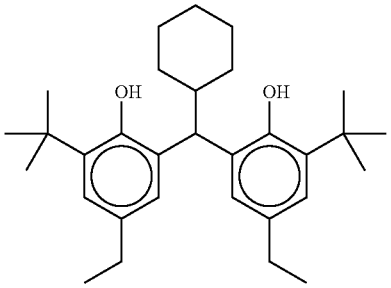
-continued
R1-42
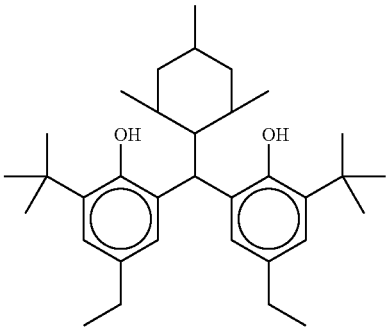
R1-43
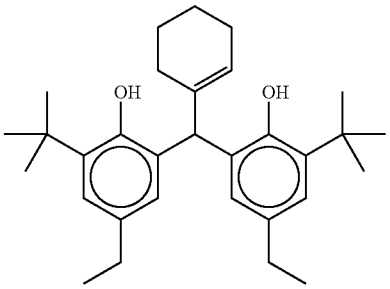
R1-44
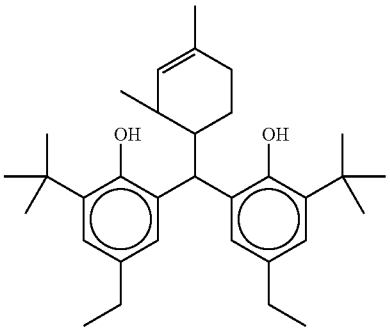
R1-45
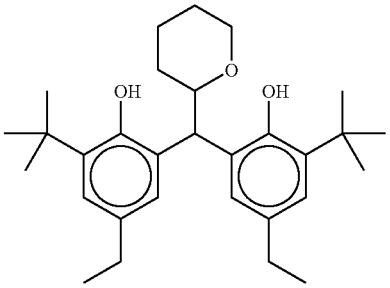
R1-46
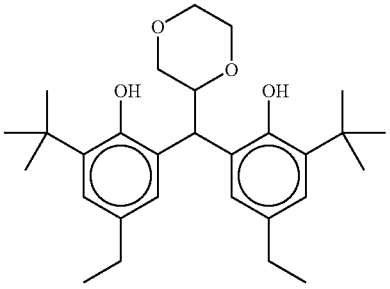

-continued
R1-47
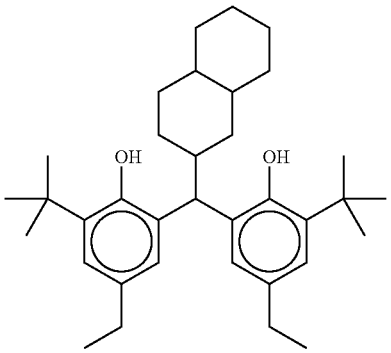
R1-48
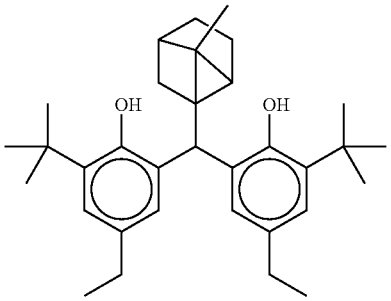
R1-49
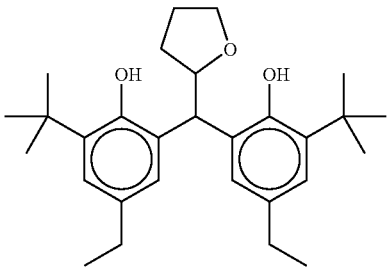
R1-50
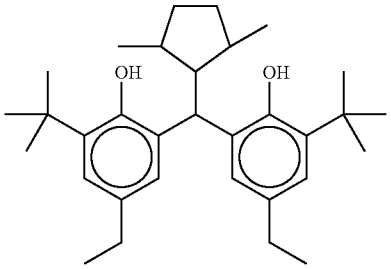
R1-51
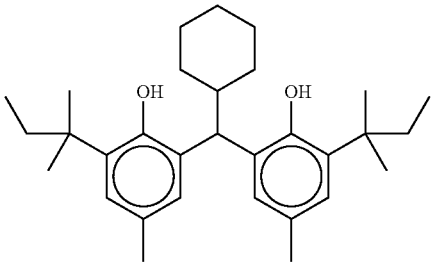
-continued
R1-52
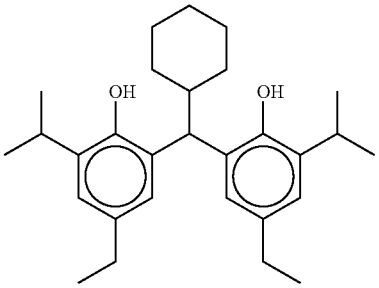
R1-53
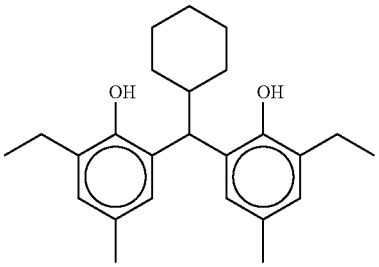
R1-54
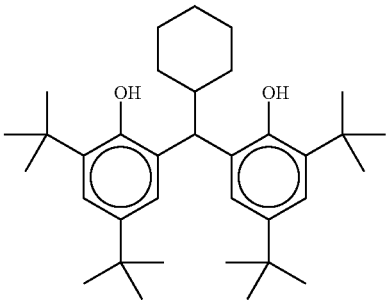
R1-55
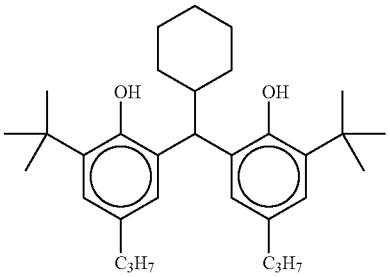
R1-56
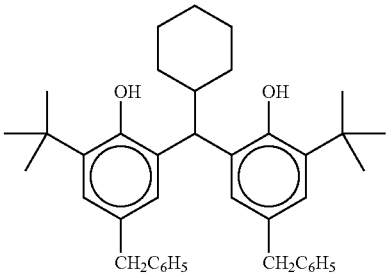

-continued
R1-57
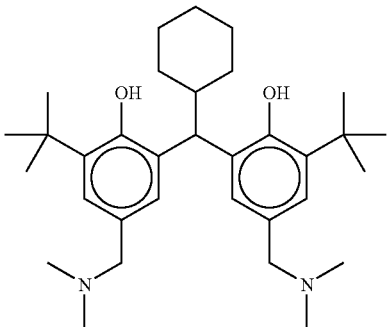
R1-58
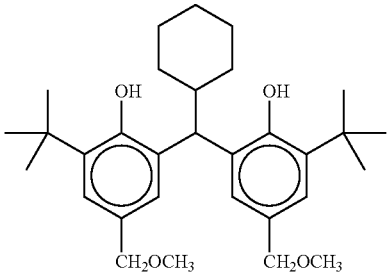
R1-59
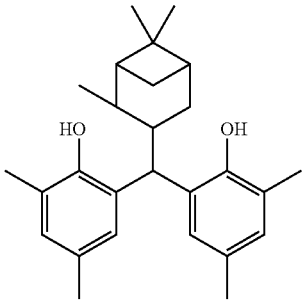
R1-60
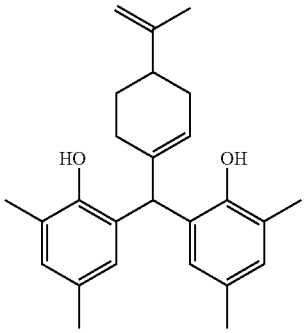
R1-61
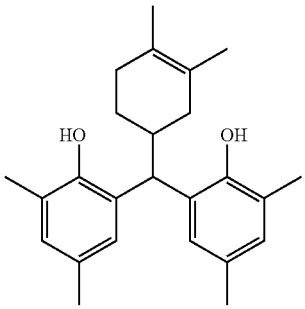
-continued
R1-62
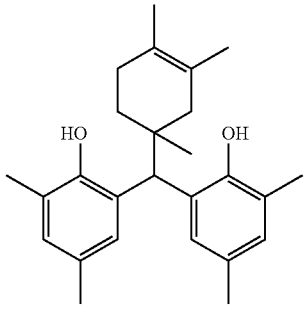
R1-63
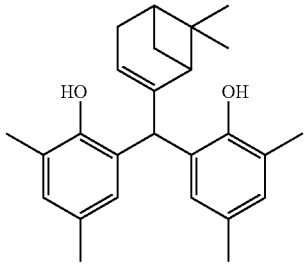
R1-64
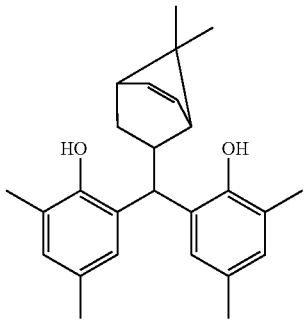
R1-65
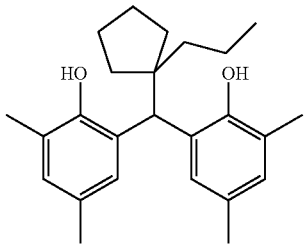
R1-66
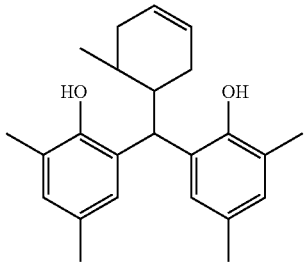

-continued
R1-67
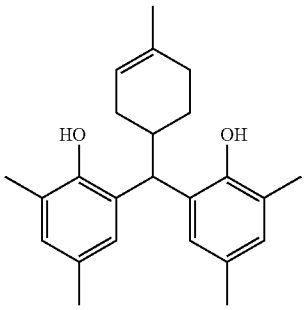
R1-68
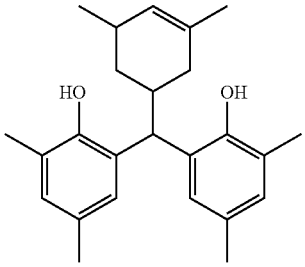
R1-69
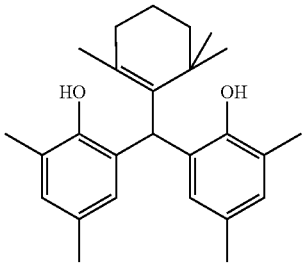
R1-70
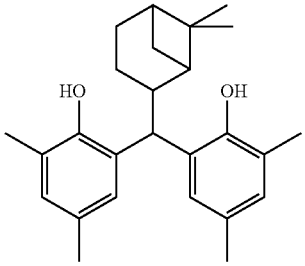
R1-71
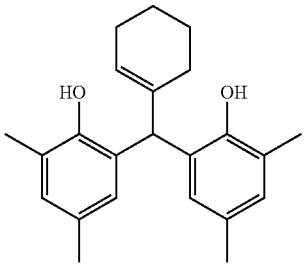
-continued
R1-72
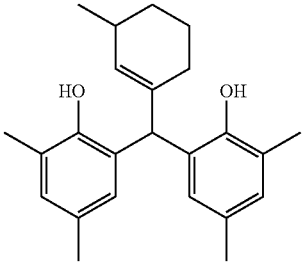
R1-73
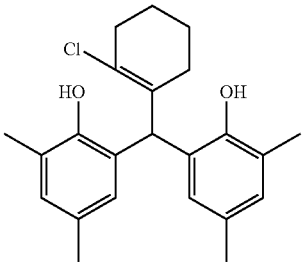
R1-74
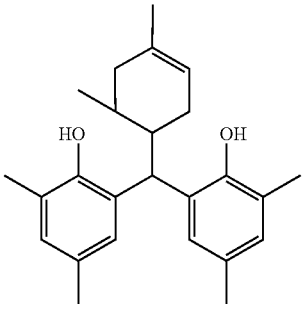
R1-75
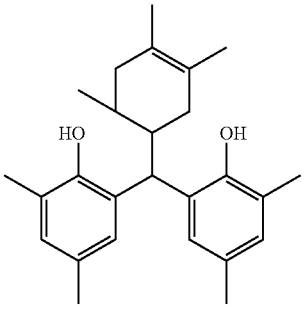
R1-76
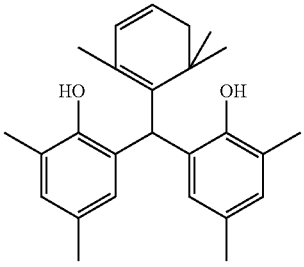

-continued
R1-77
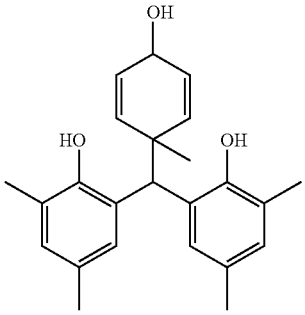
R1-78
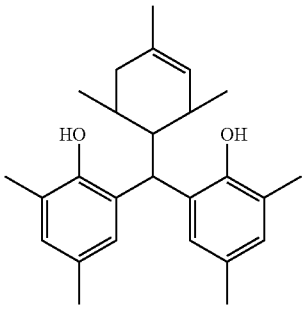
R1-79
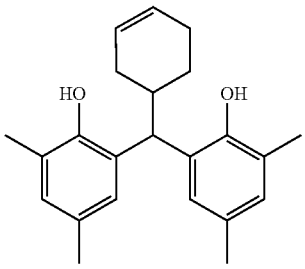
R1-80
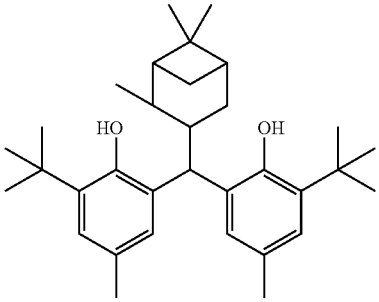
R1-81
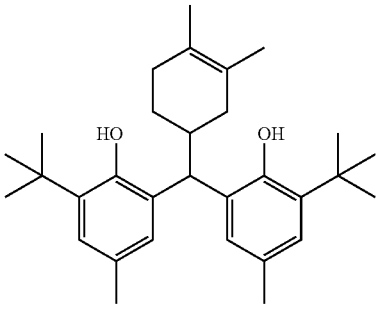
-continued
R1-82
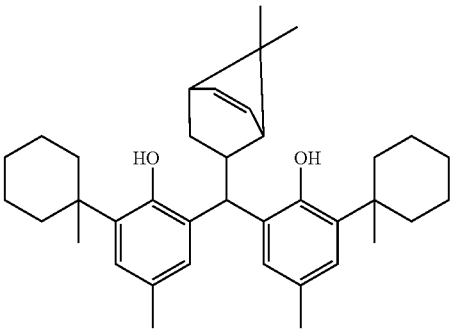
R1-83
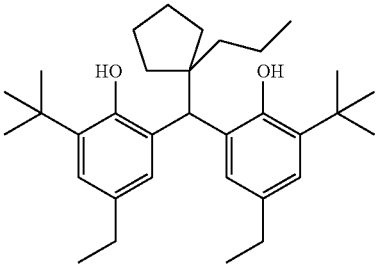
R1-84
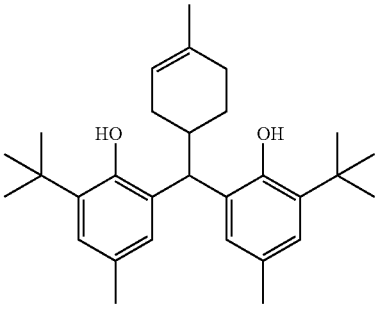
R1-85
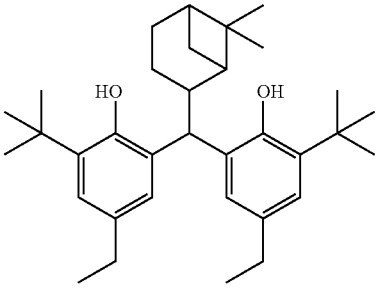
R1-86
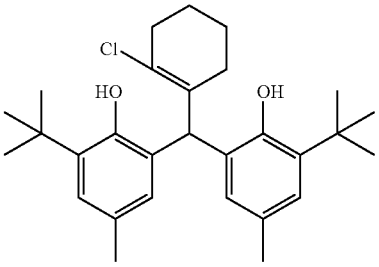

-continued
R1-87
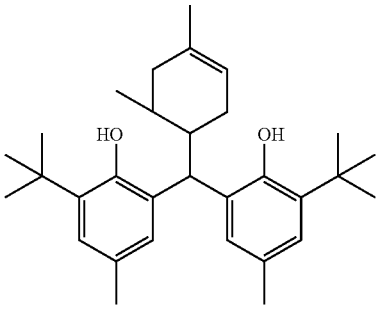
R1-88
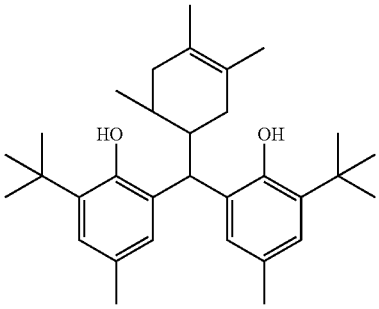
R1-89
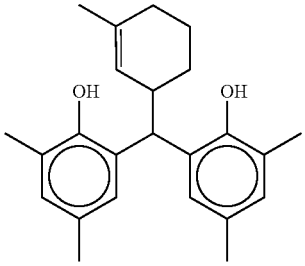
R1-90
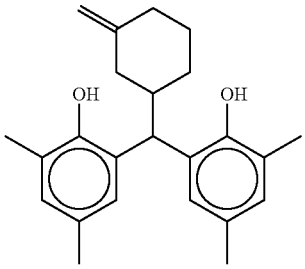
R1-91
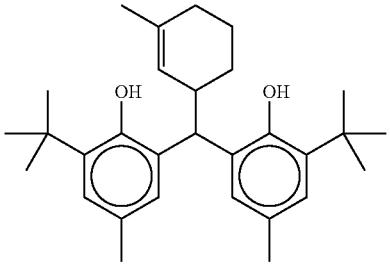
-continued
R1-92
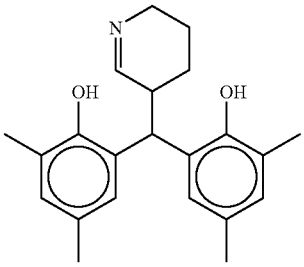
R1-93
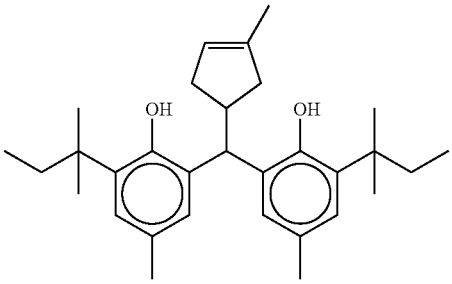
R1-94
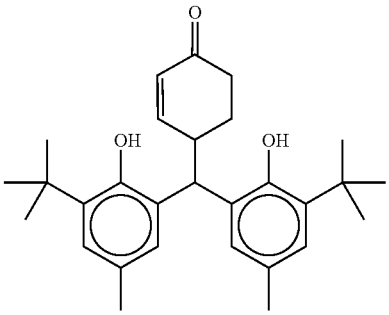
R1-95
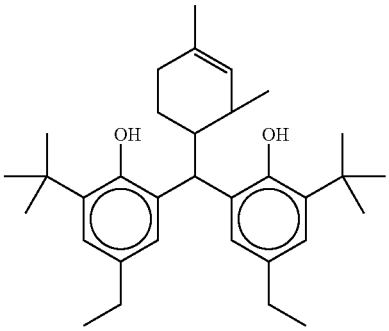
R1-96
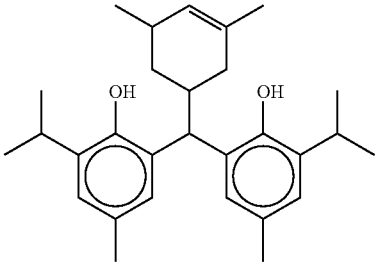

-continued
R1-97
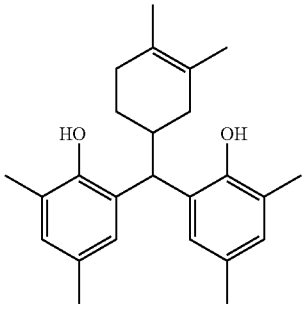
R1-98
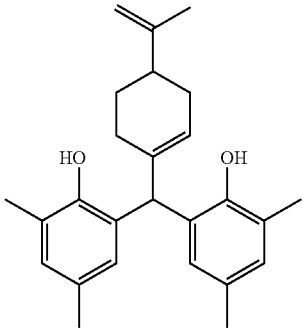
R1-99
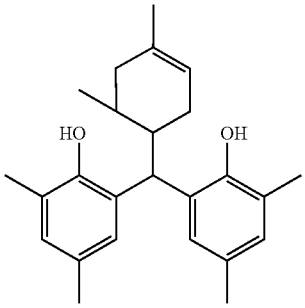
R1-100
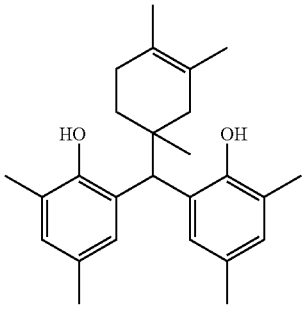
R1-101
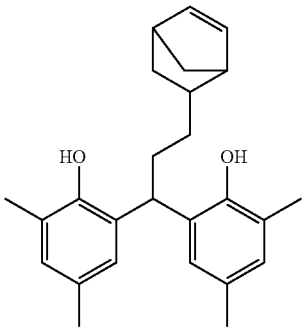
-continued
R1-102
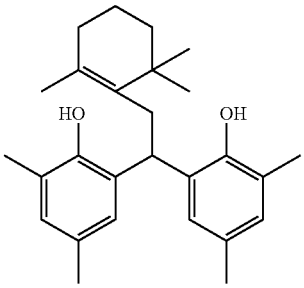
R1-103
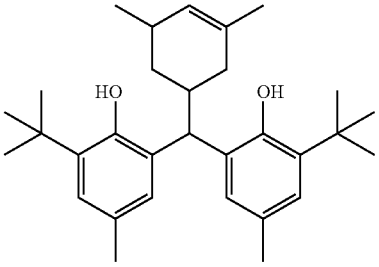
R1-104
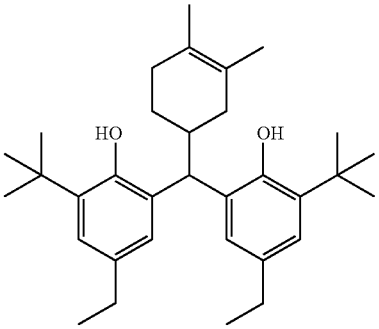
R1-105
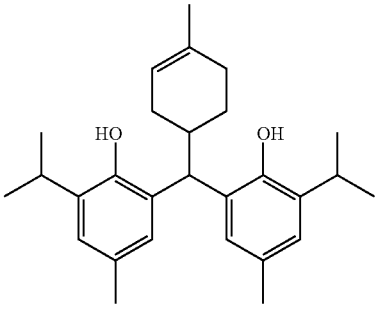
R1-106
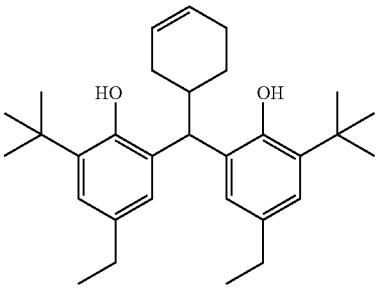
In the invention, the addition amount of the reducing agent is, preferably, from 0.1 g/m$^2$ to 3.0 g/m$^2$, more preferably, 0.2 g/m$^2$ to 1.5 g/m$^2$ and, further preferably 0.3 g/m$^2$ to 1.0 g/m$^2$. It is, preferably, contained by 5 mol % to 50 mol %, more preferably, 8 mol % to 30 mol % and, further preferably, 10 mol % to 20 mol % per one mole of silver on the surface having an image forming layer. The reducing agent preferably is contained in the image forming layer.

In the invention, the reducing agent may be incorporated into photosensitive material by being added into the coating solution, such as in the form of a solution, an emulsion dispersion, a solid fine particle dispersion, and the like.

As a well known emulsion dispersion method, there can be mentioned a method comprising dissolving the reducing agent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid fine particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range from 1 ppm to 1000 ppm. It is practically acceptable so long as Zr is incorporated in an amount of 0.5 mg or less per 1 g of silver. Preferably, a preservative (for instance, sodium benzoisothiazolinone salt) is added in the water dispersion.

In the invention, furthermore, the reducing agent is preferably used as solid fine particle dispersion, and is added in the form of fine particles having average particle size from 0.01 μm to 10 μm, and more preferably, from 0.05 μm to 5 μm and, further preferably, from 0.1 μm to 2 μm. In the invention, other solid dispersions are preferably used with this particle size range.

2) Reducing Agent Represented by Formula (R2)

Reducing agent represented by formula (R2) will be described below.

Formula (R2)

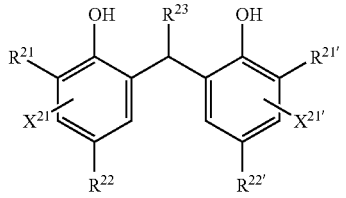

In formula (R2), $R^{21}$ and $R^{21'}$ each independently represent an alkyl group having 1 to 20 carbon atoms. $R^{22}$ and $R^{22'}$ each independently represent a hydrogen atom or a group capable of substituting for a hydrogen atom on a benzene ring. $R^{23}$ represents an alkenyl group or an alkyl group having an unsaturated bond. $X^{21}$ and $X^{21'}$ each independently represent a hydrogen atom or a group capable of substituting for a hydrogen atom on a benzene ring.

Formula (R2) will be described in detail.

(1) $R^{21}$ and $R^{21'}$ $R^{21}$ and $R^{21'}$ each independently represent a substituted or unsubstituted alkyl group having 1 to 20 carbon atoms. The substituent of alkyl group is not particularly limited but preferred examples thereof include an aryl group, a hydroxy group, an akloxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group, a halogen atom and the like.

$R^{21}$ and $R^{21'}$ preferably is a secondary or tertiary alkyl group having 3 to 15 carbon atoms. As specific examples, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group and the like can be described. $R^{21}$ and $R^{21'}$ more preferably is a tertiary alkyl group having 4 to 12 carbon atoms and still more preferably is a t-butyl group, a t-amyl group and a 1-methylcyclohexyl group and most preferably is a t-butyl group.

(2) $R^{22}$ and $R^{22'}$, $X^{21}$ and $X^{21'}$ $R^{22}$ and $R^{22'}$ each independently represent a hydrogen atom or a group capable of substituting for a hydrogen atom on a benzene ring and $X^{21}$ and $X^{21'}$ each independently represent a hydrogen atom or a group capable of substituting for a hydrogen atom on a benzene ring. Preferred examples of the group capable of substituting for a hydrogen atom on a benzene ring include an alkyl group, an aryl group, a halogen atom, an alkoxy group and an acylamino group.

$R^{22}$ and $R^{22'}$ each preferably represent an alkyl group having 1 to 20 carbon atoms and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group and the like. Among these, more preferred are a methyl group, an ethyl group, a propyl group, an isopropyl group and a t-butyl group.

$X^{21}$ and $X^{21'}$ each preferably represent a hydrogen atom, a halogen atom and an alkyl group, and more preferably a hydrogen atom.

(3) $R^{23}$ $R^{23}$ represents an alkenyl group or an alkyl group having an unsaturated bond and having 2 to 20 carbon atoms. An alkenyl group or an alkyl group may be unsubstituted or may have a substituent.

Examples of substituent include a halogen atom, an alkyl group, an alkenyl group, an alkynyl group, a cycloalkyl group, an aryl group, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, a heterocyclic group and the like.

The unsaturated bond of alkyl group preferably is a carbon-carbon unsaturated bond or a carbon-nitrogen unsaturated bond, and more preferably a carbon-carbon unsaturated bond.

The alkyl group having unsaturated bond is concretely an alkyl group having any of a carbon-carbon double bond, a carbon-carbon triple bond, a carbon-nitrogen double bond and a carbon-nitrogen triple bond, and more preferably an alkyl group having a carbon-carbon double bond.

At least one of these groups is contained in a molecule. Two or more of these groups may be contained in a molecule and in this case, these unsaturated bonds either may conjugate or not, however, it is more preferred not to conjugate.
Specific examples of the compound represented by formula (R2) are illustrated below, but the present invention is not limited thereto.
R2-1
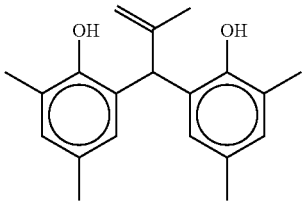
R2-2
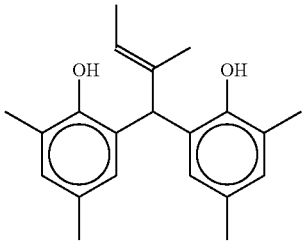
R2-3
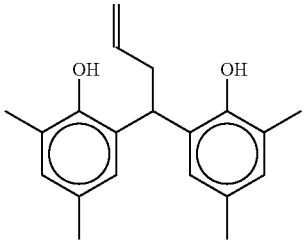
R2-4
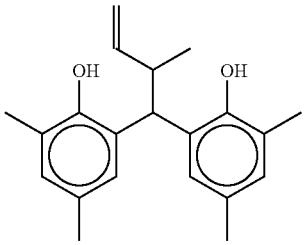
R2-5
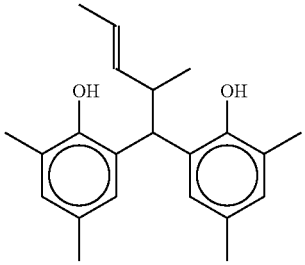
-continued
R2-6
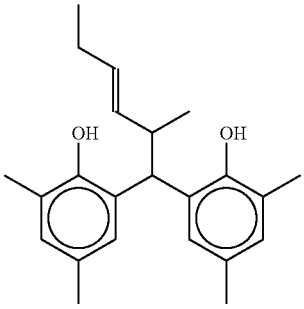
R2-7
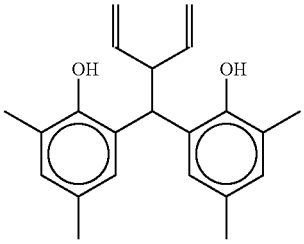
R2-8
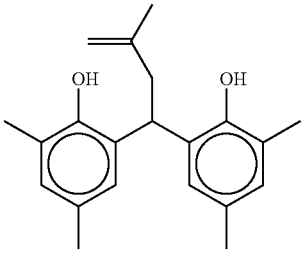
R2-9
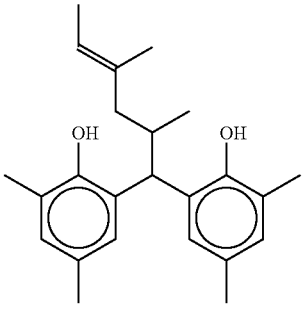
R2-10
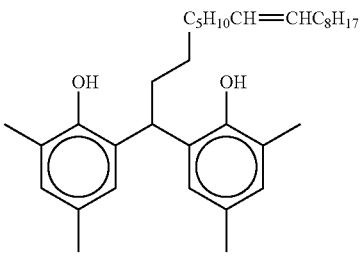

-continued
R2-11
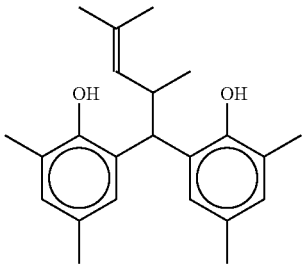
R2-12
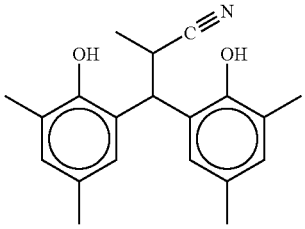
R2-13
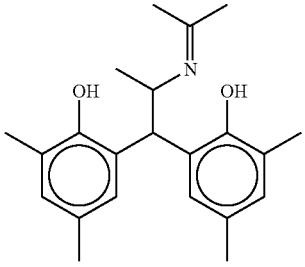
R2-14
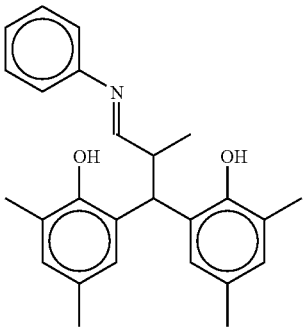
R2-15
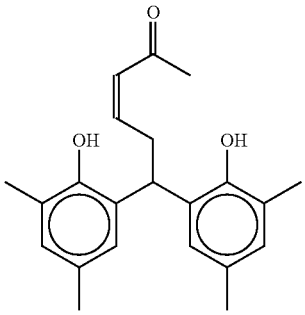
-continued
R2-16
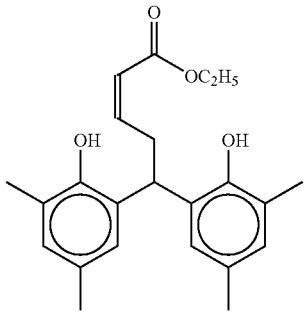
R2-17
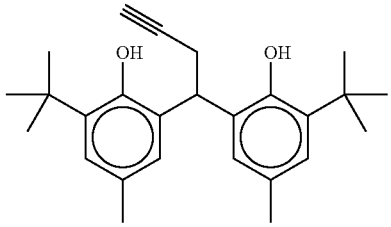
R2-18
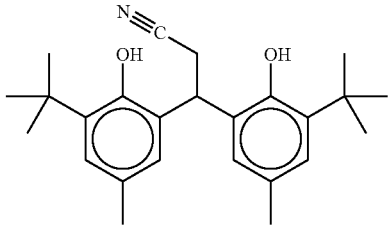
R2-19
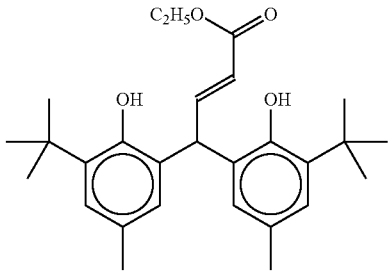
R2-20
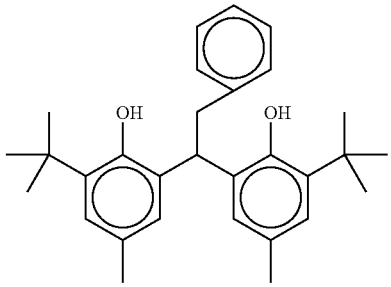
R2-21
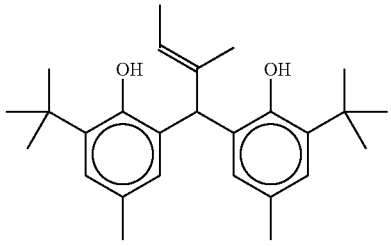

-continued
R2-22
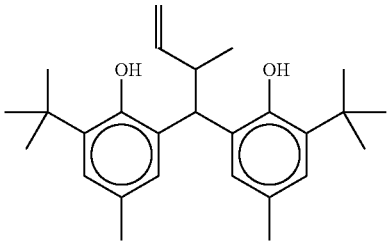
R2-23
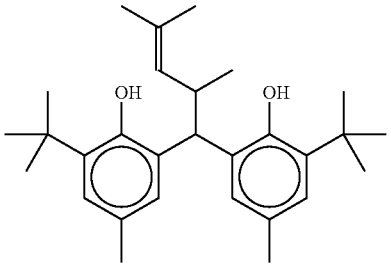
R2-24
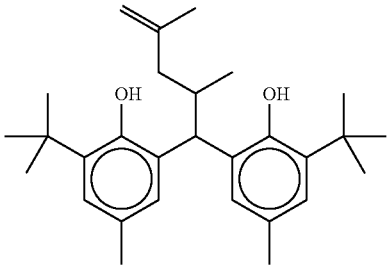
R2-25
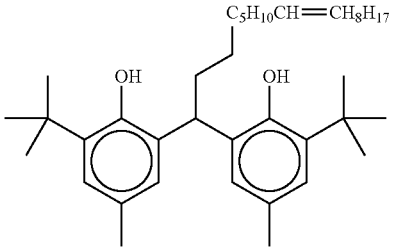
R2-26
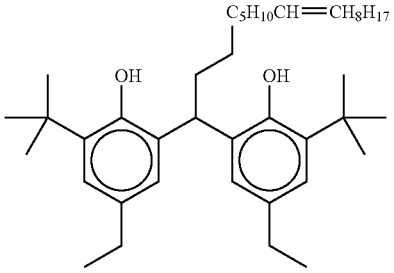
R2-27
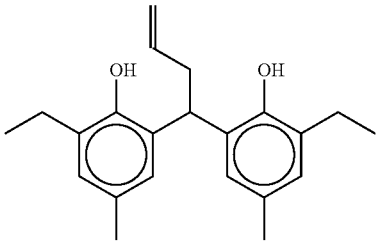
-continued
R2-28
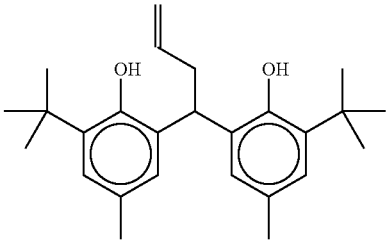
R2-29
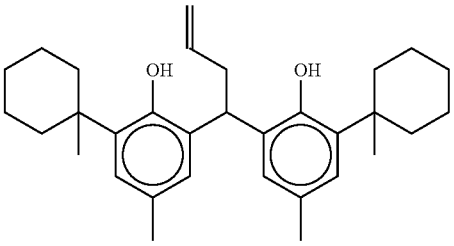
R2-30
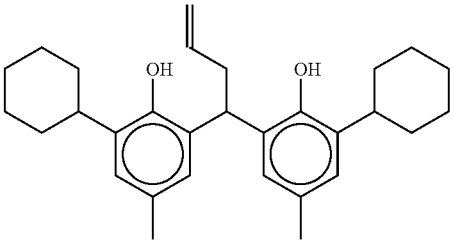
R2-31
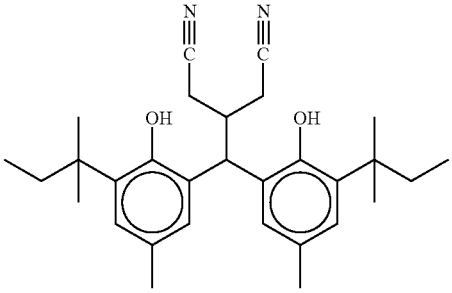
R2-32
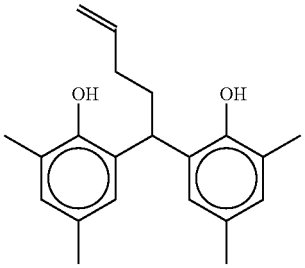
R2-33
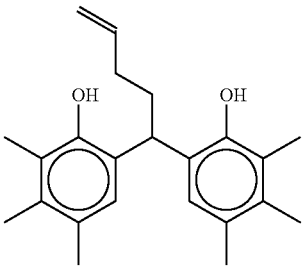

-continued
R2-34
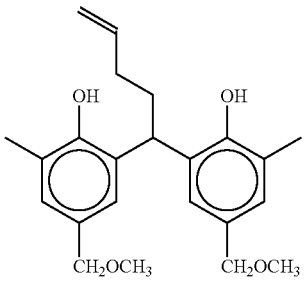
R2-35
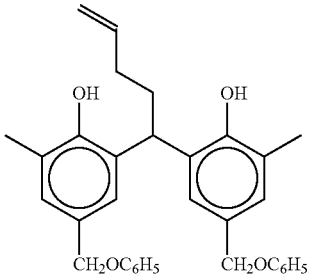
R2-36
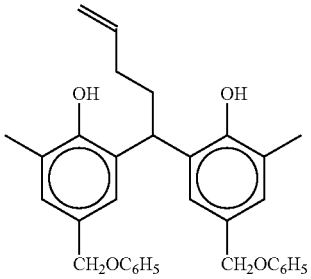
R2-37
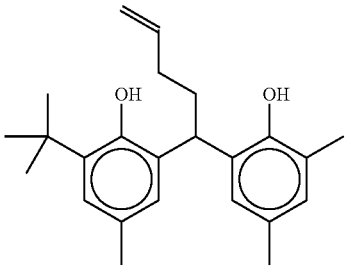
R2-38
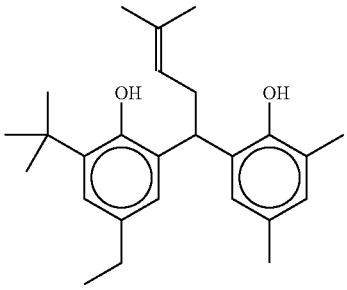
-continued
R2-39
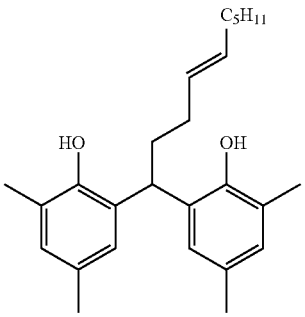
R2-40
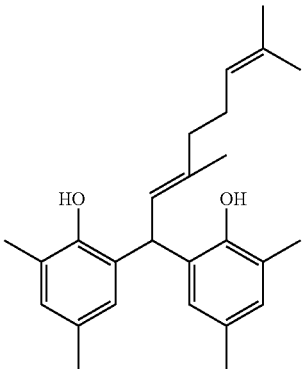
R2-41
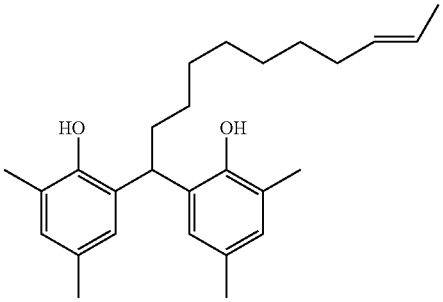
R2-42
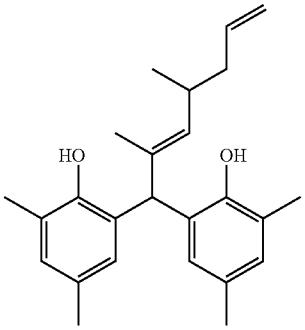

-continued
R2-43
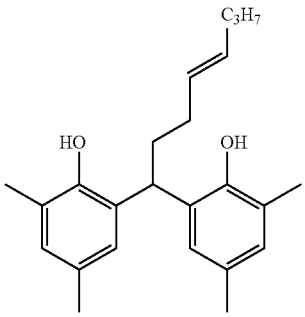
R2-44
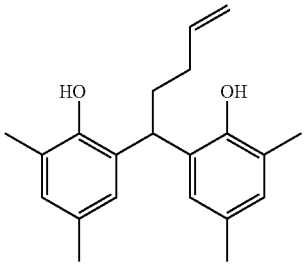
R2-45
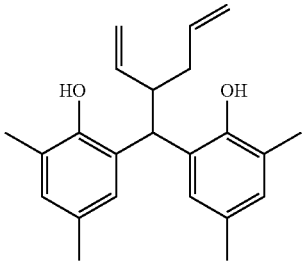
R2-46
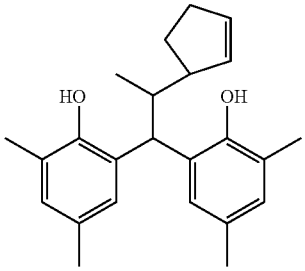
R2-47
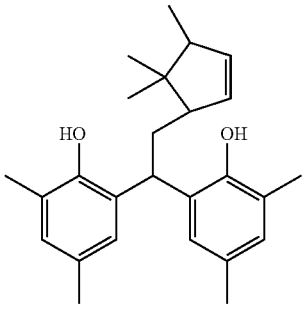
-continued
R2-48
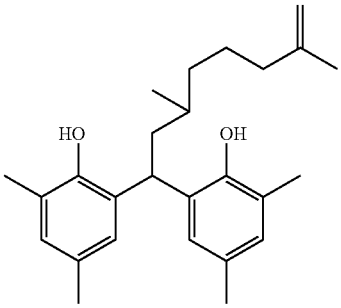
R2-49
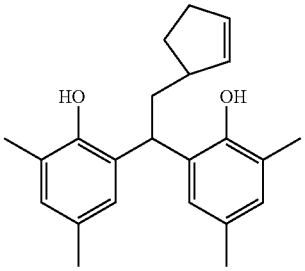
R2-50
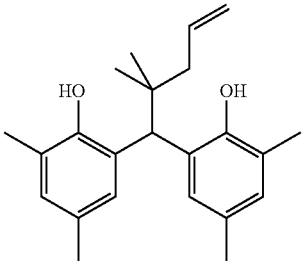
R2-51
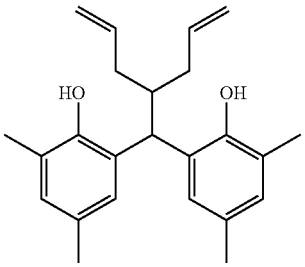
R2-52
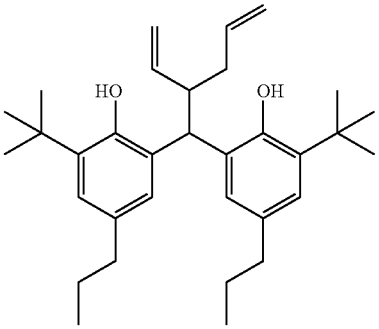

-continued

R2-53

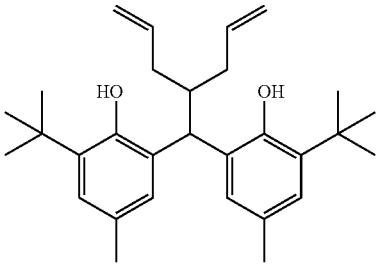

R2-54

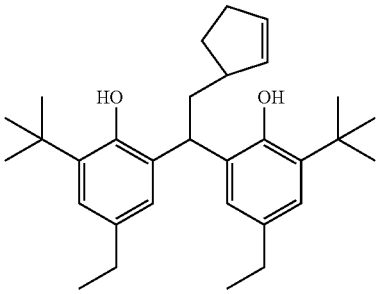

R2-55

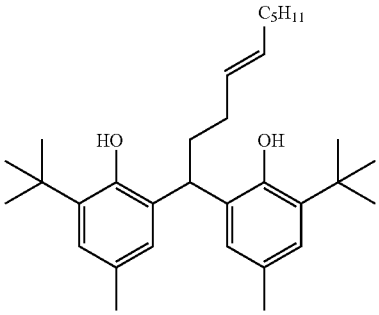

R2-56

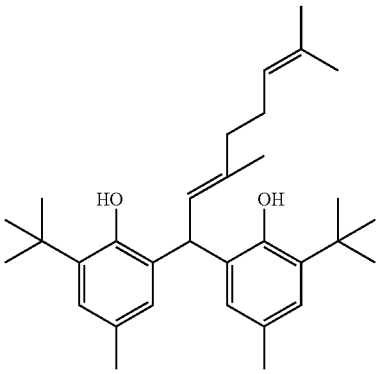

R2-57

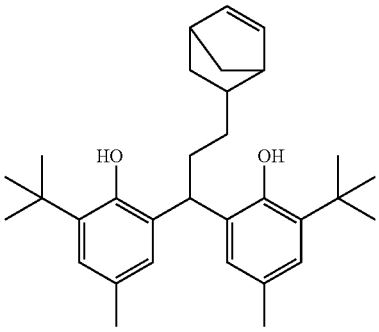

-continued

R2-58

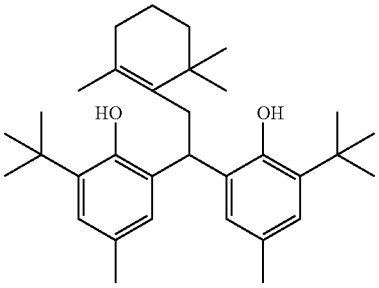

The reducing agent in the present invention may be used independently or plural kinds of the reducing agent may be used in combination. In the case of combination, it may be selected among different kinds of compound belonging to formula (R1) and different kinds of compound belonging to formula (R2), or among formula (R1) and formula (R2).

For example, the addition ratio of the compound represented by formula (R1) to the compound represented by formula (R2) is from 10/90 to 90/10, preferably from 20/80 to 80/20.

The compound represented by formula (R1) of the present invention may be added into a coating solution in any form such as in the form of a solution, an emulsion dispersion, a solid fine particle dispersion, and the like, similar to the compound represented by formula (R1) described above.

Preferred addition method is similar to the case of compound represented by formula (R1) described above.

In the invention, the addition amount of the reducing agent is, preferably, from 0.1 g/m$^2$ to 3.0 g/m$^2$, more preferably, 0.2 g/m$^2$ to 1.5 g/m$^2$ and, further preferably 0.3 g/m$^2$ to 1.0 g/m$^2$. It is, preferably, contained by 5 mol % to 50 mol %, more preferably, 8 mol % to 30 mol % and, further preferably, 10 mol % to 20 mol % per one mole of silver on the surface having an image forming layer.

In the case of using plural kinds of reducing agent in combination, total addition amount of those preferably is within the above-described range.

The reducing agent may be added to any layer on the side having thereon the photosensitive layer, however, preferably an image forming layer or the layer adjacent to the image forming layer, and more preferably the image forming layer.

3) Other Reducing Agent that Can Be Used in Combination with the Reducing Agent of the Invention As for the photothermographic material of the invention, other reducing agent can be used in combination with the compound represented by formulae (R1) and (R2).

The reducing agent which can be used in combination may be any substance (preferably, organic substance) capable of reducing silver ions into metallic silver. Examples of the reducing agent are described in JP-A No. 11-65021 (column Nos. 0043 to 0045) and EP-A 0803764 A1 (p. 7, line 34 to p. 18, line 12).

In the invention, a so-called hindered phenolic reducing agent or a bisphenol agent having a substituent at the ortho-position to the phenolic hydroxyl group is preferred and the compound represented by the following formula (R) is more preferred.

Formula (R)

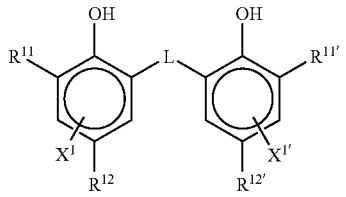

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents a —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Now, formula (R) will be described specifically.

(1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, and halogen atom.

(2) $R^{12}$ and $R^{12'}$, $X^1$ and $X^{1'}$ $R^{12}$ and $R^{12'}$ each independently represent a hydrogen atom or a group capable of substituting for a hydorgen atom on a benzene ring. $X^1$ and $X^{1'}$ each independently represent a hydrogen atom or a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

(3) L

L represents a —S— group or a —$CHR^{13}$— group. $R^{13}$ represents a hydrogen atom or an alkyl group having 1 to 20 carbon atoms in which the alkyl group may have a substituent. Specific examples of the non-substituted alkyl group for $R^{13}$ can include, for example, methyl group, ethyl group, propyl group, butyl group, heptyl group, undecyl group, isopropyl group, 1-ethylpentyl group, and 2,4,4-trimethylpentyl group. Examples of the substituent for the alkyl group can include, like substituent $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

(4) Preferred Substituents $R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represents, more preferably, tertiary alkyl group having 4 to 12 carbon atoms and, among them, t-butyl group, t-amyl group, 1-methylcyclohexyl group are further preferred, tbutyl group being most preferred.

$R^{12}$ and $R^{12'}$ are, preferably, alkyl groups having 1 to 20 carbon atoms and can include, specifically, methyl group, ethyl group, propyl group, butyl group, isopropyl group, tbutyl group, t-amyl group, cyclohexyl group, 1-methylcyclohexyl group, benzyl group, methoxymethyl group and methoxyethyl group. More preferred are methyl group, ethyl group, propyl group, isopropyl group, and t-butyl group.

$X^1$ and $X^{1'}$ are, preferably, a hydrogen atom, halogen atom, or alkyl group, and more preferably, hydrogen atom.

L is preferably a group —$CHR^{13}$—.

$R^{13}$ is, preferably, a hydrogen atom or an alkyl group having 1 to 15 carbon atoms. The alkyl group is preferably methyl group, ethyl group, propyl group, isopropyl group and 2,4,4-trimethylpentyl group. Particularly preferred $R^{13}$ is a hydrogen atom, methyl group, propyl group or isopropyl group.

In a case where $R^{13}$ is a hydrogen atom, $R^{12}$ and $R^{12'}$ each represent, preferably, an alkyl group having 2 to 5 carbon atoms, ethyl group and propyl group being more preferred and ethyl group being most preferred.

In a case where $R^{13}$ is a primary or secondary alkyl group having 1 to 8 carbon atom, $R^{12}$ and $R^{12'}$ each represent preferably methyl group. As the primary or secondary alkyl group of 1 to 8 carbon atoms for $R^{13}$, methyl group, ethyl group, propyl group and isopropyl group are more preferred, and methyl group, ethyl group, and propyl group are further preferred.

In a case where each of $R^{11}$, $R^{11'}$ and $R^{12}$, $R^{12'}$ is methyl group, $R^{13}$ is preferably a secondary alkyl group. In this case, the secondary alkyl group for $R^{13}$ is preferably isopropyl group, isobutyl group and 1-ethylpentyl group, with isopropyl group being more preferred.

The reducing agent described above shows different thermal developing performances or developed-silver tones or the like depending on the combination of $R^{11}$, $R^{11'}$ and $R^{12}$, $R^{12'}$, as well as $R^{13}$. Since these performances can be controlled by using two or more kinds of reducing agents at various mixing ratios, it is preferred to use two or more kinds of reducing agents in combination depending on the purpose.

Specific examples of the reducing agents of the invention including the compounds represented by formula (R) according to the invention are shown below, but the invention is not restricted to them.

(Red-1)

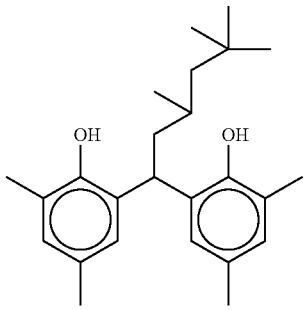

(Red-2)

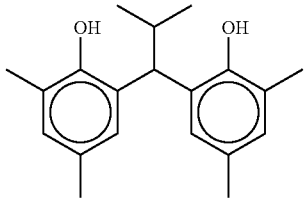

-continued (Red-3)

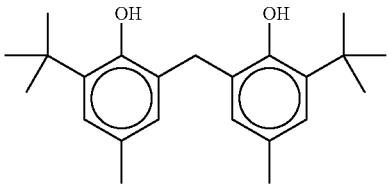

(Red-4)

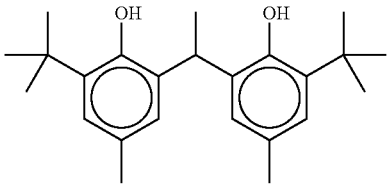

(Red-5)

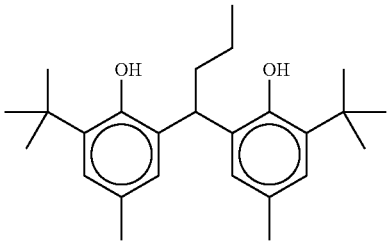

(Red-6)

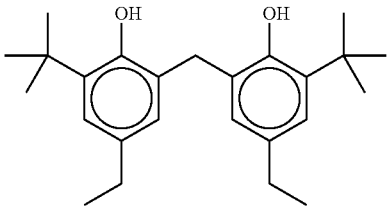

(Red-7)

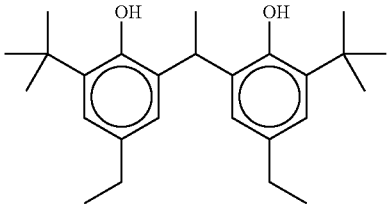

(Red-8)

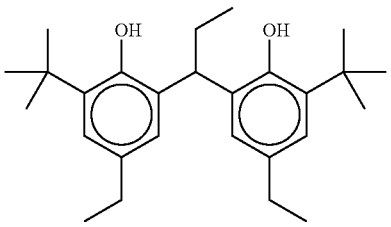

(Red-9)

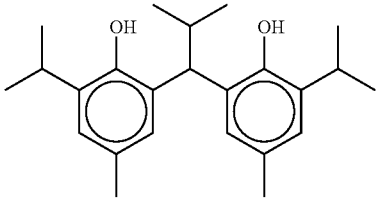

-continued (Red-10)

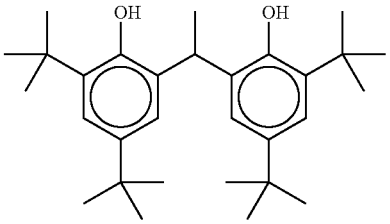

(Red-11)

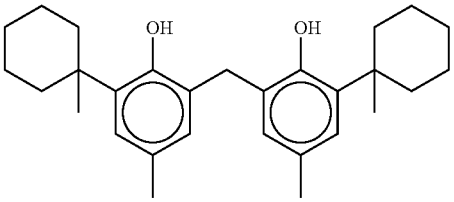

(Red-12)

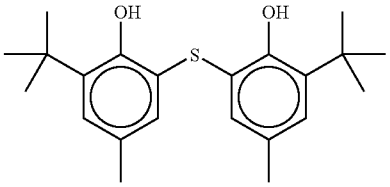

(Red-13)

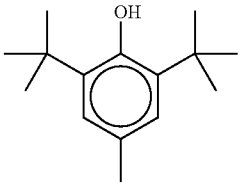

(Red-14)

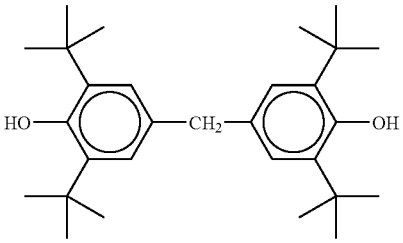

(Red-15)

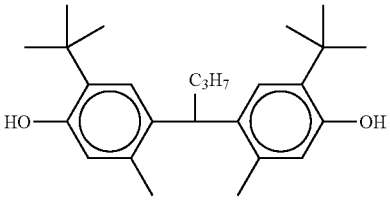

As preferred reducing agents of the invention other than those above, there can be mentioned compounds disclosed in JP-A Nos. 2001-188314, 2001-209145, 2001-350235, and 2002-156727.

The compound represented by formula (R) may be incorporated into photosensitive material by dispersing similar to the reducing agent of the invention.

In the invention, the addition ratio of the compound represented by formula (R) to the compounds represented by formulae (R1) and (R2), namely (R/(R1+R2)), is 90/10 to 0/100, preferably 70/30 to 0/100, and further preferably 50/50 to 0/100. Total addition amount of these reducing agents preferably is in the same range described above for the reducing agent of the invention.

1-2. Compound Represented by Formulae (1a), (1b) or (1c)

The compounds represented by formulae (1a), (1b) or (1c) in the embodiment of the present invention are described below.

$$R—Y_1-(L_1)_{n1}—CX_1X_2X_3 \quad \text{Formula (1a)}$$

wherein, $X_1$, $X_2$ and $X_3$ each independently represent a hydrogen atom or a substituent, provided that at least one of $X_1$, $X_2$ and $X_3$ is a halogen atom. $L_1$ represents a sulfonyl group. n1 represents 0 or 1. $Y_1$ represents —N($R_1$)—, a sulfur atom, an oxygen atom, a selenium atom, or —($R_2$)C═C($R_3$)—, and $R_1$, $R_2$ and $R_3$ each independently represent a hydrogen atom or a substituent. R represents a hydrogen atom, a halogen atom, an aliphatic group, an aryl group, or a heterocyclic group.

$$R—Y_1-L_2-CX_1X_2X_3 \quad \text{Formula (1b)}$$

wherein, $X_1$, $X_2$ and $X_3$ each independently represent a hydrogen atom or a substituent, provided that at least one of $X_1$, $X_2$ and $X_3$ is a halogen atom. $L_2$ represents a carbonyl group or a sulfinyl group. $Y_2$ represents —N($R_1$)—, a sulfur atom, an oxygen atom, a selenium atom, or —($R_2$)C═C($R_3$)—, and $R_1$, $R_2$ and $R_3$ each independently represent a hydrogen atom or a substituent. R represents a hydrogen atom, a halogen atom, an aliphatic group, an aryl group, or a heterocyclic group.

$$R—Y_3-(L_3)_{n2}—CX_1X_2X_3 \quad \text{Formula (1c)}$$

wherein, $X_1$, $X_2$ and $X_3$ each independently represent a hydrogen atom or a substituent, provided that at least one of $X_1$, $X_2$ and $X_3$ represents a halogen atom. $L_3$ represents a sulfonyl group, a carbonyl group, or a sulfinyl group. n2 represents 2 or 3. $Y_3$ represents a single bond, —N($R_1$)—, a sulfur atom, an oxygen atom, a selenium atom, or —($R_2$)C═C($R_3$)—, and $R_1$, $R_2$ and $R_3$ each independently represent a hydrogen atom or a substituent. R represents a hydrogen atom, a halogen atom, an aliphatic group, an aryl group, or a heterocyclic group.

The compound represented by formulae (1a), (1b) and (1c) will be described below.

In formulae (1a) and (1b) described above, $X_1$, $X_2$ and $X_3$ each independently represent a hydrogen atom or a substituent, provided that at least one of $X_1$, $X_2$ and $X_3$ represents a halogen atom. The halogen atom is F, Cl, Br or I. In the case of more than two or more are substituted, the halogen atoms may be the same or different, preferably, Cl or Br, and more preferably Br.

A subtituent other than a halogen atom may be any substituent, but is preferably an alkyl group, an alkenyl group, an aryl group, an alkoxy group, an acyl group, an alkoxycarbonyl group, an aryloxy group, an aryloxycarbonyl group, a carbamoyl group, a sulfamoyl group, an acyloxy group, an acylamino group, an alkoxycarbonylamino group, an aryloxycarbonylamino group, a sulfonylamino group, an ureido group, a phosphoramido group, a sulfinyl group, a hydroxy group, a heterocyclic group. These groups may be further substituted. Among these, an electron-attracting group is preferable, such as an electron-attracting-group-substituted alkyl group, acyl group, alkoxy group, aryloxycarbonyl group, carbamoyl group, sulfamoyl group and etc., and more preferably an electron-attracting-group-substituted alkyl group.

$CX_1X_2X_3$ group preferably is a trihalomethyl group wherein all of $X_1$, $X_2$ and $X_3$ are halogen atoms, and more preferably a tribromomethyl group wherein all of the halogen atoms are Br.

$Y_1$ and $Y_2$ each independently represent —N($R_1$)—, a sulfur atom, an oxygen atom, a selenium atom, or —($R_2$)C═C($R_3$)—. $R_1$, $R_2$, and $R_3$ each independently are a hydrogen atom or a substituent. $Y_1$ and $Y_2$ independently preferably are —N($R_1$)—, an oxygen atom, or a vinyl group, and particularly preferably —N($R_1$)—. In the case where $Y_1$ represents —N($R_1$)— in formula (1a), $R_1$ is preferably an alkyl group.

R and $R_1$, or R and $R_3$ may bond together to form a ring. The ring is preferably an alicyclic group. The ring may include a heteroatom.

In the case where $Y_2$ represents —N($R_1$)— in formula (1b), $R_1$ is preferably a hydrogen atom.

R represents a hydrogen atom, a halogen atom, an aliphatic group, an aryl group, or a heterocyclic group.

The aliphatic group is a substituted or an unsubstituted aliphatic group, and may be linear, branched, or cyclic alkyl group, alkenyl group, alkinyl group, aryl group, or heterocyclic group. The alkyl group preferably is a substituted or an unsubstituted alkyl group having 1 to 30 carbon atoms. Preferred examples include methyl, ethyl, n-propyl, isopropyl, t-butyl, n-octyl, eicosyl, 2-chloroethyl, 2-cyanoethyl, 2-ethylhexyl, cyclohexyl, cyclopentyl, 4-n-dodecylcyclohexyl, bicyclo[1,2,2]heptan-2-yl, bicyclo[2,2,2]octan-3-yl, and the like.

Preferred among the alkenyl group is a substituted or an unsubstituted alkenyl group having 2 to 30 carbon atoms. Examples include vinyl, aryl, prenyl, geranyl, oleyl, 2-cyclopenten-1-yl, 2-cyclohexen-1-yl, bicyclo[2,2,1]hept-2-en-1-yl, bicyclo[2,2,2]oct-2-en-4-yl, and the like.

Preferred among the alkenyl group is a substituted or an unsubstituted alkenyl group having 2 to 30 carbon atoms. Examples include ethynyl, propargyl, a trimethylsilylethyl group and the like.

Preferred among the aryl group represents a substituted or an unsubstituted aryl group having 6 to 30 carbon atoms. Examples can include phenyl, p-tolyl, naphtyl, m-chlorophenyl, o-hexadecanylaminophenyl, and the like.

The heterocyclic group is preferably an aromatic or non-aromatic five or six-membered heterocyclic group, wherein the heterocyclic group means a univalent heterocyclic group derived from a heterocyclic compound by removal of one hydrogen atom. Examples can include a furyl group, a thienyl group, a pyrimidyl group, a benzothiazolyl group, a pyridyl group, a triazinyl group, a thiazol group, a benzothiazol group, an oxazolyl group, a benzoxazol group, an imidazolyl group, a pyrazolyl group, an indazol group, an indol group, a purine group, a quinoline group, an isoquinoline group, a quinazoline group, a piperidyl group and the like.

In the aforementioned formulae (1a) and (1b), R preferably is an aliphatic group, an aryl group, or a heterocyclic group, more preferably an alkyl group or an aryl group, and particularly preferably an alkyl group. In the case that R is an aliphatic group, an aryl group or a heterocyclic group, R may preferably be further substituted with a —$Y_1$—$(L_1)_{n1}$—$CX_1X_2X_3$ group or a —$Y_2$—$L_2$—$CX_1X_2X_3$ group. In this case, R preferably has additionally from one to three —$Y_1$—$(L_1)_{n1}$—$CX_1X_2X_3$ groups in formula (1a), and R preferably has additionally from one to three —$Y_2$—$L_2$—$CX_1X_2X_3$ groups in formula (1b), wherein each of $Y_1$, $L_1$, n1, $X_1$, $X_2$, $X_3$, $Y_2$ and $L_2$ represent the same as those in formulae (1a) and (1b).

$L_1$ represents a sulfonyl group, and $L_2$ represents a carbonyl group or a sulfinyl group. n1 represents 0 or 1, and preferably 1.

The compounds represented by formula (1c) are described below. In formula (1c), $X_1$, $X_2$, $X_3$ and R represent the same as defined in formulae (1a) and (1b), and preferable range of R is also the same as defined therein.

In the case that R is an aliphatic group, an aryl group, or a heterocyclic group, R preferably has several (preferably 2 or 4) —$Y_3$—$(L_3)_{n2}$—$CX_1X_2X_3$, wherein, each of $Y_3$, n2, $X_1$, $X_2$, $X_3$ and $L_3$ are the same as those in formula (1c).

$Y_3$ in formula (1c) represents a single bond, —$N(R_1)$—, a sulfur atom, an oxygen atom, a selenium atom, or —$(R_2)C{=}C(R_3)$—. $R_1$, $R_2$ and $R_3$ each independently represent a hydrogen atom, or a substituent. $Y_3$ represents preferably a single bond, —$N(R_1)$—, an oxygen atom, or a vinyl group, and more preferably a single bond or —$N(R_1)$—. In the case that $Y_3$ is —$N(R_1)$—, $R_1$ preferably represents an alkyl group or a hydrogen atom.

R and $R_1$ or R and $R_3$ may bond together to form a ring, and preferably an alicyclic group. The ring may include a heteroatom. $L_3$ represents a sulfonyl group, a carbonyl group, or a sulfinyl group, and more preferably a sulfonyl group. $n_2$ represents 2 or 3, and preferably 2.

In the present invention, more preferable compound among the compounds represented by formulae (1a) to (1c) is a compound represented by formulae (1a) or (1b), and particularly preferable is a compound described represented by formula (1b).

Halogeno compounds represented by formulae (1a) to (1c) may comprise a ballasted group, wherein the ballasted group means a substituent having 8 or more carbon atoms in total, preferably 8 to 100 carbon atoms, more preferably 8 to 60 carbon atoms, and further more preferably 10 to 40 carbon atoms. Preferable ballasted group include an aliphatic hydrocarbon group (for example, an alkyl group, an alkenyl group, an alkynyl group and etc), an aryl group, a heterocyclic group, or combination of these groups with an ether group, a thioether group, a carbonyl group, an amino group, a sulfonyl group, and a phosphonyl group. The ballasted group may represent a polymer. Practical examples of ballasted group are described, for example, in Reseach Disclosure, 1995/2, 37938, pages 82 to 89, JP-A Nos. 1-280747, and 1-283548.

The ballasted group may be added as a substituent represented by the aforementioned $R_1$, $R_2$ and $R_3$, or as an aliphatic group represented by R, or as a substituent represented by $X_1$, $X_2$, and $X_3$. Specific examples of the compound represented by formulae (1a) to (1c) are described below, however, the present invention is not limited thereto.

1a-1

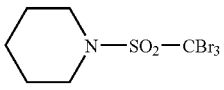

1a-2

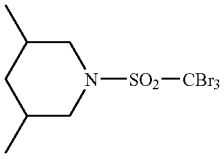

-continued 1a-3

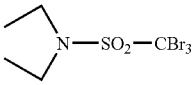

1a-4

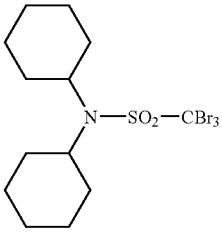

1a-5

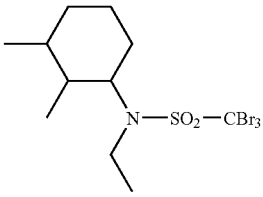

1a-6

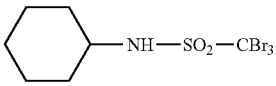

1a-7

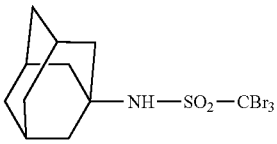

1a-8

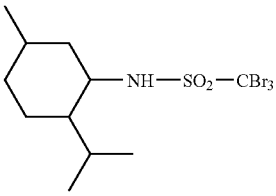

1a-9

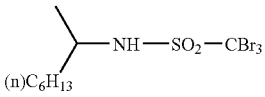

1a-10

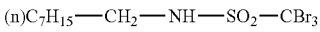

1a-11

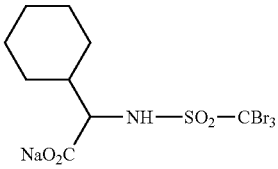

1a-12

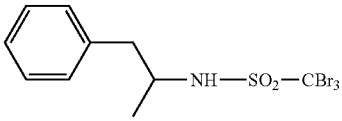

1a-13

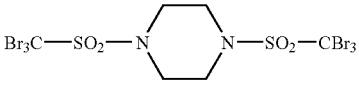

-continued
1a-14
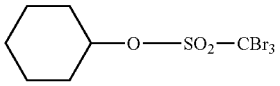
1a-15
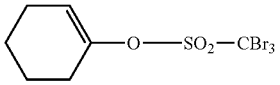
1a-16
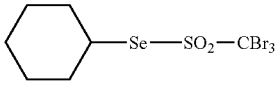
1a-17
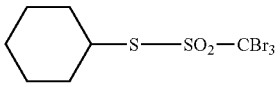
1a-18
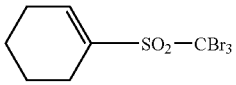
1a-19
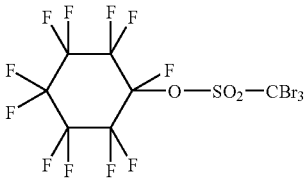
1a-20
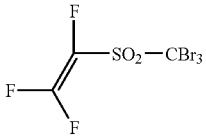
1a-21
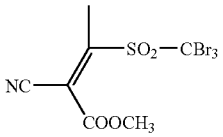
1a-22
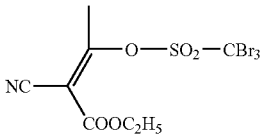
1a-23
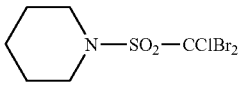
1a-24
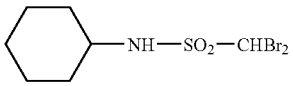
1a-25
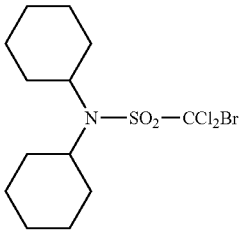
-continued
1a-26
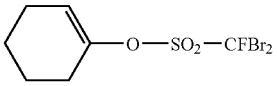
1a-27
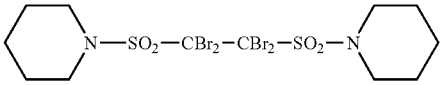
1a-28
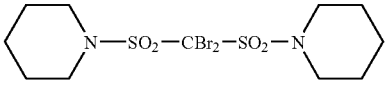
1a-29
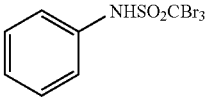
1a-30
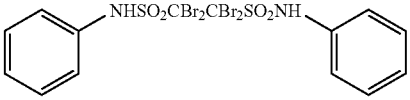
1a-31
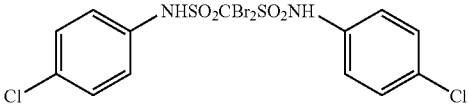
1a-32
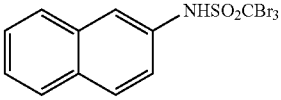
1a-33
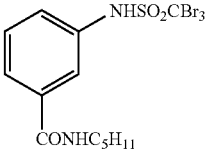
1a-34
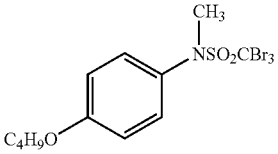
1a-35
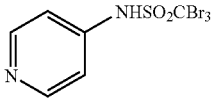
1a-36
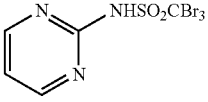
1a-37
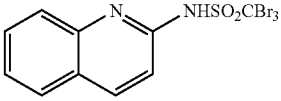
1a-38
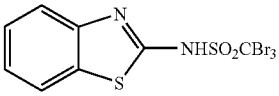

-continued
1b-1
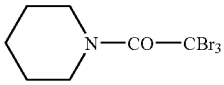
1b-2
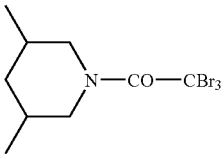
1b-3
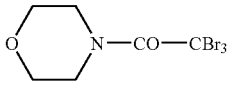
1b-4
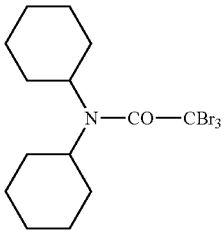
1b-5
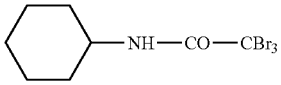
1b-6
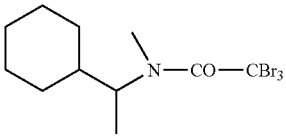
1b-7
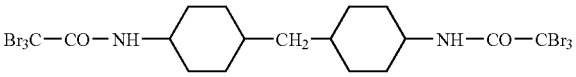
1b-8
1b-9
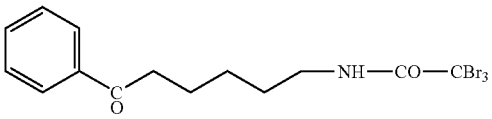
1b-10
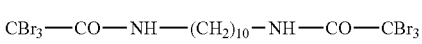
1b-11
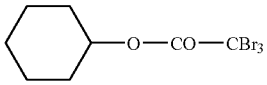
1b-12
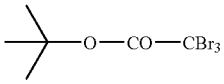
1b-13
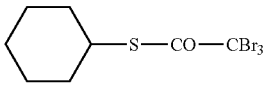
1b-14
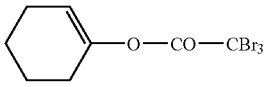
-continued
1b-15
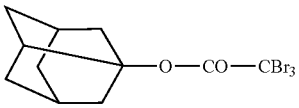
1b-16
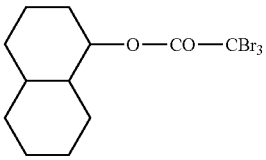
1b-17
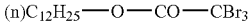
1b-18
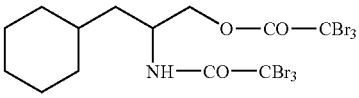
1b-19
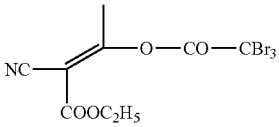
1b-20
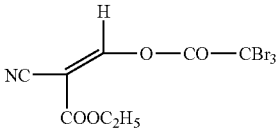
1b-21
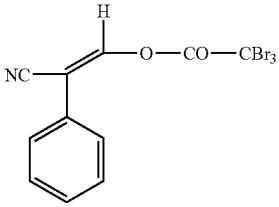
1b-22
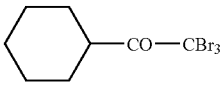
1b-23
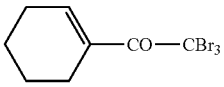
1b-24
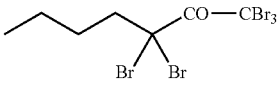
1b-25
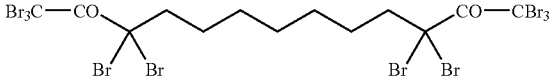
1b-26
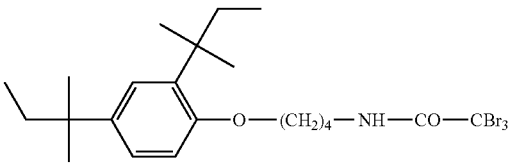
1b-27
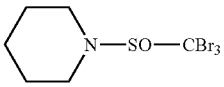

-continued 1b-28

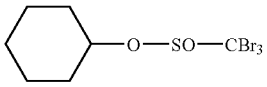

1b-29

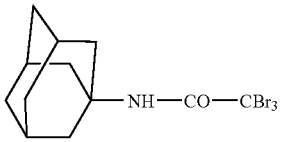

1b-30

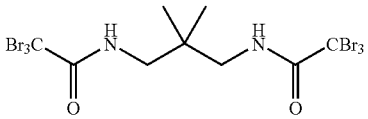

1b-31

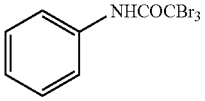

1b-32

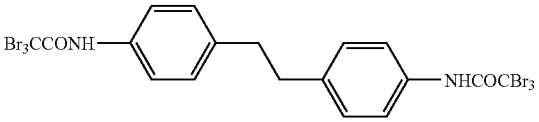

1b-33

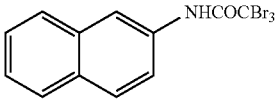

1b-34

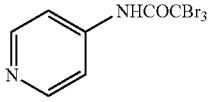

1b-35

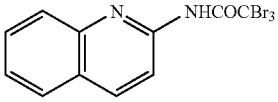

1b-36

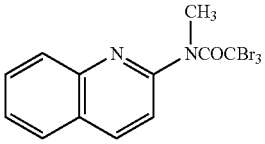

1b-37

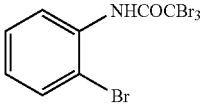

1b-38

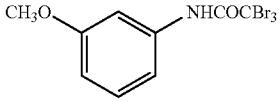

1b-39

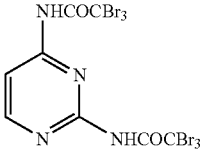

-continued 1b-40

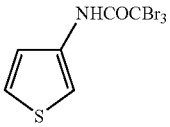

1c-1

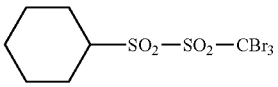

1c-2

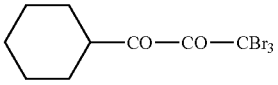

1c-3

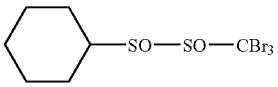

1c-4

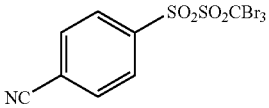

1c-5

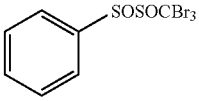

1c-6

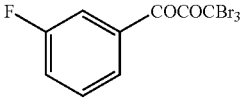

1c-7

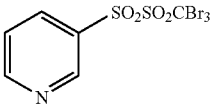

In the invention, at least one kind of compounds represented by formulae (1a), (1b) and (1c) is used, and two or more kinds of these compounds may be used in combination.

The addition amount of the compound represented by formula (1a), (1b) or (1c) is preferably in the range from $1\times10^{-4}$ mol to 1 mol, more preferably from $1\times10^{-3}$ mol to 0.5 mol, and still more preferably from $1\times10^{-2}$ mol to 0.2 mol, per one mol of a non-photosensitive organic silver salt in the image forming layer.

The compound represented by formulae (1a), (1b) or (1c) is preferably added to the surface side including the image forming layer, more preferably is added in the image forming layer or the layer adjacent to the image forming layer, and particularly preferably is added in the image forming layer.

In the invention, a method of incorporating an organic polyhalogen compound into a photosensitive material is described in a method of incorporating a reducing agent described above. Regarding the organic polyhalogen compound, it is preferably added in the form of solid fine particle dispersion.

1-3. Imagewise Coloring Compound

In this invention, an imagewise coloring compound is preferably used for adjusting a color tone of the image. The imagewise coloring compound of this invention represents a compound which does not form a dye at a non-image station which was not substantially exposed, by a thermal development, and formes a dye at an image station where a developed silver is formed.

The aforementioned compound may develop a color alone or may form a dye by a coupling reaction through two or more compounds.

As a silver image generated by a thermal development is predominantly in a magenta component than in a neutral color, the dyes formed by imagewise coloring compounds absorb preferably at a yellow region or a cyan region.

As to an absorption wavelength region of dyes, the aforementioned dyes preferably absorb 70% or more in a yellow region of 350 nm to 500 nm or in a cyan region of 600 nm to 700 nm, more preferably in the region of 350 nm to 500 nm, and particularly preferably in the region of 380 nm to 460 nm.

Examples of the aforementioned compound which form a dye alone, include phenols having a methyl group at para position or a methylene group substituted by a heteroatom, or parabisphenols having a specific substituent at ortho position.

Examples of the compound which formes a dye by a coupling reaction through two or more compounds, include paraphenylenediamines, carbamoylhydrazines, and compounds known as a color coupler, for example, 2-acylaminophenols, naphtols, pyrrotriazoles, pyrazolotriazoles, 5-pyrazolones, and acylacetonitriles.

Preferable examples of the aforementioned compounds are the compounds described in JP-A Nos. 2001-330923, 2001-330925 and 2002-49123.

Particularly preferable compounds in the invention are compounds represented by the following formula (C).

Formula (C)

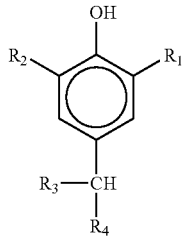

In formula (C), $R_1$ and $R_2$ each independently represent a halogen atom, an alkyl group, an alkoxy group, an amino group, an acylamino group, an acyloxy group, an acyl group, an acyloxycarbonyl group, a sulfide group, a sulfonyl group, a disulfide group, a sulfamoyl group or a carbamoyl group. $R_3$ and $R_4$ each independently represent a hydrogen atom, a halogen atom, a hydroxyl group, an amino group, an alkoxy group, an aryloxy group, an acyloxy group, an acylamino group, a sulfide group, a disulfide group, an aryl group or a heterocyclic group.

Halogen atom represented by $R_1$ and $R_2$ is preferably a chlorine atom or a bromine atom, and more preferably a chlorine atom.

Alkyl group represented by $R_1$ and $R_2$ is preferably an alkyl group having 1 to 24 carbon atoms, and more preferably an alkyl group having 3 to 12 carbon atoms, and they may have a substituent. The alkyl group may be linear, branched or cyclic. Examples can include a methyl group, an ethyl group, an n-butyl group, an n-dodecyl group, an isopropyl group, a t-butyl group, a t-amyl group, a cyclohexyl group, an 1-methylcyclohexyl group, a benzyl group, a 2-hydroxybenzyl group, a 3-t-butyl-5-methyl-2-hydroxybenzyl group, a chloromethyl group, and a hydroxymethyl group, and the like. A secondary or a tertiary alkyl group, a cycloalkyl group or a benzyl group is preferable, and more preferable is a tertiary alkyl group, or a benzyl group.

Alkoxy group represented by $R_1$ and $R_2$ is preferably an alkoxy group having 1 to 20 carbon atoms, more preferably an alkoxy group having 1 to 12 carbon atoms, and they may have a substituent. Examples can include a methoxy, an ethoxy group, an isopropoxy group, a t-butoxy group, an octyloxy group, a cyclohexyl oxy group, a benzyloxy group, a methoxyethoxy group and the like. Amino group represented by $R_1$ and $R_2$ is an amino group having preferably 1 to 20 carbon atoms, more preferably an amino group having 2 to 12 carbon atoms, and they may have a substituent. Examples can include an amino group, an N-methylamino group, an N,N-dimethylamino group, an N-butylamino group, an anilino group, an N-methylamino group, a cyclohexylmethylamino group, a piperidinyl group, a morpholino group, and the like.

Acylamino group represented by $R_1$ and $R_2$ is preferably an acylamino group having 1 to 20 carbon atoms, more preferably an acylamino group having 1 to 12 carbon atoms, and they may have a substituent. Examples can include an acetylamino group, a methylureido group, an ethylurethane group, a benzoylamino group, a propionylamino group, a pivaloylamino group and the like.

Acyloxy group represented by $R_1$ and $R_2$ is preferably an acyloxy groups having 1 to 20 carbon atoms, more preferably an acyloxy group having 1 to 12 carbon atoms, and they may have a substituent. Examples can include an actoxy group, a benzoyloxy group and the like.

Acyl group represented by $R_1$ and $R_2$ is preferably an acyl group having 1 to 20 carbon atoms, more preferably an acyl group having 1 to 12 carbon atoms, and they may have a substituent. Examples can include an actyl group, a myristoyl group, a benzoyl group and the like.

Alkoxycarbonyl group represented by $R_1$ and $R_2$ is preferably an alkoxycarbonyl group having 1 to 20 carbon atoms, more preferably an alkoxycarbonyl group having 1 to 12 carbon atoms, and they may have a substituent. Examples can include a methoxycarbonyl group, a cyclohexyloxycarbonyl group, an octyloxycarbonyl group and the like.

Carbamoyl group represented by $R_1$ and $R_2$ is preferably a carbamoyl group having 1 to 20 carbon atoms, more preferably a carbamoyl group having 1 to 12 carbon atoms, and they may have a substituent. Examples can include an N,N-dimethylcarbamoyl group, an N,N-diethylcabamoyl group and the like.

$R_1$ and $R_2$ each preferably represent an alkyl group or a benzyl group, more preferably represent an alkyl group or a benzyl group wherein at least one of them represents a secondary or a tertiary alkyl or a benzyl group, and particularly preferably a tertiary alkyl group or a benzyl group.

When $R_3$ and $R_4$ each independently represent a halogen atom, an alkoxy group, an amino group, an acyloxy group, and an acylamino group, $R_3$ and $R_4$ are the same as $R_1$ and $R_2$ described above. Aryloxy group represented by $R_3$ and $R_4$ is preferably an aryloxy group having 6 to 25 carbon atoms. Examples can include a phenoxy group, a naphthoxy group, a cresyloxy group, a xylyloxy group, a 4-methoxyphenoxy group, 2,4-dichlorophenoxy group and the like.

Aryl group represented by $R_3$ and $R_4$ preferably is an aryl group having 6 to 25 carbon atoms. Examples can include a phenyl group, a naphtyl group, a cresyl group, a xylyl group, a 4-methoxyphenyl group, a 2,4-dichlorophenyl group, a 3,5-dimethyl-4-hydroxyphenyl group, a 3-methyl-5-t-butyl-4-hydroxyphenyl group, a 3,5-di-t-butyl-4-hydroxyphenyl group and the like.

Heterocyclic group represented by $R_3$ and $R_4$ preferably is a heterocyclic group having 3 to 25 carbon atoms. Examples can include a pyridinyl group, a quinolyl group and the like.

$R_3$ and $R_4$ each preferably represent a hydrogen atom, an aryl group, an alkoxy group, a hydroxy group or an amino group, and more preferably a hydrogen atom or an aryl group. It is particularly preferred that one of $R_3$ and $R_4$ is a hydrogen atom.

Preferable examples represented by formula (C) are shown below, however, the present invention is not limited thereto.

C-1

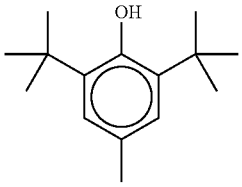

C-2

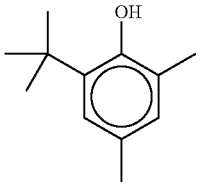

C-3

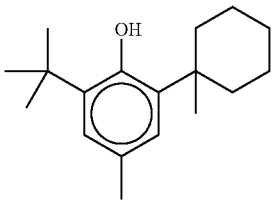

C-4

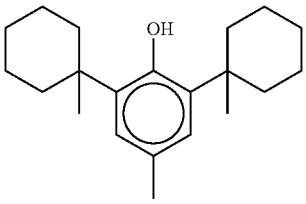

C-5

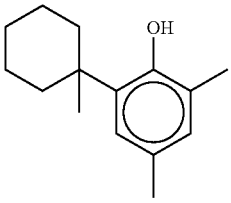

-continued

C-6

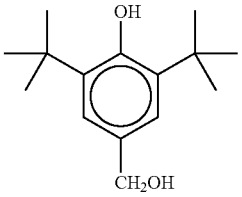

C-7

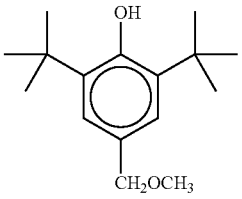

C-8

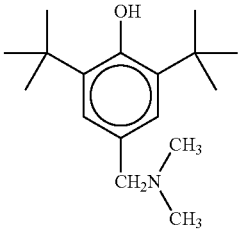

C-9

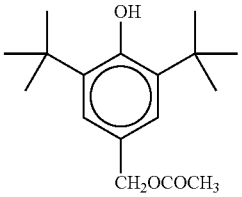

C-10

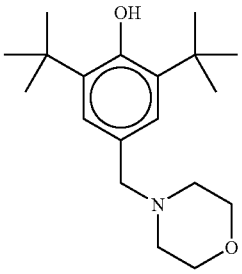

C-11

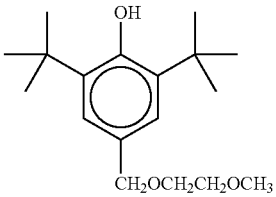

C-12

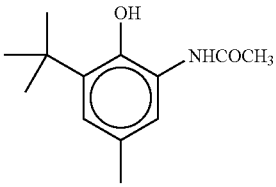

-continued
C-13
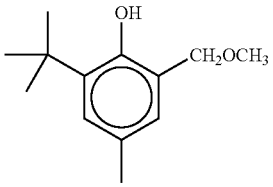
C-14
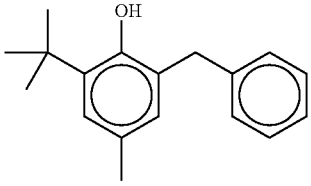
C-15
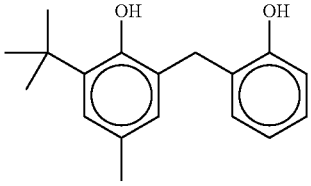
C-16
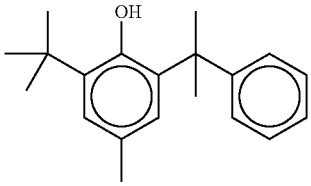
C-17
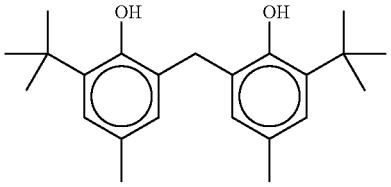
C-18
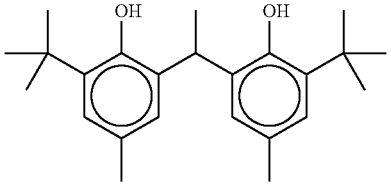
C-19
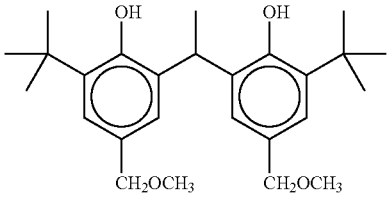
C-20
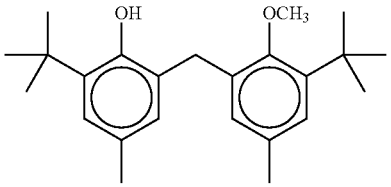
-continued
C-21
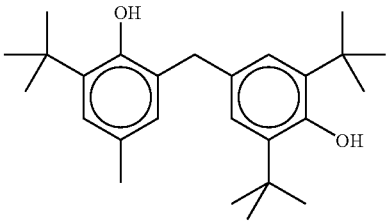
C-22
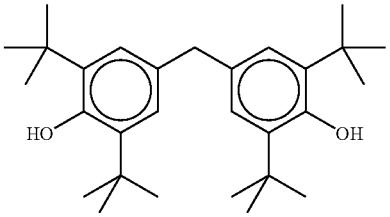
C-23
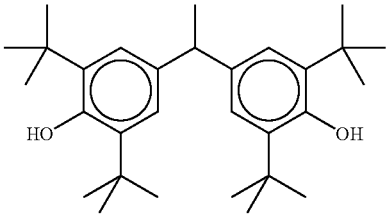
C-24
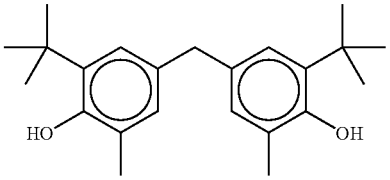
C-25
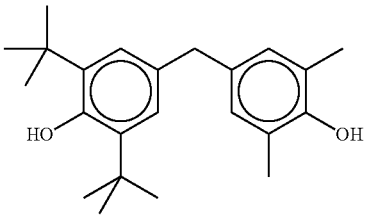
C-26
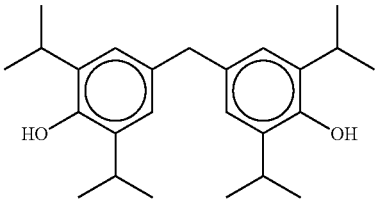
C-27
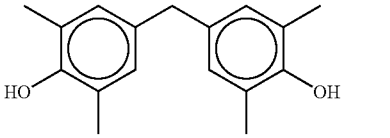

-continued
C-28
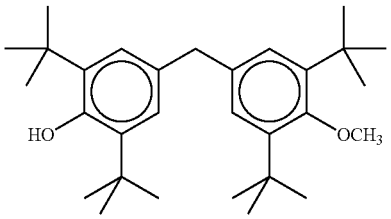
C-29
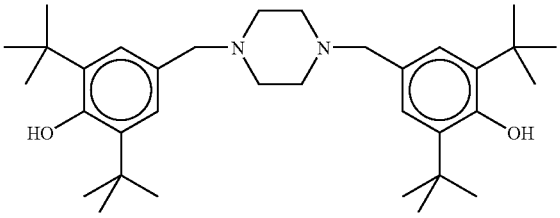
C-30
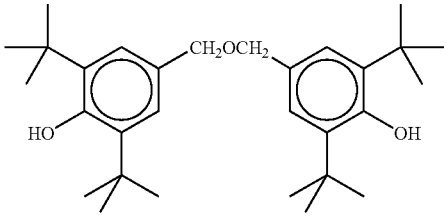
C-31
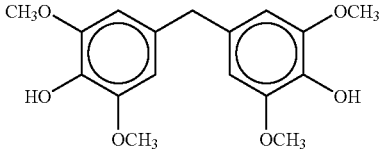
C-32
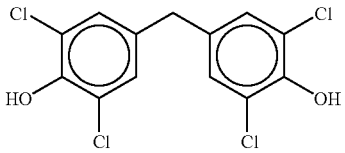
C-33
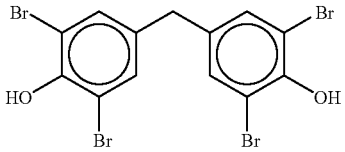
C-34
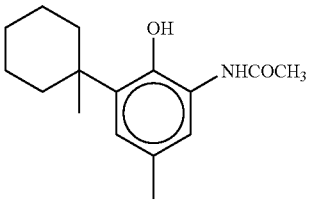
C-35
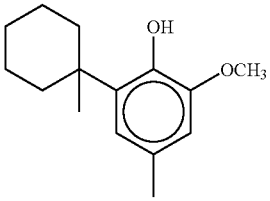
-continued
C-36
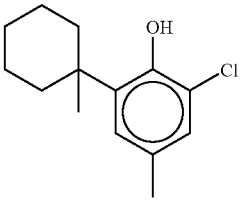
C-37
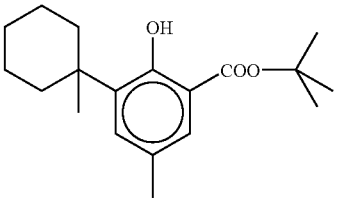
C-38
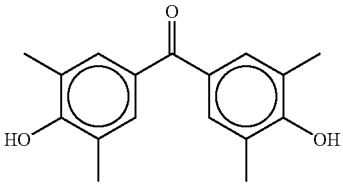
C-39
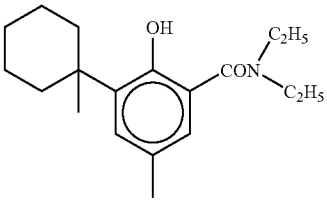
C-40
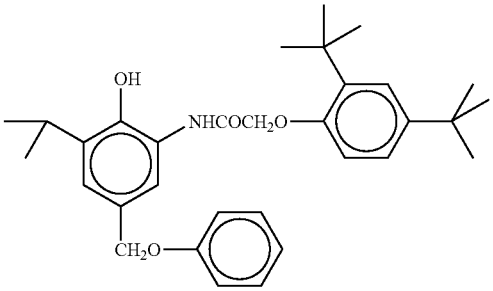
C-41
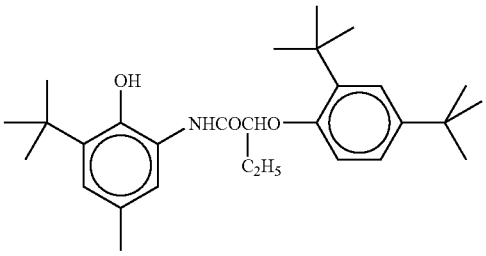

-continued

C-42

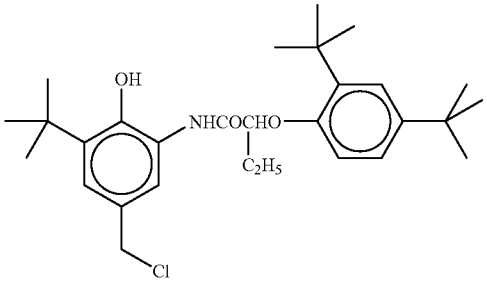

C-43

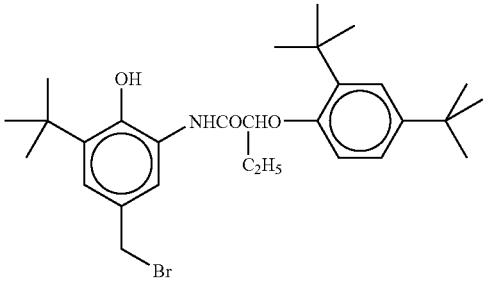

C-44

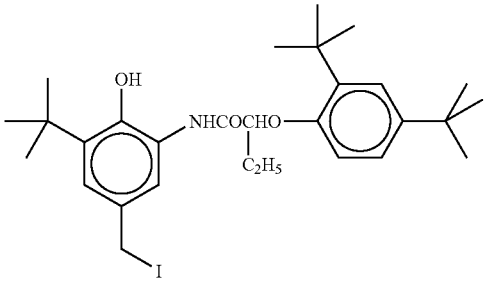

C-45

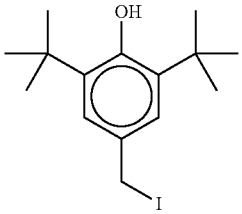

C-46

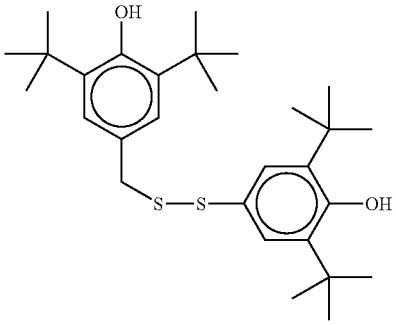

The compounds represented by formula (C) may be added to the photothermographic material by a method similar to the method for the reducing agent of the invention. The addition amount of the compound is preferably in an amount of 0.1 mol % to 50 mol %, and more preferably 1 mol % to 10 mol % based on the reducing agent.

1-4. Organic Silver Salt

1) Composition

The organic silver salt particle according to the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 962812A1, JP-A Nos. 11-349591, 2000-7683, and 2000-72711, and the like. A silver salt of organic acid, particularly, a silver salt of long chained fatty acid carboxylic acid (having 10 to 30 carbon atoms, preferably, having 15 to 28 carbon atoms) is preferable. Preferred examples of the silver salt of fatty acid can include, for example, silver lignocerate, silver behenate, silver arachidinate, silver stearate, silver oleate, silver laurate, silver capronate, silver myristate, silver palmitate, silver erucate and mixtures thereof. Among the silver salts of fatty acid, it is preferred to use a silver salt of fatty acid with the silver behenate content of 50 mol % or more, more preferably, 85 mol % or more, further preferably, 95 mol % or more. And, it is preferred to use a silver salt of fatty acid with the silver erucate content of 2 mol % or less, more preferably, 1 mol % or less, further preferably, 0.1 mol % or less.

It is preferred that the content of the silver stearate is 1 mol % or less. When the content of the the silver stearate is 1 mol % or less, a silver salt of organic acid having low Dmin, high sensitivity and excellent image stability can be obtained. The content of the silver stearate above-mentioned, is preferably 0.5 mol % or less, more preferably, the silver stearate is not substantially contained. Further, in the case the silver salt of organic acid includes silver arachidinic acid, it is preferred that the content of the silver arachidinic acid is 6 mol % or less in order to obtain a silver salt of organic acid having low Dmin and excellent image stability. The content of the silver arachidinate is more preferably 3 mol % or less.

2) Shape

There is no particular restriction on the shape of the organic silver salt usable in the invention and it may needle-like, bar-like, plate-like or flaky shape.

In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of more than 5. Particularly, a particle with the major axis to minor axis ratio of 3 or less is preferred since it can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flaky shape. The relation is preferably: 30≧x (average)≧1.5 and, more preferably, 15≧x (average)≧1.5. By the way, needle-like is expressed as 1≦x (average)<1.5.

In the flaky shaped particle, a can be regarded as a thickness of a plate particle having a main plate with b and c being as the sides. a in average is preferably 0.01 μm to 0.3 μm and, more preferably, 0.1 μm to 0.23 μm. c/b in average preferably 1 to 9, more preferably, 1 to 6 and, further preferably, 1 to 4 and, most preferably, 1 to 3.

By controlling the sphere equivalent diameter to 0.05 μm to 1 μm, it causes less agglomeration in the photosensitive material and image stability is improved. The spherical equivalent diameter is preferably 0.1 μm to 1 μm. In the invention, the sphere equivalent diameter can be measured by a method of photographing a sample directly by using an electron microscope and then image-processing negative images.

In the flaky shaped particle, the sphere equivalent diameter of the particle/a is defined as an aspect ratio. The aspect ratio of the flaky particle is, preferably, 1.1 to 30 and, more preferably, 1.1 to 15 with a viewpoint of causing less agglomeration in the photosensitive material and improving the image stability.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The mono-dispersion can be determined from particle size (volume weighted mean diameter) obtained, for example, by a measuring method of irradiating a laser beam to an organic silver salt dispersed in a liquid, and determining a self correlation function of the scattering of scattered light to the change of time.

3) Preparing Method

Methods known in the art may be applied to the method for producing the organic silver salt used in the invention, and to the dispersion method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868.

When a photosensitive silver salt is present together during dispersion of the organic silver salt, fog increases and the sensitivity becomes remarkably lower, so that it is more preferred that the photosensitive silver salt is not substantially contained during dispersion. In the invention, the amount of the photosensitive silver salt to be disposed in the aqueous dispersion, is preferably, 1 mol % or less, more preferably, 0.1 mol % or less per one mol of the organic acid silver salt in the solution and, further preferably, positive addition of the photosensitive silver salt is not conducted.

In the invention, the photosensitive material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, in the range from 1 mol % to 30 mol %, more preferably, in the range from 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing are used preferably for controlling the photographic properties.

4) Addition Amount

While an organic silver salt in the invention can be used in a desired amount, an amount of an organic silver salt is preferably in the range from 0.9 g/m$^2$ to 1.9 g/m$^2$ with respect to total coating amount of Ag including silver halide. It is preferable that an amount of total silver preferably is in the range from 1.0 g/m$^2$ to 1.7 g/m$^2$, and more preferably from 1.1 g/m$^2$ to 1.5 g/m$^2$, to improve the image stability. Using the reducing agent of the invention, it is possible to obtain a sufficient image density even with such a low amount of silver.

1-5. Development Accelerator

The photothermographic material of the invention preferably comprises a development accelerator. As the aforementioned development accelerator, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in the range from 0.1 mol % to 20 mol %, preferably, in the range from 0.5 mol % to 10 mol % and, more preferably, in the range from 1 mol % to 5 mol % with respect to the reducing agent.

The introduction methods to the photothermographic material can include the same methods as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use as a development accelerator, hydrazine compounds represented by formula (D) described in the specification of JP-A No. 2002-156727, and phenolic or naphtholic compounds represented by formula (2) described in the specification of JP-A No. 2001-264929.

Particularly preferred development accelerators of the invention are compounds represented by the following formulae (A-1) and (A-2).

$$Q_1\text{-NHNH-}Q_2 \qquad \text{Formula (A-1)}$$

In formula (A-1), $Q_1$ represents an aromatic group or a heterocyclic group coupling at a carbon atom to —NHNH- $Q_2$ and $Q_2$ represents a carbamoyl group, an acyl group, an alkoxycarbonyl group, an aryloxycarbonyl group, a sulfonyl group or a sulfamoyl group.

In formula (A-1), the aromatic group or the heterocyclic group represented by $Q_1$ is, preferably, 5 to 7 membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituents, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-[3-(2,4-tert-pentylphenoxy)propyl)carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbaoyl, N-3-pyridylcarbamoyl and N-benzylcarbamoyl.

The acyl group represented by $Q_2$ is an acyl group, preferably, having 1 to 50 carbon atoms and, more preferably, 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably having 0 to 50 carbon atoms, more preferably, 6 to 40 carbon atoms and can include, for example, not-substituted sulfamoyl, N-ethylsulfamoyl group, N2-ethylhexyl)sulfamoyl, N-decylsulfamoyl, N-hexadecylsulfamoyl, N-{3-(2-ethylhexyloxy)propyl}sulfamoyl, N2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Then, preferred range for the compounds represented by formula (A-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

Formula (A-2)

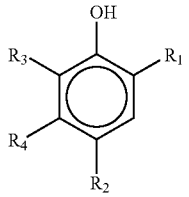

In formula (A-2), $R_1$ represents an alkyl group, an acyl group, an acylamino group, a sulfoneamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group or a carbonate ester group. $R_3$, $R_4$ each represents a group capable of substituting for a hydrogen atom on a benzene ring which is mentioned as the example of the substituent for formula (A-1). $R_3$ and $R_4$ may bond together to form a condensed ring.

$R_1$ is, preferably, an alkyl group having 1 to 20 carbon atoms (for example, methyl group, ethyl group, isopropyl group, butyl group, tert-octyl group, or cyclohexyl group), an acylamino group (for example, acetylamino group, benzoylamino group, methylureido group, or 4-cyanophenylureido group), a carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group), an acylamino group (including ureido group or urethane group) being more preferred. $R_2$ is, preferably, a halogen atom (more preferably, chlorine atom, bromine atom), an alkoxy group (for example, methoxy group, butoxy group, n-hexyloxy group, n-decyloxy group, cyclohexyloxy group or benzyloxy group), or an aryloxy group (phenoxy group or naphthoxy group).

$R_3$ preferably is a hydrogen atom, a halogen atom or an alkyl group having 1 to 20 carbon atoms, and most preferably a halogen atom. $R_4$ is preferably a hydrogen atom, alkyl group or an acylamino group, and more preferably an alkyl group or an acylamino group. Examples of the preferred substituent thereof are identical with those for $R_1$. In a case where $R_4$ is an acylamino group, $R_4$ may preferably bond with $R_3$ to form a carbostyryl ring.

In a case where $R_3$ and $R_4$ in formula (A-2) bond together to form a condensed ring, a naphthalene ring is particularly preferred as the condensed ring. The same substituent as the example of the substituent referred to for formula (A-1) may bond to the naphthalene ring. In a case where formula (A-2) is a naphtholic compound, $R_1$, is, preferably, a carbamoyl group. Among them, benzoyl group is particularly preferred. $R_2$ is, preferably, an alkoxy group or an aryloxy group and, particularly, preferably an alkoxy group.

Preferred specific examples for the development accelerator of the invention are to be described below. The invention is not restricted to them.

(A-1)

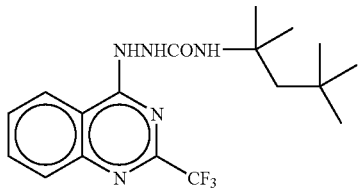

(A-2)

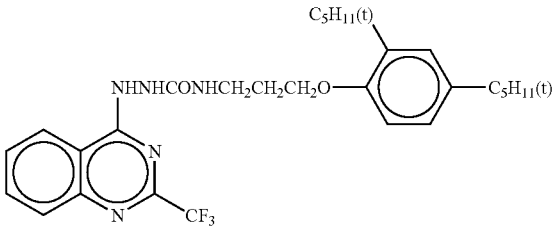

(A-3)

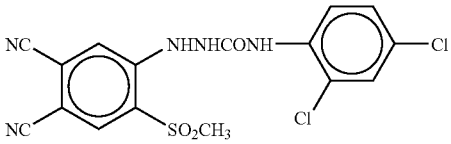

(A-4)

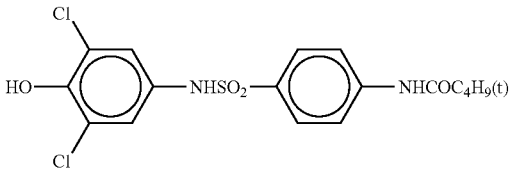

(A-5)

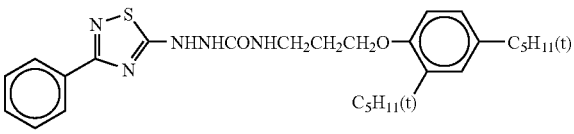

-continued (A-6)

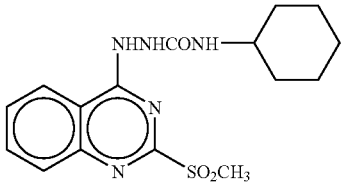

(A-7)

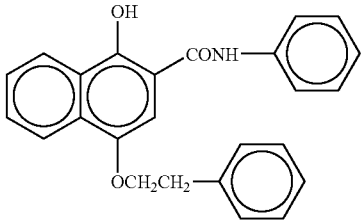

(A-8)

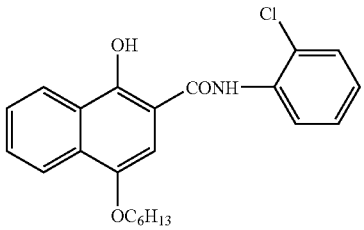

(A-9)

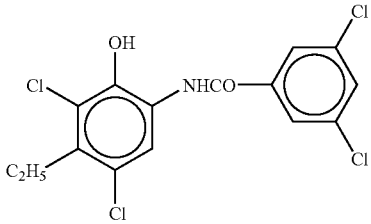

(A-10)

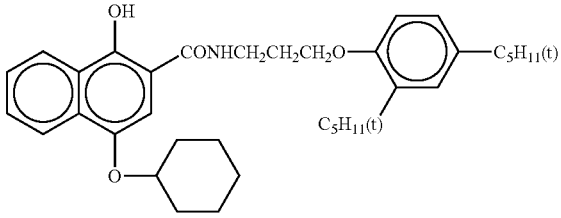

1-6. Hydrogen Bonding Compound

In the invention, in the case that the reducing agent has an aromatic hydroxyl group (—OH) or an amino group (—NHR, R represents each one of hydrogen atom and alkyl group), particularly in the case that the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

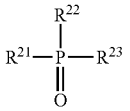

In formula (D), $R^{21}$ to $R^{23}$ each independently represent an alkyl group, an aryl group, an alkoxy group, an aryloxy group, an amino group, or a heterocyclic group, which may be substituted or not substituted.

In the case $R^{21}$ to $R^{23}$ contain a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, tbutyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, tbutyl group, t-amyl group, t-octyl group, cyclohexyl group, 1-methylcyclohexyl group, benzyl group, phenetyl group, 2-phenoxypropyl group, and the like.

As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like.

As aryloxy groups, there can be mentioned phenoxy group, cresyloxy group, isopropylphenoxy group, 4-t-butylphenoxy group, naphthoxy group, biphenyloxy group, and the like.

As amino groups, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

(D-1)

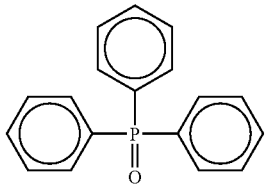

(D-2)

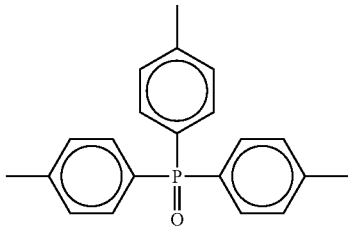

(D-3)

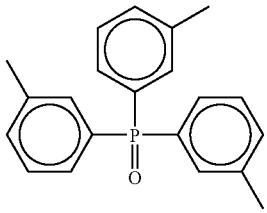

(D-4)

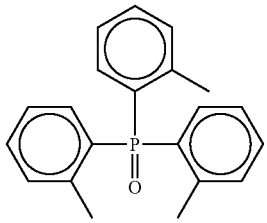

(D-5)

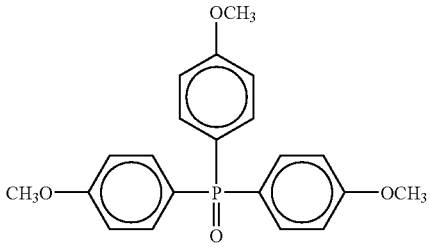

(D-6)

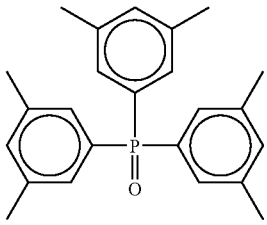

-continued
(D-7)
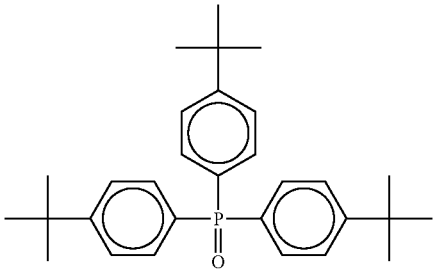
(D-8)
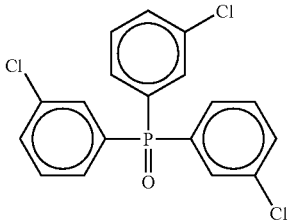
(D-9)
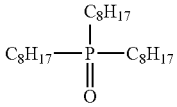
(D-10)
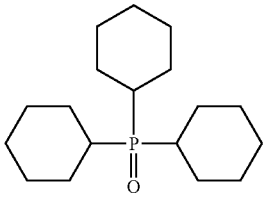
(D-11)
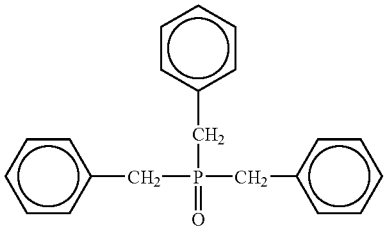
(D-12)
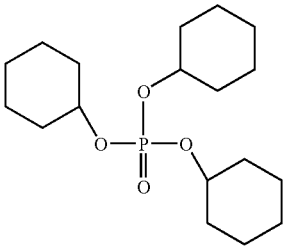
(D-13)
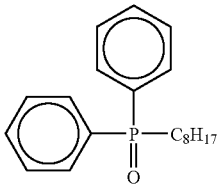
-continued
(D-14)
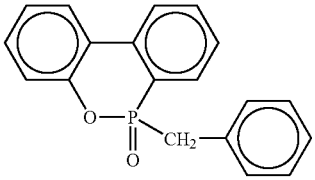
(D-15)
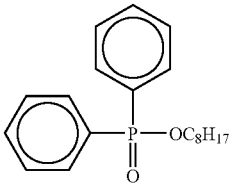
(D-16)
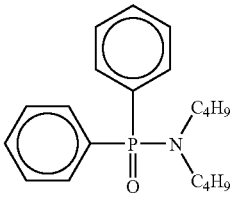
(D-17)
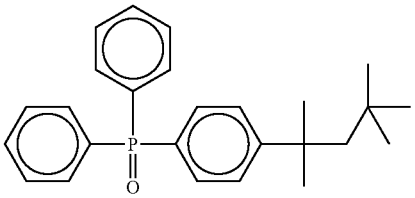
(D-18)
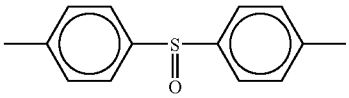
(D-19)
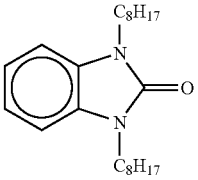
(D-20)
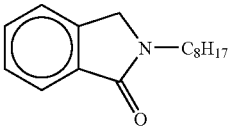
(D-21)
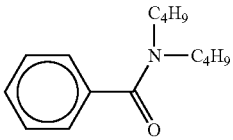
Specific examples of hydrogen bonding compounds other than those enumerated above can be found in those described in EP No. 1096310 and in JP-A Nos. 2002-156727 and 2002-318431.
The compound expressed by formula (D) used in the invention can be used in the photosensitive material by being incorporated into the coating solution in the form of solution, emulsion dispersion, or solid fine particle dispersion similar to the case of reducing agent, however, it is preferred to be used in the form of solid dispersion. In the solution, the compound expressed by formula (D) forms a hydrogen-bonded complex with a compound having a phenolic hydroxyl group or an amino group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the compound expressed by formula (D) in the form of powders and dispersing them with a proper dispersion solvent using sand grinder mill and the like.

The compound expressed by formula (D) is preferably used in the range of from 1 mol % to 200 mol %, more preferably from 10 mol % to 150 mol %, and further preferably, from 20 mol % to 100 mol %, with respect to the reducing agent.

1-7. Silver Halide

1) Halogen Composition

For the photosensitive silver halide used in the invention, there is no particular restriction on the halogen composition and silver chloride, silver bromochloride, silver bromide, silver iodobromide, silver iodochlorobromide and silver iodide can be used. Among them, silver bromide, silver iodobromide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, 0.01 μm to 0.15 μm and, further preferably, 0.02 μm to 0.12 μm. The grain size as used herein means an average diameter of a circle converted such that it has a same area as a projection area of the silver halide grain (projection area of a main plane in a case of a tabular grain).

4) Grain Shape

The shape of the silver halide grain can include, for example, cubic, octahedral, plate-like, spherical, rod-like or potato-like shape. The cubic grain is particularly preferred in the invention. A silver halide grain rounded at corners can also be used preferably. While there is no particular restriction on the index of plane (Mirror's index) of an crystal surface of the photosensitive silver halide grain, it is preferred that the ratio of [100] face is higher, in which the spectral sensitizing efficiency is higher in a case of adsorption of a spectral sensitizing dye. The ratio is preferably 50% or more, more preferably, 65% or more and, further preferably, 80% or more. The ratio of the Mirror's index [100] face can be determined by the method of utilizing the adsorption dependency of [111] face and [100] face upon adsorption of a sensitizing dye described by T. Tani; in J. Imaging Sci., 29, 165 (1985).

5) Heavy Metal

The photosensitive silver halide grain of the invention can contain metals or complexes of metals belonging to groups 8 to 10 of the periodic table (showing groups 1 to 18). The metal or the center metal of the metal complex from groups 8 to 10 of the periodic table is preferably rhodium, ruthenium or iridium. The metal complex may be used alone, or two or more kinds of complexes comprising identical or different species of metals may be used together. A preferred content is in the range from $1\times10^{-9}$ mol to $1\times10^{-3}$ mol per one mol of silver. The heavy metals, metal complexes and the addition method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl)ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per one mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion forming step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion forming step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitization method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. And phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the addition method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. In the invention, sensitizing dye can be added preferably after desalting step and before coating step, and more preferably after desalting step and before the completion of chemical ripening.

In the invention, the sensitizing dye may be added at any amount according to the property of photosensitivity and fogging, but it is preferably added from $10^{-6}$ mol to 1 mol, and more preferably, from $10^{-4}$ mol to $10^{-1}$ mol per one mol of silver in each case.

The photothermographic material of the invention may also contain super sensitizers in order to improve spectral sensitizing effect. The super sensitizers usable in the invention can include those compounds described in EP-A No. 587,338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitization method, selenium sensitization method or tellurium sensitization method. As the compound used preferably for sulfur sensitization method, selenium sensitization method and tellurium sensitization method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are more preferred.

The photosensitive silver halide grain in the invention is preferably chemically sensitized by gold sensitization method alone or in combination with the chalcogen sensitization described above. As the gold sensitizer, those having an pxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per one mol of the silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ mol per one mol of the silver halide. There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

9) Compound that Can Be One-electron-oxidized to Provide a One-electron Oxidation Product Which Releases One or More Electrons The photothermographic material of the invention preferably contains a compound that can be one-electron-oxidized to provide a one-electron oxidation product which releases one or more electrons. The said compound can be used in combination with various chemical sensitizers described above to increase the sensitivity of silver halide.

As the compound that can be one-electron-oxidized to provide a one-electron oxidation product which releases one or more electrons is a compound selected from the following Groups 1 to 5.

(Group 1) a compound that can be one-electron-oxidized to provide a one-electron oxidation product which further releases at least two electrons, due to being subjected to a subsequent bond cleavage reaction;

(Group 2) a compound that has at least two groups adsorptive to the silver halide and can be one-electron-oxidized to provide a one-electron oxidation product which further releases one electron, due to being subjected to a subsequent bond cleavage reaction;

(Group 3) a compound that can be one-electron-oxidized to provide a one-electron oxidation product, which further releases at least one electron after being subjected to a subsequent bond formation;

(Group 4) a compound that can be one-electron-oxidized to provide a one-electron oxidation product which further releases at least one electron after a subsequent intramolecular ring cleavage reaction; and (Group 5) a compound represented by X—Y, in which X represents a reducible group and Y represents a leaving group, and convertable by one-electron-oxidizing the reducible group to a one-electron oxidation product which can be converted into an X radical by eliminating the leaving group in a subsequent X—Y bond cleavage reaction, one electron being released from the X radical.

Each compound of Group 1 and Groups 3 to 5 preferably is a "compound having a sensitizing dye moiety" or a "compound having an adsorptive group to the silver halide". More preferred is a "compound having an adsorptive group to the silver halide". Each compound of Groups 1 to 4 more preferably is a "compound having a heterocyclic group containing nitrogen atoms substituted by two or more mercapto groups".

The compound of Groups 1 to 5 will be described in detail below.

In the compound of Group 1, the term "the bond cleavage reaction" specifically means a cleavage reaction of a bond of carbon-carbon, carbon-silicon, carbon-hydrogen, carbon-boron, carbon-tin or carbon-germanium. Cleavage of a carbon-hydrogen bond may be followed after the cleavage reaction. The compound of Group 1 can be one-electron-oxidized to be converted into the one-electron oxidation product, and thereafter can release further two or more electrons, preferably three or more electrons with the bond cleavage reaction.

The compound of Group 1 is preferably represented by any one of formulae (A), (B), (1), (2) and (3).

Formula (A)

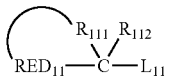

Formula (B)

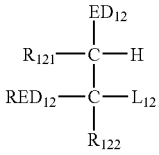

In formula (A), $RED_{11}$ represents a reducible group that can be one-electron-oxidized, and $L_{11}$ represents a leaving group. $R_{112}$ represents a hydrogen atom or a substituent. $R_{111}$ represents a nonmetallic atomic group forming a tetrahydro-, hexahydro- or octahydro-derivative of a 5- or 6-membered aromatic ring including aromatic heterocycles.

In formula (B), $RED_{12}$ represents a reducible group that can be one-electron-oxidized, and $L_{12}$ represents a leaving group. $R_{121}$ and $R_{122}$ each represent a hydrogen atom or a substituent. $ED_{12}$ represents an electron-donating group. In formula (B), $R_{121}$ and $RED_{12}$, $R_{121}$ and $R_{122}$, and $ED_{12}$ and $RED_{12}$ may bond together to form a ring structure, respectively.

In the compound represented by formula (A) or (B), the reducible group of $RED_{11}$ or $RED_{12}$ is one-electron-oxidized, and thereafter the leaving group of $L_{11}$ or $L_{12}$ is spontaneously eliminated in the bond cleavage reaction. Further two or more, preferably three or more electrons can be released with the bond cleavage reaction.

Formula (1)

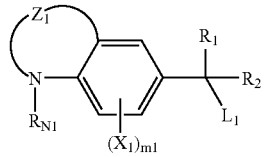

Formula (2)

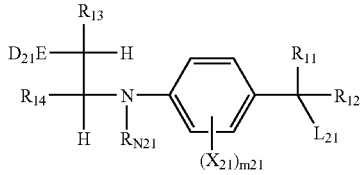

Formula (3)

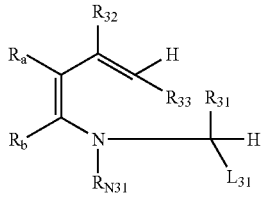

In formula (1), $Z_1$ represents an atomic group forming a 6-membered ring with a nitrogen atom and 2 carbon atoms in a benzene ring; $R_1$, $R_2$ and $R_{N1}$ each represent a hydrogen atom or a substituent; $X_1$ represents a substituent capable of substituting for a hydrogen atom on a benzene ring; $m_1$ represents an integer from 0 to 3; and $L_1$ represents a leaving group. In formula (2), $ED_{21}$ represents an electron-donating group; $R_{11}$, $R_{12}$, $R_{N21}$, $R_{13}$ and $R_{14}$ each represent a hydrogen atom or a substituent; $X_{21}$ represents a substituent capable of substituting for a hydrogen atom on a benzene ring; $m_{21}$ represents an integer from 0 to 3; and $L_{21}$ represents a leaving group. $R_{N21}$, $R_{13}$, $R_{14}$, $X_{21}$ and $ED_{21}$ may bond to each other to form a ring structure. In formula (3), $R_{32}$, $R_{33}$, $R_{31}$, $R_{N31}$, $R_a$ and $R_b$ each represent a hydrogen atom or a substituent; and $L_{31}$ represents a leaving group. Incidentally, $R_a$ and $R_b$ bond together to form an aromatic ring when $R_{N31}$ is not an aryl group.

After the compound is one-electron-oxidized, the leaving group of $L_1$, $L_{21}$ or $L_{31}$ is spontaneously eliminated in the bond cleavage reaction. Further two or more, preferably three or more electrons can be released with the bond cleavage reaction.

First, the compound represented by formula (A) will be described in detail below.

In formula (A), the reducible group of $RED_{11}$ can be one-electron-oxidized and can bond to after-mentioned $R_{111}$ to form the particular ring structure. Specifically, the reducible group may be a divalent group provided by removing one hydrogen atom from the following monovalent group at a position suitable for ring formation.

The monovalent group may be an alkylamino group; an arylamino group such as an anilino group and a naphthylamino group; a heterocyclic amino group such as a benzthiazolylamino group and a pyrrolylamino group; an alkylthio group; an arylthio group such as a phenylthio group; a heterocyclic thio group; an alkoxy group; an aryloxy group such as a phenoxy group; a heterocyclic oxy group; an aryl group such as a phenyl group, a naphthyl group and an anthranil group; or an aromatic or nonaromatic heterocyclic group, containing at least one heteroatom selected from the group consisting of a nitrogen atom, a sulfur atom, an oxygen atom and a selenium atom, which has a 5- to 7-membered, monocyclic or condensed ring structure such as a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring. $RED_{11}$ is hereinafter described as the monovalent group for convenience. The monovalent groups may have a substituent.

Examples of the substituent include halogen atoms; alkyl groups including aralkyl groups, cycloalkyl groups, active methine groups, etc.; alkenyl groups; alkynyl groups; aryl groups; heterocyclic groups, which may bond at any position; heterocyclic groups containing a quaternary nitrogen atom such as a pyridinio group, an imidazolio group, a quinolinio group and an isoquinolinio group; acyl groups; alkoxycarbonyl groups; aryloxycarbonyl groups; carbamoyl groups; a carboxy group and salts thereof; sulfonylcarbamoyl groups; acylcarbamoyl groups; sulfamoylcarbamoyl groups; carbazoyl groups; oxalyl groups; oxamoyl groups; a cyano group; carbonimidoyl groups; thiocarbamoyl groups; a hydroxy group; alkoxy groups, which may contain a plurality of ethyleneoxy groups or propyleneoxy groups as a repetition unit; aryloxy groups; heterocyclic oxy groups; acyloxy groups; alkoxy or aryloxy carbonyloxy groups; carbamoyloxy groups; sulfonyloxy groups; amino groups; alkyl, aryl or heterocyclic amino groups; acylamino groups; sulfoneamide groups; ureide groups; thioureide groups; imide groups; alkoxy or aryloxy carbonylamino groups; sulfamoylamino groups; semicarbazide groups; thiosemicarbazide groups; hydrazino groups; ammonio groups; oxamoylamino groups; alkyl or aryl sulfonylureide groups; acylureide groups; acylsulfamoylamino groups; a nitro group; a mercapto group; alkyl, aryl or heterocyclic thio groups; alkyl or aryl sulfonyl groups; alkyl or aryl sulfinyl groups; a sulfo group and salts thereof; sulfamoyl groups; acylsulfamoyl groups; sulfonylsulfamoyl groups and salts thereof; groups containing a phosphoric amide or phosphate ester structure; etc. These substituents may be further substituted by these substituents.

$RED_{11}$ is preferably an alkylamino group, an arylamino group, a heterocyclic amino group, an aryl group, an aromatic heterocyclic group, or nonaromatic heterocyclic group. $RED_{11}$ is more preferably an arylamino group (particularly an anilino group), or an aryl group (particularly a phenyl group). When $RED_{11}$ has a substituent, preferred as a substituent include halogen atoms, alkyl groups, alkoxy groups, carbamoyl groups, sulfamoyl groups, acylamino groups, sulfoneamide groups. When $RED_{11}$ is an aryl group, it is preferred that the aryl group has at least one "electron-donating group". The "electron-donating group" is a hydroxy group; an alkoxy group; a mercapto group; a sulfoneamide group; an acylamino group; an alkylamino group; an arylamino group; a heterocyclic amino group; an active methine group; an electron-excess, aromatic, heterocyclic group with a 5-membered monocyclic ring or a condensed-ring including at least one nitrogen atom in the ring such as an indolyl group, a pyrrolyl group, an imidazolyl group, a benzimidazolyl group, a thiazolyl group, a benzthiazolyl group and an indazolyl group; a nitrogen-containing, nonaromatic heterocyclic group that substitutes at the nitrogen atom, such as so-called cyclic amino group like pyrrolidinyl group, an indolinyl group, a piperidinyl group, a piperazinyl group and a morpholino group; etc.

The active methine group is a methine group having two "electron-attracting groups", and the "electron-attracting group" is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron-attracting groups may bond together to form a ring structure.

In formula (A), specific examples of $L_{11}$ include a carboxy group and salts thereof, silyl groups, a hydrogen atom, triarylboron anions, trialkylstannyl groups, trialkylgermyl groups and a $—CR_{C1}R_{C2}R_{C3}$ group. When $L_{11}$ represents a silyl group, the silyl group is specifically a trialkylsilyl group, an aryldialkylsilyl group, a triarylsilyl group, etc, and they may have a substituent.

When $L_{11}$ represents a salt of a carboxy group, specific examples of a counter ion to form the salt include alkaline metal ions, alkaline earth metal ions, heavy metal ions, ammonium ions, phosphonium ions, etc. Preferred as a counter ion are alkaline metal ions and ammonium ions, most preferred are alkaline metal ions such as $Li^+$, $Na^+$ and $K^+$.

When $L_{11}$ represents a $—CR_{C1}R_{C2}R_{C3}$ group, $R_{C1}$, $R_{C2}$ and $R_{C3}$ independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxy group. $R_{C1}$, $R_{C2}$ and $R_{C3}$ may bond to each other to form a ring structure, and may have a substituent. Incidentally, when one of $R_{C1}$, $R_{C2}$ and $R_{C3}$ is a hydrogen atom or an alkyl group, there is no case where the other two of them are a hydrogen atom or an alkyl group. $R_{C1}$, $R_{C2}$ and $R_{C3}$ are preferably an alkyl group, an aryl group (particularly a phenyl group), an alkylthio group, an arylthio group, an alkylamino group, an arylamino group, a heterocyclic group, an alkoxy group or a hydroxy group, respectively. Specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, a hydroxy group, etc. Examples of the ring structure formed by $R_{C1}$, $R_{C2}$ and $R_{C3}$ include a 1,3-dithiolane-2-yl group, a 1,3-dithiane-2-yl group, an N-methyl-1,3-thiazolidine-2-yl group, an N-benzyl-benzothiazolidine-2-yl group, etc.

It is also preferred that the —$CR_{C1}R_{C2}R_{C3}$ group is the same as a residue provided by removing $L_{11}$ from formula (A) as a result of selecting each of $R_{C1}$, $R_{C2}$ and $R_{C3}$ as above.

In formula (A), $L_{11}$ is preferably a carboxy group or a salt thereof, or a hydrogen atom, more preferably a carboxy group or a salt thereof.

When $L_{11}$ represents a hydrogen atom, the compound represented by formula (A) preferably has a base moiety. After the compound represented by formula (A) is oxidized, the base moiety acts to eliminate the hydrogen atom of $L_{11}$ and to release an electron.

The base is specifically a conjugate base of an acid with a pKa value of approximately 1 to 10. For example, the base moiety may contain a structure of a nitrogen-containing heterocycle such as pyridine, imidazole, benzoimidazole and thiazole; aniline; trialkylamine; an amino group; a carbon acid such as an active methylene anion; a thioacetic acid anion; carboxylate (—$COO^-$); sulfate (—$SO_3^-$); amineoxide (>$N^+(O^-)$—); and derivatives thereof. The base is preferably a conjugate base of an acid with a pKa value of approximately 1 to 8, more preferably carboxylate, sulfate or amineoxide, particularly preferably carboxylate. When these bases have an anion, the compound of formula (A) may have a counter cation. Examples of the counter cation include alkaline metal ions, alkaline earth metal ions, heavy metal ions, ammonium ions, phosphonium ions, etc. The base moiety may be at an optional position of the compound represented by formula (A). The base moiety may be connected to $RED_{11}$, $R_{111}$ or $R_{112}$ in formula (A), and to a substituent thereon.

In formula (A), $R_{112}$ represents a substituent capable of substituting a hydrogen atom or a carbon atom therewith, provided that $R_{112}$ and $L_{11}$ do not represent the same group.

$R_{112}$ preferably represents a hydrogen atom, an alkyl group, an aryl group (such as a phenyl group), an alkoxy group (such as a methoxy group, a ethoxy group, a benzyloxy group), a hydroxy group, an alkylthio group, (such as a methylthio group, a butylthio group), and amino group, an alkylamino group, an arylamino group, a heterocyclic amino group or the like; and more preferably represents a hydrogen atom, an alkyl group, an alkoxy group, a hydroxy group, a phenyl group and an alkylamino group.

Ring structures formed by $R_{111}$ in formula (A) are ring structures corresponding to a tetrahydro structure, a hexahydro structure, or an octahydro structure of a five-membered or six-membered aromatic ring (including an aromatic hetro ring), wherein a hydro structure means a ring structure in which partial hydrogenation is performed on a carbon-carbon double bond (or a carbon-nitrogen double bond) contained in an aromatic ring (an aromatic hetero ring) as a part thereof, wherein the tetrahydro structure is a structure in which 2 carbon-carbon double bonds (or carbon-nitrogen double bonds) are hydrogenated, the hexahydro structure is a structure in which 3 carbon-carbon double bonds (or carbon-nitrogen double bonds) are hydrogenated, and the octahydro structure is a structure in which 4 carbon-carbon double bonds (or carbon-nitrogen double bonds) are hydrogenated. Hydrogenation of an aromatic ring produces a partially hydrogenated non-aromatic ring structure.

Examples include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperazine ring, a tetralin ring, a tetrahydroquinoline ring, a tetrahydroisoquinoline ring, a tetrahydroquinazoline ring and a tetrahydroquinoxaline ring, a tetrahydrocarbazole ring, an octahydrophenanthridine ring and the like. The ring structures may have a substituent therein.

More preferable examples of a ring structure forming $R_{111}$ include a pyrrolidine ring, an imidazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring and a tetracarbazole ring. Particularly preferable examples include a pyrrolidine ring, a piperidine ring, a piperazine ring, a tetrahydropyridine ring, a tetrahydroquinoline ring, a tetrahydroisoquinoline ring, a tetrahydroquinazoline ring and a tetrahydroquinoxaline ring; and most preferable examples include a pyrrolidine ring, a piperidine ring, a tetrahydropyridine ring, a tetrahydroquinoline ring and a tetrahydroisoquinoline ring.

In formula (B), $RED_{12}$ and $L_{12}$ represent groups having the respective same meanings as $RED_{11}$ and $L_{11}$ in formula (A), and have the respective same preferable ranges as $RED_{11}$ and $L_{11}$ in formula (A). $RED_{12}$ is a monovalent group except a case where $RED_{12}$ forms the following ring structure and to be concrete, there are exemplified groups each with a name of a monovalent group described as $RED_{11}$. $RED_{121}$ and $L_{122}$ represent groups having the same meaning as $R_{112}$ in formula (A), and have the same preferable range as $R_{112}$ in formula (A). $ED_{12}$ represents an electron-donating group. Each pair of $R_{121}$ and $RED_{12}$; $R_{121}$ and $R_{122}$; or $ED_{12}$ and $RED_{12}$ may form a ring structure by bonding with each other.

An electron-donating group represented by $RED_{12}$ in formula (B) is the same as an electron-donating group described as a substituent when $RED_{11}$ represents an aryl group. Preferable examples of $RED_{12}$ include a hydroxy group, an alkoxy group, a mercapto group, a sulfonamide group, an alkylamino group, an arylamino group, an active methine group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute, and a phenyl group substituted with an electron donating group described above, and more preferable examples thereof include a non-aromatic nitrogen containing heterocyclic group further substituted with a hydroxy group, a mercapto group, a sulfonamide group, an alkylamino group, an arylamino group, an active methine group, or a nitrogen atom; and a phenyl group substituted with an electron-donating group described above (for example, a p-hydroxyphenyl group, a p-dialkylaminophenyl group, an o- or p-dialkoxyphenyl group and the like).

In formula (B), $R_{121}$ and $RED_{12}$; $R_{122}$ and $R_{121}$; or $ED_{12}$ and $RED_{12}$ may bond to each other to form a ring structure. A ring structure formed here is a non-aromatic carbon ring or hetero ring in a 5- to 7-membered single ring or fused ring structure which is substituted or unsubstituted. Concrete examples of a ring structure formed from $R_{121}$ and $RED_{12}$ include, in addition to the examples of the ring structure formed by $R_{111}$ in formula (A), a pyrroline ring, an imidazoline ring, a thiazoline ring, a pyrazoline ring, an oxazoline ring, an indan ring, a morphorine ring, an indoline ring, a tetrahydro-1,4-oxazine ring, 2,3-dihydrobenzo-1,4-oxazine ring, a tetrahydro-1,4-thiazine ring, 2,3-dihydrobenzo-1,4-thiazine ring, 2,3-dihydrobenzofuran ring, 2,3-dihydrobenzothiophene ring and the like. In formation of a ring structure from $ED_{12}$ and $RED_{12}$, $ED_{12}$ is preferably an amino group, an alkylamino group or an arylamino group and concrete examples of the ring structure include a tetrahyropyrazine ring, a piperazine ring, a tetrahydroquinoxaline ring, a tetrahydroisoquinoline ring and the like. Concrete examples of a ring structure formed from $R_{122}$ and $R_{121}$ include a cyclohexane ring, a cyclopentane ring and the like.

Below, description will be given of formulae (1) to (3).

In formulae (1) to (3), $R_1$, $R_2$, $R_{11}$, $R_{12}$ and $R_{31}$ represent the same meaning as $R_{112}$ of formula (A) and have the same preferable range as $R_{112}$ of formula (A). $L_1$, $L_{21}$ and $L_{31}$ independently represents the same leaving groups as the groups shown as concrete examples in description of $L_{11}$ of formula (A) and also have the same preferable range as $L_{11}$ of formula (A). The substituents represented by $X_1$ and $X_{21}$ are the same as the examples of substituents of $RED_{11}$ of formula (A) and have the same preferable range as $RED_{11}$ of formula (A). $m_1$ and $m_2$ are preferably integers from 0 to 2 and more preferably integer of 0 or 1.

When $R_{N1}$, $R_{N21}$ and $R_{N31}$ each represent a substituent, preferred as a substituent include an alkyl group, an aryl group or a heterocyclic group, and may further have a substituent. Each of $R_{N1}$, $R_{N21}$ and $R_{N31}$ is preferably a hydrogen atom, an alkyl group or an aryl group, more preferably a hydrogen atom or an alkyl group.

When $R_{13}$, $R_{14}$, $R_{32}$, $R_{33}$, $R_a$ and $R_b$ independently represent a substituent, the substituent is preferably an alkyl group, an aryl group, an acyl group, an alkoxycarbonyl group, a carbamoyl group, a cyano group, an alkoxy group, an acylamino group, a sulfoneamide group, a ureide group, a thiouredide group, an alkylthio group, an arylthio group, an alkylsulfonyl group, an arylsulfonyl group, or a sulfamoyl group.

The 6-membered ring formed by $Z_1$ in formula (1) is a nonaromatic heterocycle condensed with the benzene ring in formula (1). The ring structure containing the nonaromatic heterocycle and the benzene ring to be condensed may be specifically a tetrahydroquinoline ring, a tetrahydroquinoxaline ring, or a tetrahydroquinazoline ring, which may have a substituent.

In formula (2), $ED_{21}$ is the same as $ED_{12}$ in formula (B) with respect to the meanings and preferred embodiments.

In formula (2), any two of $R_{N21}$, $R_{13}$, $R_{14}$, $X_{21}$ and $ED_{21}$ may bond together to form a ring structure. The ring structure formed by $R_{N21}$ and $X_{21}$ is preferably a 5- to 7-membered, carbocyclic or heterocyclic, nonaromatic ring structure condensed with a benzene ring, and specific examples thereof include a tetrahydroquinoline ring, a tetrahydroquinoxaline ring, an indoline ring, a 2,3-dihydro-5,6-benzo-1,4-thiazine ring, etc. Preferred are a tetrahydroquinoline ring, a tetrahydroquinoxaline ring and an indoline ring.

When $R_{N31}$ is a group other than an aryl group in formula (3), $R_a$ and $R_b$ bond together to form an aromatic ring. The aromatic ring is an aryl group such as a phenyl group and a naphthyl group, or an aromatic heterocyclic group such as a pyridine ring group, a pyrrole ring group, a quinoline ring group and an indole ring group, preferably an aryl group. The aromatic ring group may have a substituent.

In formula (3), $R_a$ and $R_b$ preferably bond together to form an aromatic ring, particularly a phenyl group.

In formula (3), $R_{32}$ is preferably a hydrogen atom, an alkyl group, an aryl group, a hydroxy group, an alkoxy group, a mercapto group or an amino group. When $R_{32}$ is a hydroxy group, $R_{33}$ is preferably an electron-attracting group. The electron-attracting group is the same as described above, preferably an acyl group, an alkoxycarbonyl group, a carbamoyl group or a cyano group.

The compound of Group 2 will be described below.

According to the compound of Group 2, the "bond cleavage reaction" is a cleavage reaction of a bond of carbon-carbon, carbon-silicon, carbon-hydrogen, carbon-boron, carbon-tin or carbon-germanium. Cleavage of a carbon-hydrogen bond may be caused with the cleavage reaction.

The compound of Group 2 has two or more, preferably 2 to 6, more preferably 2 to 4, adsorbent groups to the silver halide. The adsorptive group is further preferably a mercapto-substituted, nitrogen-containing, heterocyclic group. The adsorptive group will hereinafter be described.

The compound of Group 2 is preferably represented by the following formula (C).

Formula (C)

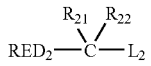

In the compound represented by formula (C), the reducible group of $RED_2$ is one-electron-oxidized, and thereafter the leaving group of $L_2$ is spontaneously eliminated, thus a C (carbon atom)-$L_2$ bond is cleaved, in the bond cleavage reaction. Further one electron can be released with the bond cleavage reaction.

In formula (C), $RED_2$ is the same as $RED_{12}$ in formula (B) with respect to the meanings and preferred embodiments. $L_2$ is the same as $L_{11}$ in formula (A) with respect to the meanings and preferred embodiments. Incidentally, when $L_2$ is a silyl group, the compound of formula (C) has two or more mercapto-substituted, nitrogen-containing, heterocyclic groups as the adsorbent groups. $R_{21}$ and $R_{22}$ each represent a hydrogen atom or a substituent, and are the same as $R_{112}$ in formula (A) with respect to the meanings and preferred embodiments. $RED_2$ and $R_{21}$ may bond together to form a ring structure.

The ring structure is a 5- to 7-membered, monocyclic or condensed, carbocyclic or heterocyclic, nonaromatic ring, and may have a substituent. Incidentally, there is no case where the ring structure corresponds to a tetrahydro-, hexahydro- or octahydro-derivative of an aromatic ring or an aromatic heterocycle. The ring structure is preferably such that corresponds to a dihydro-derivative of an aromatic ring or an aromatic heterocycle, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1,2-dihydroquinazoline ring, a 1,2-dihydroquinoxaline ring, etc. Preferred are a 2-imidazoline ring, a 2-thiazoline ring, an indoline ring, a benzoimidazoline ring, a benzothiazoline ring, a benzoxazoline ring, a 1,2-dihydro pyridine ring, a 1,2-dihydroquinoline ring, a 1,2-dihydroquinazoline ring and a 1,2-dihydroquinoxaline ring, more preferred are an indoline ring, a benzoimidazoline ring, a benzothiazoline ring and a 1,2-dihydroquinoline ring, particularly preferred is an indoline ring.

The compound of Group 3 will be described below.

According to the compound of Group 3, "bond formation" means that a bond of carbon-carbon, carbon-nitrogen, carbon-sulfur, carbon-oxygen, etc. is formed.

It is preferable that the one-electron oxidation product releases one or more electrons after an intramolecular bond-forming reaction between the one-electron-oxidized portion and a reactive site in the same molecular such as a carbon-carbon double bond, a carbon-carbon triple bond, an aromatic group and a benzo-condensed, nonaromatic heterocyclic group.

To be more detailed, a one-electron oxidized product (a cation radical species or a neutral radical species generated by elimination of a proton therefrom) formed by one electron oxidizing a compound of Group 3 reacts with a reactive group described above coexisting in the same molecule to form a bond and form a radical species having a new ring structure therein. The radical species have a feature to release a second electron directly or in company with elimination of a proton therefrom. One of compounds of Group 3 has a chance to further release one or more electrons, in a ordinary case two or more electrons, after formation of a two-electron oxidized product, after receiving a hydrolysis reaction in one case or after causing a tautomerization reaction accompanying direct migration of a proton in another case. Alternatively, compounds of Group 3 also include a compound having an ability to further release one or more electron, in an ordinary case two or more electrons directly from a two-electron oxidized product, not by way of a tautomerization reaction.

The compound of Group 3 is preferably represented by the following formula (D).

$$RED_3—L_3—Y_3 \qquad \text{Formula (D)}$$

In formula (D), $RED_3$ represents a reducible group that can be one-electron-oxidized, and $Y_3$ represents a reactive group that reacts with the one-electron-oxidized $RED_3$, specifically an organic group containing a carbon-carbon double bond, a carbon-carbon triple bond, an aromatic group or a benzo-condensed, nonaromatic heterocyclic group. $L_3$ represents a linking group that connects $RED_3$ and $Y_3$.

In formula (D), $RED_3$ has the same meanings as $RED_{12}$ in formula (B). In formula (D), $RED_3$ is preferably an arylamino group, a heterocyclic amino group, an aryloxy group, an arylthio group, an aryl group, or an aromatic or nonaromatic heterocyclic group that is preferably a nitrogen-containing heterocyclic group. $RED_3$ is more preferably an arylamino group, a heterocyclic amino group, an aryl group, or an aromatic or nonaromatic heterocyclic group. Preferred as the heterocyclic group are a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzoimidazole ring group, a benzoimidazoline ring group, a benzothiazoline ring group, a 3,4-methylenedioxyphenyl-1-yl group, etc.

Particularly preferred as $RED_3$ are an arylamino group (particularly an anilino group), an aryl group (particularly a phenyl group), and an aromatic or nonaromatic heterocyclic group.

The aryl group represented by $RED_3$ preferably has at least one electron-donating group. The term "electron-donating group" means the same as above-mentioned electron-donating group.

When $RED_3$ is an aryl group, more preferred as a substituent on the aryl group are an alkylamino group, a hydroxy group, an alkoxy group, a mercapto group, a sulfoneamide group, an active methine group, and a nitrogen-containing, nonaromatic heterocyclic group that substitutes at the nitrogen atom, furthermore preferred are an alkylamino group, a hydroxy group, an active methine group, and a nitrogen-containing, nonaromatic heterocyclic group that substitutes at the nitrogen atom, and the most preferred are an alkylamino group, and a nitrogen-containing, nonaromatic heterocyclic group that substitutes at the nitrogen atom.

When $Y_3$ is an organic group containing carbon-carbon double bond (for example a vinyl group) having a substituent, more preferred as the substituent are an alkyl group, a phenyl group, an acyl group, a cyano group, an alkoxycarbonyl group, a carbamoyl group and an electron-donating group. The electron-donating group is preferably an alkoxy group; a hydroxy group (that may be protected by a silyl group, and examples of the silyl-protected group include a trimethylsilyloxy group, a t-butyldimethylsilyloxy group, a triphenylsilyloxy group, a triethylsilyloxy group, a phenyldimethylsilyloxy group, etc); an amino group; an alkylamino group; an arylamino group; a sulfoneamide group; an active methine group; a mercapto group; an alkylthio group; or a phenyl group having the electron-donating group as a substituent.

Incidentally, when the organic group containing the carbon-carbon double bond has a hydroxy group as a substituent, $Y_3$ contains a moiety of $>C_1{=}C_2(—OH)—$, which may be tautomerized into a moiety of $>C_1H—C_2(=O)—$. In this case, it is preferred that a substituent on the $C_1$ carbon is an electron-attracting group, and as a result, $Y_3$ has a moiety of an active methylene group or an active methine group. The electron-attracting group, which can provide such a moiety of an "active methylene group" or an "active methine group", may be the same as above-mentioned electron-attracting group on the methine group of the "active methine group".

When $Y_3$ is an organic group containing a carbon-carbon triple bond (for example a ethynyl group) having a substituent, preferred as the substituent is an alkyl group, a phenyl group, an alkoxycarbonyl group, a carbamoyl group, an electron-donating group, etc.

When $Y_3$ is an organic group containing an aromatic group, preferable as the aromatic group is an aryl group, particularly a phenyl group, having an electron-donating group as a substituent, and an indole ring group. The electron-donating group is preferably a hydroxy group, which may be protected by a silyl group; an alkoxy group; an amino group; an alkylamino group; an active methine group; a sulfoneamide group; or a mercapto group.

When $Y_3$ is an organic group containing a benzo-condensed, nonaromatic heterocyclic group, preferred as the benzo-condensed, nonaromatic heterocyclic group are groups having an aniline moiety, such as an indoline ring group, a 1,2,3,4-tetrahydroquinoline ring group, a 1,2,3,4-tetrahydroquinoxaline ring group and a 4-quinolone ring group.

The reactive group of $Y_3$ is more preferably an organic group containing a carbon-carbon double bond, an aromatic group, or a benzo-condensed, nonaromatic heterocyclic group. Furthermore preferred are an organic group containing a carbon-carbon double bond; a phenyl group having an electron-donating group as a substituent; an indole ring group; and a benzo-condensed, nonaromatic heterocyclic group having an aniline moiety. The carbon-carbon double bond more preferably has at least one electron-donating group as a substituent.

It is also preferred that the reactive group represented by $Y_3$ contains a moiety the same as the reducible group represented by $RED_3$ as a result of selecting the reactive group as above.

$L_3$ represents a linking group that connects $RED_3$ and $Y_3$, specifically a single bond, an alkylene group, an arylene group, a heterocyclic group, —O—, —S—, —$NR_N$—, —C(═O)—, —$SO_2$—, —SO—, —P(═O)—, or a combination thereof. $R_N$ represents a hydrogen atom, an alkyl group, an aryl group or a heterocyclic group. The linking group represented by $L_3$ may have a substituent. The linking group represented by $L_3$ may bond to each of $RED_3$ and $Y_3$ at an optional position such that the linking group substitutes optional one hydrogen atom of each $RED_3$ and $Y_3$. Preferred examples of $L_3$ include a single bond; alkylene groups, particularly a methylene group, an ethylene group or a propylene group; arylene groups, particularly a phenylene group; a —C(═O)— group; a —O— group; a —NH— group; —N(alkyl)-groups; and divalent linking groups of combinations thereof. When a cation radical ($X^{+}$•) provided by oxidizing $RED_3$ or a radical (X•) provided by eliminating a proton therefrom reacts with the reactive group represented by $Y_3$ to form a bond, it is preferable that they form a 3 to 7-membered ring structure containing the linking group represented by $L_3$. Thus, the radical ($X^{+}$• or X•) and the reactive group of Y are preferably connected though 3 to 7 atoms.

Next, the compound of Group 4 will be described below.

The compound of Group 4 has a reducible group-substituted ring structure. After the reducible group is one-electron-oxidized, the compound can release further one or more electrons with a ring structure cleavage reaction. The ring cleavage reaction proceeds as follows.

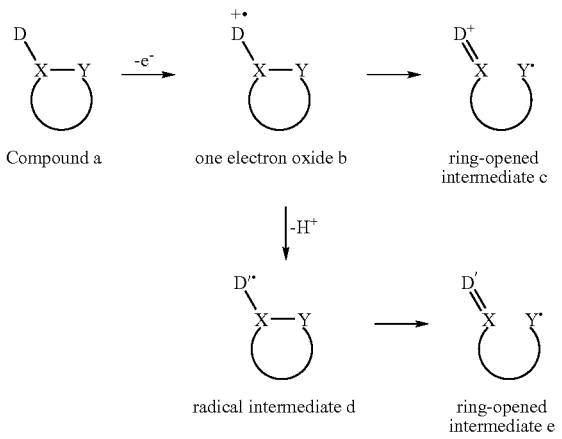

In the formula, compound a is the compound of Group 4. In compound a, D represents a reducible group, and X and Y each represent an atom forming a bond in the ring structure, which is cleaved after the one-electron oxidation. First, compound a is one-electron-oxidized to generate one-electron oxidation product b. Then, the X—Y bond is cleaved with conversion of the D-X single bond into a double bond, whereby ring-opened intermediate c is provided. Alternatively, there is a case where one-electron oxidation product b is converted into radical intermediate d with deprotonation, and ring-opened intermediate e is provided in the same manner. Subsequently, further one or more electrons are released form thus-provided ring-opened intermediate c or e.

The ring structure in the compound of Group 4 is a 3 to 7-membered, carbocyclic or heterocyclic, monocyclic or condensed, saturated or unsaturated, nonaromatic ring. The ring structure is preferably a saturated ring structure, more preferably 3- or 4-membered ring. Preferred examples of the ring structure include a cyclopropane ring, a cyclobutane ring, an oxirane ring, an oxetane ring, an aziridine ring, an azetidine ring, an episulphide ring and a thietane ring. More preferred are a cyclopropane ring, a cyclobutane ring, an oxirane ring, an oxetane ring and an azetidine ring, particularly preferred are a cyclopropane ring, a cyclobutane ring and an azetidine ring. The ring structure may have a substituent.

The compound of Group 4 is preferably represented by the following formulae (E) or (F).

Formula (E)

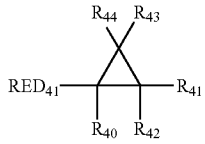

Formula (F)

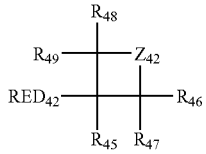

In formulae (E) and (F), $RED_{41}$ and $RED_{42}$ are the same as $RED_{12}$ in formula (B) with respect to the meanings and preferred embodiments, respectively. $R_{40}$ to $R_{44}$ and $R_{45}$ to $R_{49}$ each represent a hydrogen atom or a substituent. In formula (F), $Z_{42}$ represents —$CR_{420}R_{421}$—, —$NR_{423}$—, or —O—. $R_{420}$ and $R_{421}$ each represent a hydrogen atom or a substituent, and $R_{423}$ represents a hydrogen atom, an alkyl group, an aryl group or a heterocyclic group.

In formulae (E) and (F), each of $R_{40}$ and $R_{45}$ is preferably a hydrogen atom, an alkyl group or an aryl group, more preferably a hydrogen atom, an alkyl group or an aryl group. Each of $R_{41}$ to $R_{44}$ and $R_{46}$ to $R_{49}$ is preferably a hydrogen atom, an alkyl group, an alkenyl group, an aryl group, a heterocyclic group, an arylthio group, an alkylthio group, an acylamino group or a sulfoneamide group, more preferably a hydrogen atom, an alkyl group, an aryl group or a heterocyclic group, It is preferred that at least one of $R_{41}$ to $R_{44}$ is a donor group, and it is also preferred that both of $R_{41}$ and $R_{42}$, or both of $R_{43}$ and $R_{44}$ are an electron-attracting group. It is more preferred that at least one of $R_{41}$ to $R_{44}$ is a donor group. It is furthermore preferred that at least one of $R_{41}$ to $R_{44}$ is a donor group and $R_{41}$ to $R_{44}$ other than the donor group are selected from a hydrogen atom and an alkyl group.

A donor group referred to here is an "electron-donating group" or an aryl group substituted with at least one "electron-donating group." Preferable examples of donor groups include an alkylamino group, an arylamino group, a heterocyclicamino group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute and a phenyl group substituted with at least one electron-donating group. More preferable examples thereof include an alkylamino group, an aryamino group, an electron excessive aromatic heterocyclic group in a five-membered single ring or fused ring containing at least one nitrogen atom in a ring structure as a part (an indol ring, a pyrrole ring, a carbazole ring and the like), and a phenyl group substituted with an electron-donating group (a phenyl group substituted with three or more alkoxy groups, a phenyl group substituted with a hydroxy group, an alkylamino group, or an arylamino group and the like). Particularly preferable examples thereof include an aryamino group, an electron excessive aromatic heterocyclic group in a five-membered single ring or fused ring containing at least one nitrogen atom in a ring structure as a part (especially, a 3-indolyl group), and a phenyl group substituted with an electron-donating group (especially, a trialkoxyphenyl group and a phenyl group substituted with an alkylamino group or an arylamino group).

$Z_{42}$ is preferably —$CR_{420}R_{421}$— or —$NR_{423}$—, more preferably —$NR_{423}$—. Each of $R_{420}$ and $R_{421}$ is preferably a hydrogen atom, an alkyl group, an aryl group, a heterocyclic group, an acylamino group or a sulfoneamino group, more preferably a hydrogen atom, an alkyl group, an aryl group or a heterocyclic group. $R_{423}$ is preferably a hydrogen atom, an alkyl group, an aryl group or an aromatic heterocyclic group, more preferably a hydrogen atom, an alkyl group or an aryl group.

The substituent represented by each of $R_{40}$ to $R_{49}$, $R_{420}$, $R_{421}$ and $R_{423}$ preferably has 40 or less carbon atoms, more preferably has 30 or less carbon atoms, particularly preferably 15 or less carbon atoms. The substituents of $R_{40}$ to $R_{49}$, $R_{420}$, $R_{421}$ and $R_{423}$ may bond to each other or to the other portion such as $RED_{41}$, $RED_{42}$ and $Z_{42}$, to form a ring.

In the compounds of Groups 1 to 4 used in the invention, the adsorptive group to the silver halide is such a group that is directly adsorbed on the silver halide or promotes adsorption of the compound onto the silver halide. Specifically, the adsorptive group is a mercapto group or a salt thereof; a thione group (—C(═S)—); a heterocyclic group containing at least one atom selected from the group consisting of a nitrogen atom, a sulfur atom, a selenium atom and a tellurium atom; a sulfide group; a cationic group; or an ethynyl group. Incidentally, the adsorptive group in the compound of Group 2 is not a sulfide group.

The mercapto group or a salt thereof used as the adsorptive group may be a mercapto group or a salt thereof itself, and is more preferably a heterocyclic group, an aryl group or an alkyl group having a mercapto group or a salt thereof as a substituent. The heterocyclic group is a 5- to 7-membered, monocyclic or condensed, aromatic or nonaromatic, heterocyclic group. Examples thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, etc. The heterocyclic group may contain a quaternary nitrogen atom, and in this case, the mercapto group bonding to the heterocyclic group may be dissociated into a mesoion. Such heterocyclic group may be an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group, etc. Preferred among them is a triazolium ring group such as a 1,2,4-triazolium-3-thiolate ring group. Examples of the aryl group include a phenyl group and a naphthyl group. Examples of the alkyl group include straight, branched or cyclic alkyl groups having 1 to 30 carbon atoms. When the mercapto group forms a salt, a counter ion of the salt may be a cation of an alkaline metal, an alkaline earth metal, a heavy metal, etc. such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; etc.

Further, the mercapto group used as the adsorptive group may be tautomerized into a thione group. Specific examples of the thione group include a thioamide group (herein a —C(═S)—NH— group); and groups containing a structure of the thioamide group, such as linear or cyclic thioamide groups, a thiouredide group, a thiourethane group and a dithiocarbamic acid ester group. Examples of the cyclic thioamide group include a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group, etc.

The thione group used as the adsorbent group, as well as the thione group derived from the mercapto group by tautomerization, may be a linear or cyclic, thioamide, thiouredide, thiourethane or dithiocarbamic acid ester group that cannot be tautomerized into the mercapto group or has no hydrogen atom at α-position of the thione group.

The heterocyclic group containing at least one atom selected from the group consisting of a nitrogen atom, a sulfur atom, a selenium atom and tellurium atom, which is used as the adsorbent group, is a nitrogen-containing heterocyclic group having a —NH— group that can form a silver imide (>NAg) as a moiety of the heterocycle; or a heterocyclic group having a —S— group, a —Se— group, a —Te— group or a ═N— group that can form a coordinate bond with a silver ion as a moiety of the heterocycle. Examples of the former include a benzotriazole group, a triazole group, an indazole group, a pyrazole group, a tetrazole group, a benzimidazole group, an imidazole group, a purine group, etc. Examples of the latter include a thiophene group, a thiazole group, an oxazole group, a benzothiazole group, a benzoxazole group, a thiadiazole group, an oxadiazole group, a triazine group, a selenazole group, a benzselenazole group, a tellurazole group, a benztellurazole group, etc. The former is preferable.

The sulfide group used as the adsorptive group may be any group with a —S— moiety, and preferably has a moiety of: alkyl or alkylene-S-alkyl or alkylene; aryl or arylene-S-alkyl or alkylene; or aryl or arylene-S-aryl or arylene. The sulfide group may form a ring structure, and may be a —S—S— group. Specific examples of the ring structure include groups with a thiolane ring, a 1,3-dithiolane ring, a 1,2-dithiolane ring, a thiane ring, a dithiane ring, a tetrahydro-1,4-thiazine ring (a thiomorpholine ring), etc. Particularly preferable as the sulfide groups are groups having a moiety of alkyl or alkylene-S-alkyl or alkylene.

The cationic group used as the adsorptive group is a quaternary nitrogen-containing group, specifically a group with an ammonio group or a quaternary nitrogen-containing heterocyclic group. Incidentally, there is no case where the cationic group partly composes an atomic group forming a dye structure, such as a cyanine chromophoric group. The ammonio group may be a trialkylammonio group, a dialkylarylammonio group, an alkyldiarylammonio group, etc., and examples thereof include a benzyldimethylammonio group, a trihexylammonio group, a phenyldiethylammonio group, etc. Examples of the quaternary nitrogen-containing heterocyclic group include a pyridinio group, a quinolinio group, an isoquinolinio group, an imidazolio group, etc. Preferred are a pyridinio group and an imidazolio group, and particularly preferred is a pyridinio group. The quaternary nitrogen-containing heterocyclic group may have an optional substituent. Preferred as the substituent in the case of the pyridinio group and the imidazolio group are alkyl groups, aryl groups, acylamino groups, a chlorine atom, alkoxycarbonyl groups and carbamoyl groups. Particularly preferred as the substituent in the case of the pyridinio group is a phenyl group.

The ethynyl group used as the adsorptive group means a —C≡CH group, in which the hydrogen atom may be substituted.

The adsorptive group may have an optional substituent.

Specific examples of the adsorptive group further include groups described in pages 4 to 7 of a specification of JP-A No. 11-95355.

Preferred as the adsorptive group used in the invention are mercapto-substituted, nitrogen-containing, heterocyclic groups such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group and a 1,5-dimethyl-1,2,4-triazolium-3-thiolate group; and nitrogen-containing heterocyclic groups having a —NH— group that can form a silver imide (>NAg) as a moiety of the heterocycle, such as a benzotriazole group, a benzimidazole group and an indazole group. Particularly preferred are a 5-mercaptotetrazole group, a 3mercapto-1,2,4-triazole group and a benzotriazole group, and the most preferred are a 3-mercapto-1,2,4-triazole group and a 5-mercaptotetrazole group.

Among these compounds, it is particularly preferred that the compound has two or more mercapto groups as a moiety. The mercapto group (—SH) may be converted into a thione group in the case where it can be tautomerized. The compound may have two or more adsorbent groups containing above-mentioned mercapto or thione group as a moiety, such as a cyclic thioamide group, an alkylmercapto group, an arylmercapto group and a heterocyclic mercapto group. Further, the compound may have one or more adsorptive group containing two or more mercapto or thione groups as a moiety, such as a dimercapto-substituted, nitrogen-containing, heterocyclic group.

Examples of the adsorptive group containing two or more mercapto group, such as a dimercapto-substituted, nitrogen-containing, heterocyclic group, include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolo pyrimidine group, a 2,5-dimercapto-imidazole group, etc. Particularly preferred are a 2,4-dimercaptopyrimidine group, a 2,4-dimercaptotriazine group, and a 3,5-dimercapto-1,2,4-triazole group.

The adsorptive group may be connected to any position of the compound represented by each of formulae (A) to (F) and (1) to (3). Preferred portions, which the adsorptive group bonds to, are $RED_{11}$, $RED_{12}$, $RED_2$ and $RED_3$ in formulae (A) to (D), $RED_{41}$, $R_{41}$, $RED_{42}$, and $R_{46}$ to $R_{48}$ in formulae (E) and (F), and optional portions other than $R_1$, $R_2$, $R_{11}$, $R_{12}$, $R_{31}$, $L_1$, $L_{21}$ and $L_{31}$ in formulae (1) to (3). Further, more preferred portions are $RED_{11}$ to $RED_{42}$ in formulae (A) to (F).

The spectral sensitizer moiety is a group containing a spectral sensitizer chromophore, a residual group provided by removing an optional hydrogen atom or substituent from a spectral sensitizer compound. The spectral sensitizer moiety may be connected to any position of the compound represented by each of formulae (A) to (F) and (1) to (3). Preferred portion, which the spectral sensitizer moiety bonds to, are $RED_{11}$, $RED_{12}$, $RED_2$ and $RED_3$ in formulae (A) to (D), $RED_{41}$, $R_{41}$, $RED_{42}$, and $R_{46}$ to $R_{48}$ in formulae (E) and (F), and optional portions other than $R_1$, $R_2$, $R_{11}$, $R_{12}$, $R_{31}$, $L_1$, $L_{21}$ and $L_{31}$ in formulae (1) to (3). Further, more preferred portions are $RED_{11}$ to $RED_{42}$ in formulae (A) to (F). The spectral sensitizer is preferably such that typically used in color sensitizing techniques. Examples thereof include cyanine dyes, composite cyanine dyes, merocyanine dyes, composite merocyanine dyes, homopolar cyanine dyes, styryl dyes, and hemicyanine dyes. Typical spectral sensitizers are disclosed in Research Disclosure, Item 36544, September 1994. The dyes can be synthesized by one skilled in the art according to procedures described in the above Research Disclosure and F. M. Hamer, *The Cyanine dyes and Related Compounds*, Interscience Publishers, New York, 1964. Further, dyes described in pages 4 to 7 of a specification of JP-A No. 11-95355 (U.S. Pat. No. 6,054,260) may be used in the invention.

The compounds of Groups 1 to 4 used in the invention has preferably 10 to 60 carbon atoms in total, more preferably 15 to 50 carbon atoms, furthermore preferably 18 to 40 carbon atoms, particularly preferably 18 to 30 carbon atoms.

When a silver halide photosensitive material using the compounds of Groups 1 to 4 is exposed, the compound is one-electron-oxidized. After the subsequent reaction, the compound is further oxidized while releasing one electron, or two or more electrons depending on Group. An oxidation potential in the first one-electron oxidation is preferably 1.4 V or less, more preferably 1.0 V or less. This oxidation potential is preferably 0 V or more, more preferably 0.3 V or more. Thus, the oxidation potential is preferably approximately 0 V to 1.4 V, more preferably approximately 0.3 V to 1.0 V.

The oxidation potential may be measured by a cyclic voltammetry technique. Specifically, a sample is dissolved in a solution of acetonitrile/water containing 0.1 M lithium perchlorate=80/20 (volume %), nitrogen gas is passed through the resultant solution for 10 minutes, and then the oxidation potential is measured at 25° C. at a potential scanning rate of 0.1 V/second by using a glassy carbon disk as a working electrode, using a platinum wire as a counter electrode, and using a calomel electrode (SCE) as a reference electrode. The oxidation potential per SCE is obtained at peak potential of cyclic voltammetric curve.

In the case where the compound of Groups 1 to 4 is one-electron-oxidized and release further one electron after the subsequent reaction, an oxidation potential in the subsequent oxidation is preferably −0.5 V to −2 V, more preferably −0.7 V to −2 V, furthermore preferably −0.9 V to −1.6 V.

In the case where the compound of Groups 1 to 4 is one-electron-oxidized and release further two or more electrons after the subsequent reaction, oxidation potentials in the subsequent oxidation are not particularly limited. The oxidation potentials in the subsequent oxidation often cannot be measured precisely, because an oxidation potential in releasing the second electron cannot be clearly differentiated from an oxidation potential in releasing the third electron.

Next, the compound of Group 5 will be described.

The compound of Group 5 is represented by X—Y, in which X represents a reducible group and Y represents a leaving group. The reducible group represented by X can be one-electron-oxidized to provide a one-electron oxidation product, which can be converted into an X radical by eliminating the leaving group of Y with a subsequent X—Y bond cleavage reaction. The X radical can release further one electron. The oxidation reaction of the compound of Group T5 may be represented by the following formula.

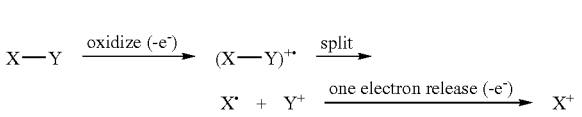

The compound of Group 5 exhibits an oxidation potential of preferably 0 V to 1.4 V, more preferably 0.3 V to 1.0 V. The radical X generated in the formula exhibits an oxidation potential of preferably −0.7 V to −2.0 V, more preferably 0.9 V to −1.6 V.

The compound of Group 5 is preferably represented by the following formula (G).

Formula (G)

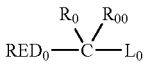

In formula (G), $RED_0$ represents a reducible group, $L_0$ represents a leaving group, and $R_0$ and $R_{00}$ each represent a hydrogen atom or a substituent. $RED_0$ and $R_0$, and $R_0$ and $R_{00}$ may be bond together to form a ring structure, respectively. $RED_0$ is the same as $RED_2$ in formula (C) with respect to the meanings and preferred embodiments. $R_0$ and $R_{00}$ are the same as $R_{21}$ and $R_{22}$ in formula (C) with respect to the meanings and preferred embodiments, respectively. Incidentally, $R_0$ and $R_{00}$ are not the same as the leaving group of $L_0$ respectively, except for a hydrogen atom. $RED_0$ and $R_0$ may bond together to form a ring structure with examples and preferred embodiments the same as those of the ring structure formed by bonding $RED_2$ and $R_{21}$ in formula (C). Examples of the ring structure formed by bonding $R_0$ and $R_{00}$ each other include a cyclopentane ring, a tetrahydrofuran ring, etc. In formula (G), $L_0$ is the same as $L_2$ in formula (C) with respect to the meanings and preferred embodiments.

The compound represented by formula (G) preferably has an adsorptive group to the silver halide or a spectrally sensitizing dye moiety. However, the compound does not have two or more adsorptive groups when $L_0$ is a group other than a silyl group. Incidentally, the compound may have two or more sulfide groups as the adsorbent groups, not depending on $L_0$.

The adsorptive group to the silver halide in the compound represented by formula (G) may be the same as those in the compounds of Groups 1 to 4, and further may be the same as all of the compounds and preferred embodiments described as "an adsorptive group to the silver halide" in pages 4 to 7 of a specification of JP-A No. 11-95355.

The spectral sensitizer moiety in the compound represented by formula (G) is the same as in the compounds of Groups 1 to 4, and may be the same as all of the compounds and preferred embodiments described as "photoabsorptive group" in pages 7 to 14 of a specification of JP-A No. 11-95355.

Specific examples of the compounds of Groups 1 to 5 used in the invention are illustrated below without intention of restricting the scope of the invention.

1

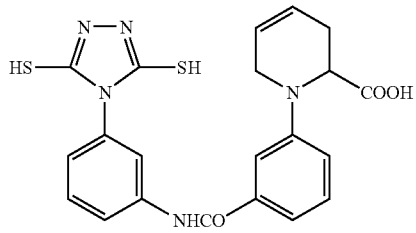

2

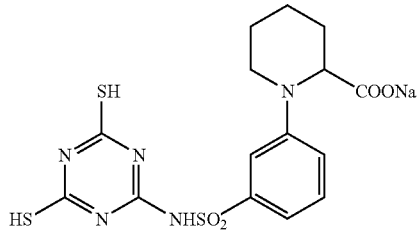

3

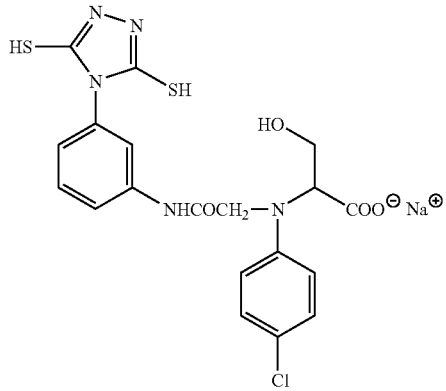

4

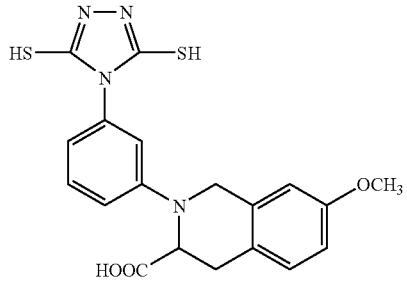

5

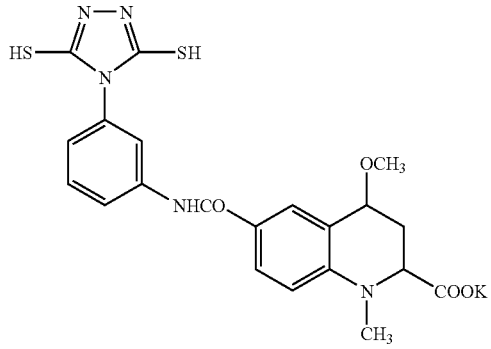

-continued
6
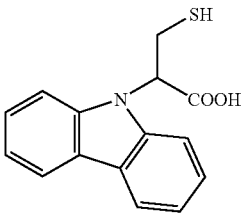
7
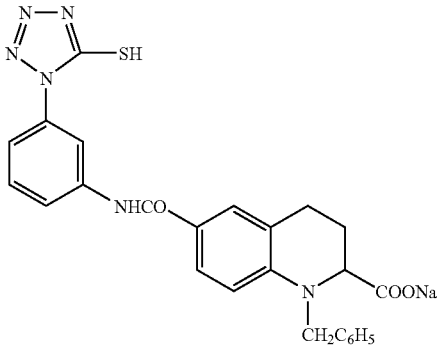
8
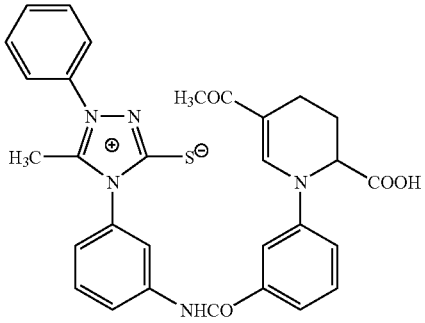
9
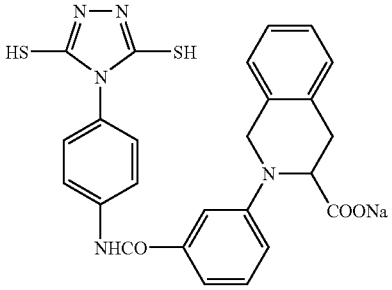
10
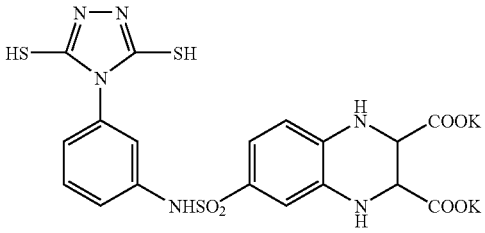
11
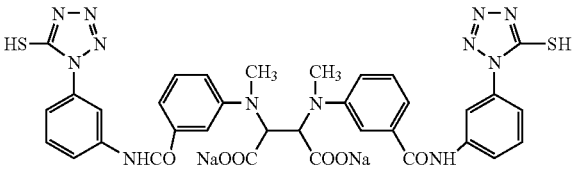
-continued
12
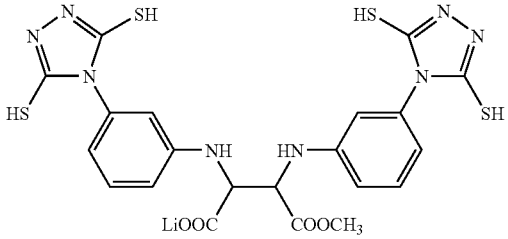
13
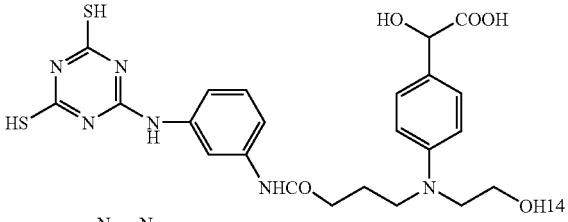
14
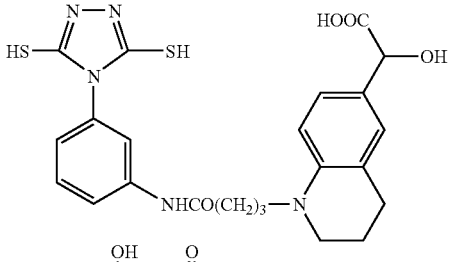
15
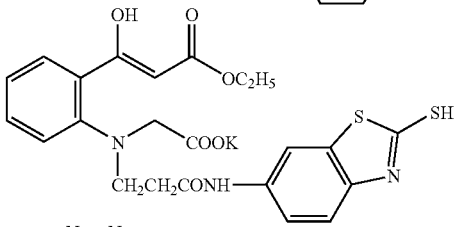
16
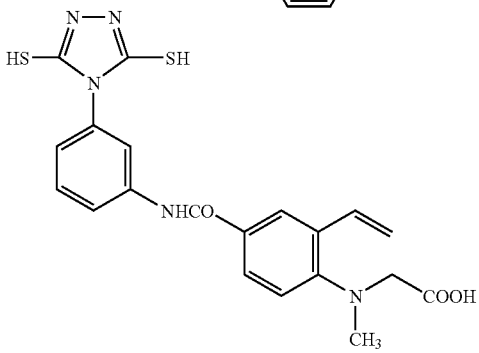
17
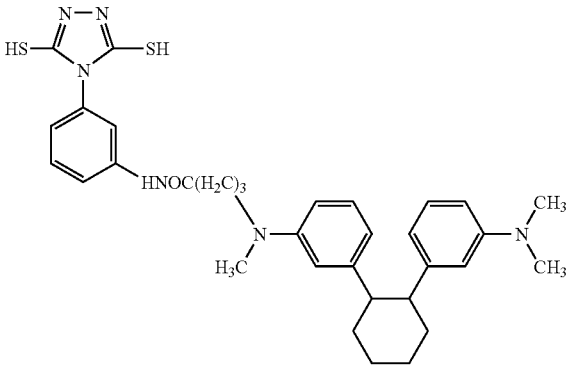

-continued
18
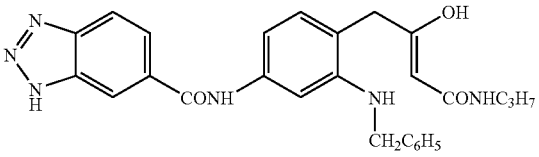
19
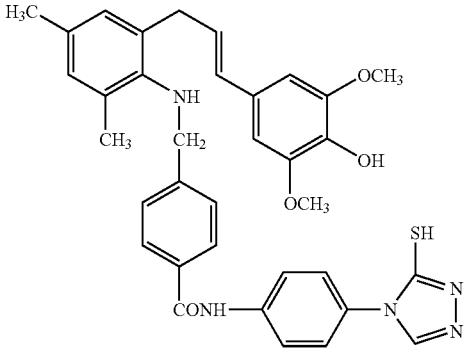
20
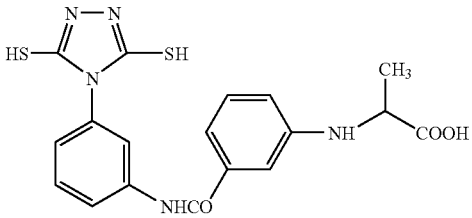
21
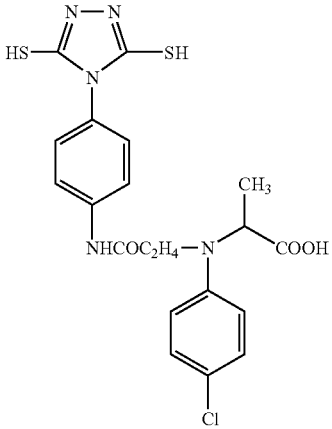
22
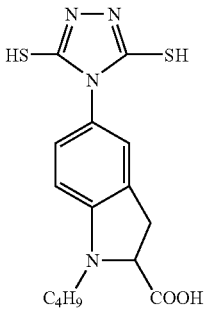
-continued
23
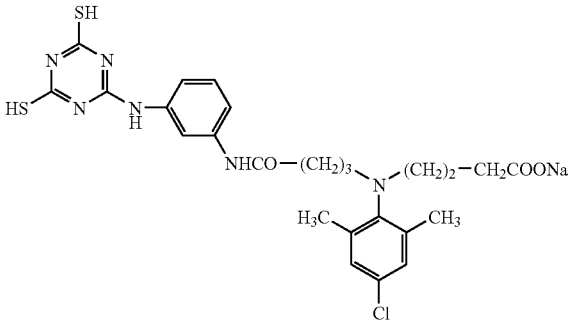
24
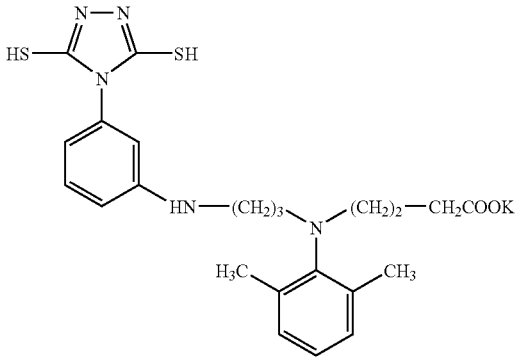
25
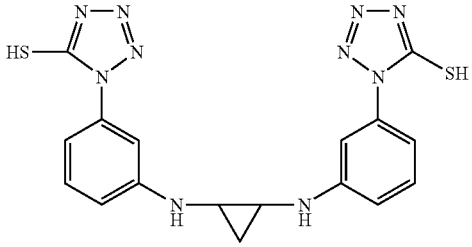
26
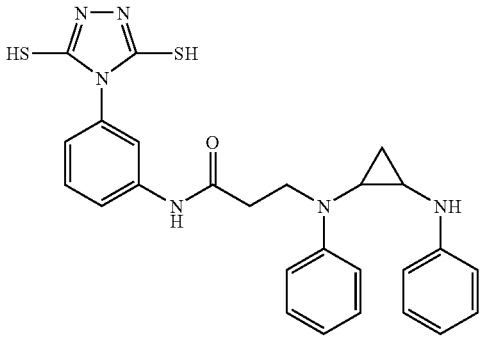
27
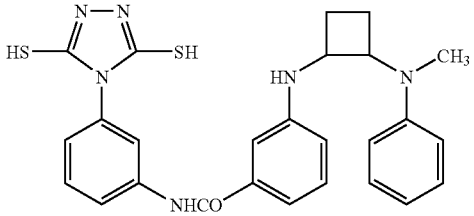

-continued
28
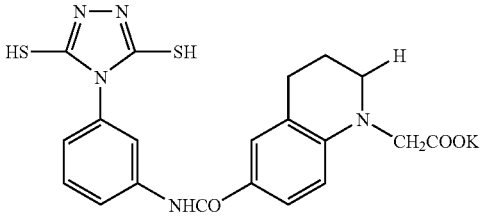
29
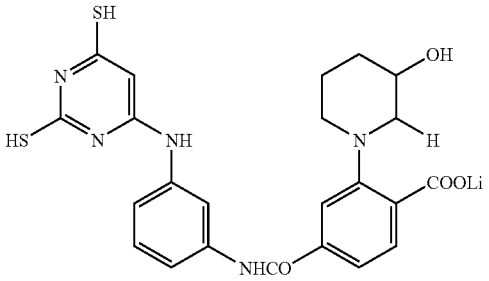
30
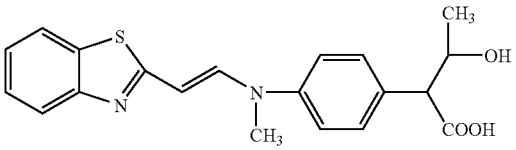
31
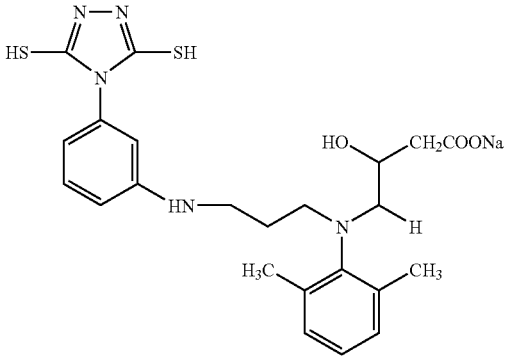
32
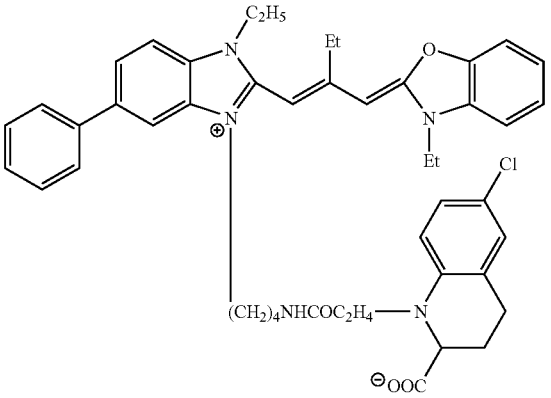
-continued
33
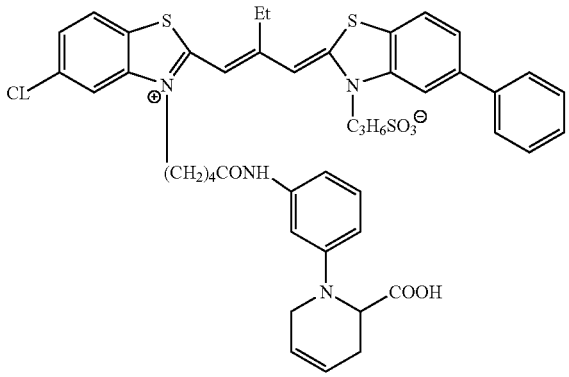
34
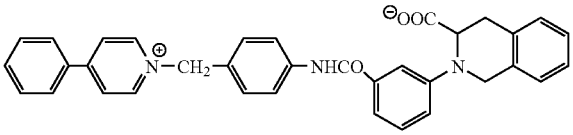
35
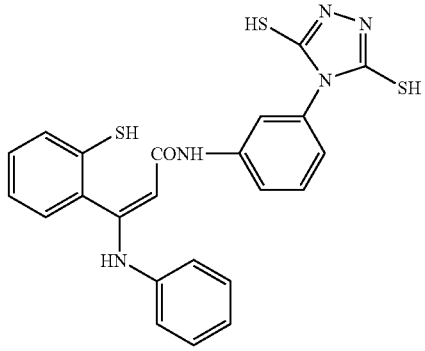
G-1
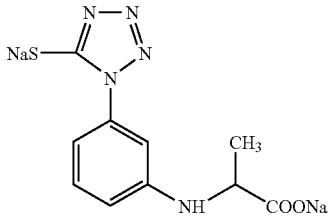
G-2
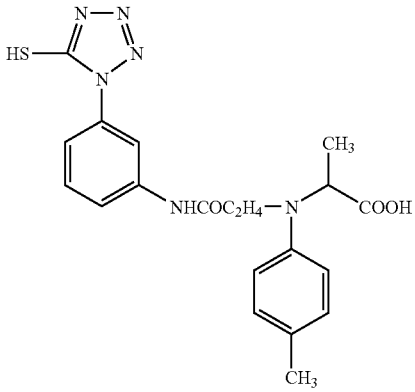

-continued

G-3

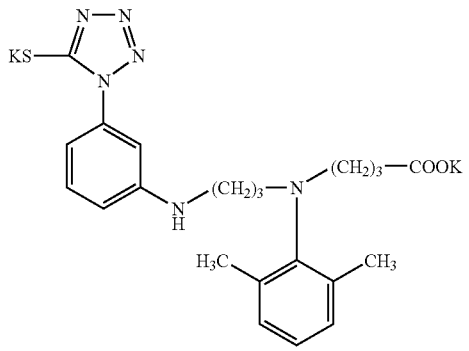

G-4

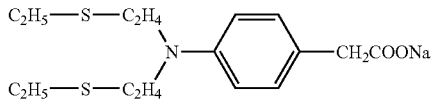

G-5

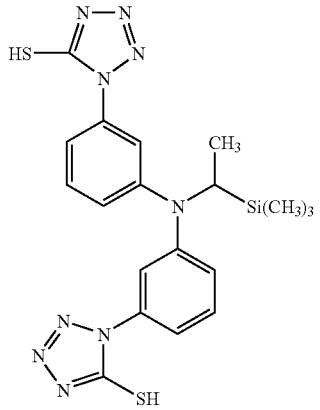

The compounds of Groups 1 to 4 used in the invention are the same as compounds described in detail in JP-A Nos. 2003-114487, 2003-114486, 2003-140287, 2003-75950 and 2003-114488, respectively. The specific examples of the compounds of Groups 1 to 4 used in the invention further include compound examples disclosed in the specifications. Synthesis examples of the compounds of Groups 1 to 4 used in the invention may be the same as described in the specifications.

Specific examples of the compound of Group 5 further include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692 A1 (Compound INV 1 to 35); EP No. 893732 A1; U.S. Pat. Nos. 6,054,260 and 5,994,051; etc.

The compounds of Groups 1 to 5 may be used at any time during preparation of the photosensitive silver halide emulsion and production of the photothermographic material. For example, the compound may be used, in a photosensitive silver halide grain formation step, in a desalting step, in a chemical sensitization step, and before coating, etc. The compound may be added in several times, during these steps. The compound is preferably added, after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 to 5 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Groups 1 to 5 used in the invention is preferably added to the image forming layer comprising the photosensitive silver halide and the non-photosensitive organic silver salt. The compound may be added to a surface protective layer, or an intermediate layer, as well as the image forming layer comprising the photosensitive silver halide and the non-photosensitive organic silver salt, to be diffused to the image forming layer in the coating step. The compound may be added before or after addition of a sensitizing dye. A mol value of the compound per one mol of the silver halide is preferably $1\times10^{-9}$ mol to $5\times10^{-1}$ mol, more preferably $1\times10^{-8}$ mol to $5\times10^{-2}$ mol, in a layer comprising the photosensitive silver halide emulsion.

10) Combined Use of a Plurality of Silver Halides

The photosensitive silver halide emulsion in the photosensitive material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

11) Coating Amount

The addition amount of the photosensitive silver halide, when expressed by the coating amount of silver per one $m^2$ of the photothermographic material, is preferably from 0.03 $g/m^2$ to 0.6 $g/m^2$, more preferably, 0.05 $g/m^2$ to 0.4 $g/m^2$ and, further preferably, 0.07 $g/m^2$ to 0.3 $g/m^2$. The photosensitive silver halide is used by 0.01 mol to 0.5 mol, preferably, 0.02 mol to 0.3 mol, and further preferably 0.03 mol to 0.2 mol per one mol of the organic silver salt.

12) Mixing Silver Halide and Organic Silver Salt

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more kinds of aqueous dispersions of organic silver salts and two or more kinds of aqueous dispersions of photosensitive silver salts upon mixing is used preferably for controlling the photographic properties.

13) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai kongou gijutu" by N. Harnby and M. F. Edwards, translated by Kouji Takahashi (Nikkankougyou shinbunsya, 1989).

1-8. Binder

Any type of polymer may be used as the binder for the layer containing organic silver salt in the photothermographic material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly (vinyl alcohol), hydroxyethyl cellulose, cellulose acetate, cellulose acetate butyrate, poly (vinyl pyrrolidone), casein, starch, poly(acrylic acid), poly(methylmethacrylic acid), poly(vinyl chloride), poly(methacrylic acid), styrene-maleic anhydride copolymers, styreneacrylonitrile copolymers, styrenebutadiene copolymers, poly(vinyl acetal) (e.g., poly(vinyl formal) and poly(vinyl butyral)), poly(ester), poly(urethane), phenoxy resin, poly(vinylidene chloride), poly(epoxide), poly(carbonate), poly(vinyl acetate), poly(olefin), cellulose esters, and poly(amide). A binder may be used with water, an organic solvent or emulsion to form a coating solution.

In the invention, the Tg of the binder of the layer including organic silver salts is preferably from 0° C. to 80° C., more preferably, from 10° C. to 70° C., further preferably, from 15° C. to 60° C.

In the specification, Tg was calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition)(WileyInterscience, 1989).

The polymer used for the binder maybe of two or more kinds of polymers, if necessary. And, the polymer having Tg more than 20° C. and the polymer having Tg less than 20° C. can be used in combination. In a case that two types or more of polymers differing in Tg may be blended for use, it is preferred that the weight-average Tg is in the range mentioned above.

In the invention, it is preferred that the layer containing organic silver salt is formed by first applying a coating solution containing 30% by weight or more of water in the solvent and by then drying.

In the case the layer containing organic silver salt is formed by first applying a coating solution containing 30% by weight or more of water in the solvent and by then drying, and furthermore, in the case the binder of the layer containing organic silver salt is soluble or dispersible in an aqueous solvent (water solvent), the performance can be ameliorated particularly in the case a polymer latex having an equilibrium water content of 2% by weight or lower under 25° C. and 60% RH is used. Most preferred embodiment is such prepared to yield an ion conductivity of 2.5 mS/cm or lower, and as such a preparation method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

Equilibrium water content under 25°C and $$60\%\ RH = [(W1 - W0)/W0] \times 100\ (\%\ \text{by weight})$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in the range from 1 nm to 50,000 nm, preferably 5 nm to 1,000 nm, more preferably 10 nm to 500 nm, and further preferably 50 nm to 200 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image forming layer, and those having too large molecular weight are also not preferred because the filming properties result poor. Further, crosslinking polymer latexes are particularly preferred for use.

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly(urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latexes above may be used alone, or may be used by blending two types or more depending on needs.

Particularly preferable as the polymer latex for use in the invention is that of styrene-butadiene copolymer. The weight ratio of monomer unit for styrene to that of butadiene constituting the styrenebutadiene copolymer is preferably in the range of from 40:60 to 95:5. Further, the monomer unit of styrene and that of butadiene preferably account for 60% by weight to 99% by weight with respect to the copolymer. Moreover, the polymer latex of the invention contains acrylic acid or methacrylic acid, preferably, in the range from 1% by weight to 6% by weight, and more preferably, from 2% by weight to 5% by weight, with respect to the total weight of the monomer unit of styrene and that of butadiene. The preferred range of the molecular weight is the same as that described above.

As the latex of styrene-butadiene copolymer preferably used in the invention, there can be mentioned P-3 to P-8 and P-15, or commercially available LACSTAR-3307B, 7132C, Nipol Lx416, and the like.

In the layer containing organic silver salt of the photosensitive material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by weight or less, preferably 20% by weight or less, with respect to the total weight of the binder incorporated in the layer containing organic silver salt.

According to the invention, the layer containing organic silver salt (image forming layer) is preferably formed by using polymer latex for the binder. According to the amount of the binder for the layer containing organic silver salt, the weight ratio for total binder to organic silver salt (total binder/organic silver salt) is preferably in the range of 1/10 to 10/1, more preferably 1/3 to 5/1, and further preferably 1/1 to 3/1.

The layer containing organic silver salt is, in general, a photosensitive layer (image forming layer) containing a photosensitive silver halide, i.e., the photosensitive silver salt; in such a case, the weight ratio for total binder to silver halide (total binder/silver halide) is in the range from 400 to 5, more preferably, from 200 to 10.

The total amount of binder in the image forming layer of the invention is preferably in the range from 0.2 $g/m^2$ to 30 $g/m^2$, more preferably from 1 $g/m^2$ to 15 $g/m^2$, and further preferably from 2 $g/m^2$ to 10 $g/m^2$. As for the image forming layer of the invention, there may be added a crosslinking agent for crosslinking, or a surfactant and the like to improve coating properties.

In the invention, a solvent of a coating solution for a layer containing organic silver salt (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more and still more preferably 70% by weight or more.

Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

1-9. Antifoggant

1) Organic Polyhalogen Compound

In the invention, it is preferred to comprise an organic polyhalogen compound represented by formula (H) described below as an antifoggant, besides the aforementioned compound represented by formulae (1a), (1b) or (1c).

$$Q\text{-}(Y)n\text{-}C(Z_1)(Z_2)X \qquad \text{Formula (H)}$$

In formula (H), Q represents an alkyl group, an aryl group, or a heterocyclic group; Y represents a divalent connecting group; n represents 0 or 1; $Z_1$ and $Z_2$ each represent a halogen atom; and X represents hydrogen atom or an electron-attracting group.

In formula (H), Q preferably is a phenyl group substituted by an electron-attracting group whose Hammett substitution coefficient σp yields a positive value. For the details of Hammett substitution coefficient, reference can be made to Journal of Medicinal Chemistry, Vol. 16, No. 11 (1973), pp. 1207 to 1216, and the like.

As such electron-attracting groups, examples include, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), a cyano group (σp value: 0.66), a nitro group (σp value: 0.78), an aliphatic aryl or heterocyclic sulfonyl group (for example, methanesulfonyl (σp value: 0.72)), an aliphatic aryl or heterocyclic acyl group (for example, acetyl (σp value: 0.50) and benzoyl (σp value: 0.43)), an alkinyl (e.g., C≡CH (σp value: 0.23)), an aliphatic aryl or heterocyclic oxycarbonyl group (e.g., methoxycarbonyl (σp value: 0.45) and phenoxycarbonyl (σp value: 0.44)), a carbamoyl group (σp value: 0.36), sulfamoyl group (σp value: 0.57), sulfoxido group, heterocyclic group, and phosphoryl group.

Preferred range of the σp value is from 0.2 to 2.0, and more preferably, from 0.4 to 1.0.

Preferred as the electron-attracting groups are a carbamoyl group, an alkoxycarbonyl group, an alkylsulfonyl group, an alkylphosphoryl group, a carboxyl group, an alkylcarbonyl group, and an arylcarbonyl group, particularly preferred among them are a carbamoyl group, an alkoxycarbonyl group, an alkylsulfonyl group, an alkylphosphoryl group, and most preferred among them is a carbamoyl group.

X preferably is an electron-attracting group, more preferably, a halogen atom, an aliphatic aryl or heterocyclic sulfonyl group, an aliphatic aryl or heterocyclic acyl group, an aliphatic aryl or heterocyclic oxycarbonyl group, carbamoyl group, or sulfamoyl group; particularly preferred among them is a halogen atom.

Among halogen atoms, preferred are chlorine atom, bromine atom, and iodine atom; more preferred are chlorine atom and bromine atom; and particularly preferred is bromine atom.

Y preferably represents —C(═O)—, —SO—, or —$SO_2$—; more preferably, —C(═O)— or —$SO_2$—; and particularly preferred is —$SO_2$—. n represents 0 or 1, and preferred is 1.

Specific examples of the compounds expressed by formula (H) of the invention are shown below.

(H-1)

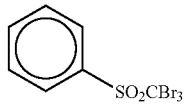

(H-2)

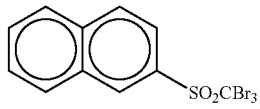

(H-3)

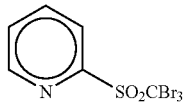

(H-4)

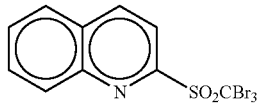

(H-5)

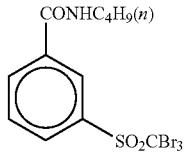

(H-6)

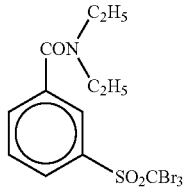

(H-7)

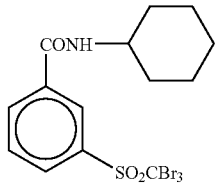

(H-8)

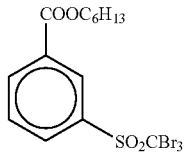

-continued (H-9)

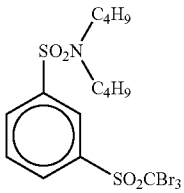

(H-10)

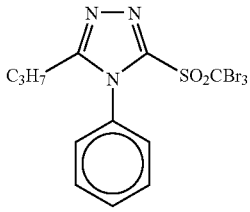

(H-11)

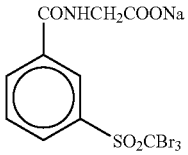

(H-12)

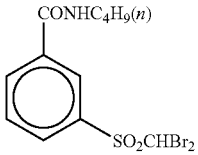

(H-13)

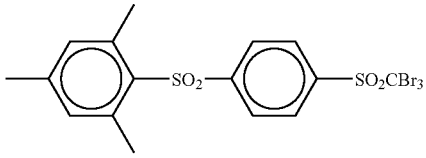

(H-14)

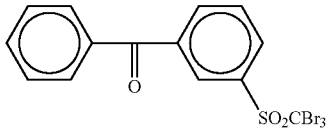

(H-15)

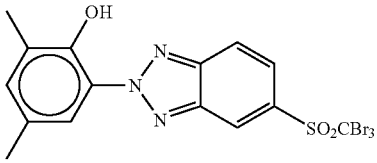

A compound expressed by formula (H) in the invention is preferably used in the range from $10^{-4}$ mol to 0.8 mol per one mole of a non-photosensitive silver salt in an image forming layer, more preferably used in the range from $10^{-3}$ mol to 0.1 mol and still more preferably used in the range from $5\times10^{-3}$ mol to 0.05 mol.

In the invention, a method of incorporating a compound expressed by formula (H) into a photosensitive material is described in a method of incorporating a reducing agent described above.

A melting point of a compound expressed by formula (H) is preferably 200° C. or lower and more preferably 170° C. or lower.

Examples of other organic polyhalogen compounds used in the invention are disclosed in paragraphs Nos. 0111 to 0112 of JP-A No. 11-65021. Preferable examples thereof are an organic polyhalogen compound expressed by formula (P) described in JP-A No. 2000-284399, an organic polyhalogen compound expressed by formula (II) described in JP-A No. 10-339934 and an organic polyhalogen compound described in JP-A No. 2001-033911.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, as described in JP-A No. 6-11791.

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864.

The photothermographic material of the invention may further contain an azolium salt in order to prevent fogging. As azolium salts, there can be mentioned a compound expressed by formula (XI) as described in JP-A No. 59-193447, a compound described in JP-B No. 55-12581, and a compound expressed by formula (II) in JP-A No. 60-153039. The azolium salt may be added to any part of the photosensitive material, but as the addition layer, preferred is to select a layer on the side having thereon the photosensitive layer, and more preferred is to select a layer containing organic silver salt.

The azolium salt may be added at any time of the process of preparing the coating solution; in the case the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, toner, and the like.

In the invention, the azolium salt may be added at any amount, but preferably, it is added in the range from $1\times10^{-6}$ mol to 2 mol, and more preferably, from $1\times10^{-3}$ mol to 0.5 mol per one mol of silver.

1-10. Other Additives

1) Mercapto Compounds, Disulfides and Thiones

In the invention, mercapto compounds, disulfide compounds, and thione compounds may be added in order to control the development by suppressing or enhancing development, to improve spectral sensitization efficiency, and to improve storage properties before and after development. Descriptions can be found in paragraph Nos. 0067 to 0069 of JP-A No. 10-62899, a compound expressed by formula (I) of JP-A No. 10-186572 and specific examples thereof shown in paragraph Nos. 0033 to 0052, in lines 36 to 56 in page 20 of EP No. 0803764A1. Among them, mercapto-substituted heterocyclic aromatic compound, which is described in JP-A Nos. 9-297367, 9-304875, 2001-100358, 2002-303954, 2002-303951 and the like, is particularly preferred.

2) Toner

In the photothermographic material of the present invention, the addition of a toner is preferred. The description of the toner can be found in JP-A No.10-62899 (paragraph Nos. 0054 to 0055), EP-A No.0803764A1 (page 21, lines 23 to 48), JP-A Nos.2000-356317 and 2000-187298. Preferred are phthalazinones (phthalazinone, phthalazinone derivatives and metal salts thereof, e.g., 4-(1-naphthyl)phthalazinone, 6-chlorophthalazinone, 5,7-dimethoxyphthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate and tetrachlorophthalic anhydride); phthalazines(phthalazine, phthalazine derivatives and metal salts thereof, e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6 isopropylphthalazine and 4-methylphthalic acid.

3) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving image tone, preventing the generation of interference fringes and preventing irradiation on laser exposure, various types of dyes and pigments (for instance, C.I. Pigment Blue 60, C.I. Pigment Blue 64, and C.I. Pigment Blue 15:6) may be used in the photosensitive layer of the invention. Detailed description can be found in WO No. 98/36322, JP-A Nos. 10-268465 and 11-338098, and the like.

5) Ultra-high Contrast Promoting Agent

In order to form ultra-high contrast image suitable for use in graphic arts, it is preferred to add an ultra-high contrast promoting agent into the image forming layer. Details on the ultra-high contrast promoting agents, method of their addition and addition amount can be found in paragraph No. 0118, paragraph Nos. 0136 to 0193 of JP-A No. 11-223898, as compounds expressed by formulae (H), (1) to (3), (A), and (B) in JP-A No. 2000-284399; as an ultra-high contrast accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, 1 mmol or less per one mol of silver.

In the case of using an ultra-high contrast promoting agent in the photothermographic material of the invention, it is preferred to use an acid resulting from hydration of diphosphorus pentaoxide, or its salt in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coverage per 1 $m^2$ of the photosensitive material) may be set as desired depending on the sensitivity and fogging, but preferred is an amount of 0.1 $mg/m^2$ to 500 $mg/m^2$, and more preferably, of 0.5 $mg/m^2$ to 100 $mg/m^2$.

1-11. Preparation of Coating Solution and Coating

The temperature for preparing the coating solution for use in the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

1-12. Layer Constitution

The image forming layer of the invention is constructed on a support by one or more layers. In the case of constituting the layer by a single layer, it comprises an organic silver salt, photosensitive silver halide, a reducing agent, and a binder, which may further comprise additional materials as desired if necessary, such as a toner, a coating aid, and other auxiliary agents. In the case of constituting the image forming layer from two or more layers, the first image forming layer (in general, a layer placed adjacent to the support) contains an organic silver salt and a photosensitive silver halide, and some of the other components must be incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the photosensitive layers as described in U.S. Pat. No. 4,460,681.

The photothermographic material according to he invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photosensitive material.

1) Surface Protective Layer

The photothermographic material of the invention may further comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like.

Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.).

The coating amount of polyvinyl alcohol (per 1 $m^2$ of support) in the protective layer (per one layer) is preferably in the range from 0.3 $g/m^2$ to 4.0 $g/m^2$, and more preferably, from 0.3 $g/m^2$ to 2.0 $g/m^2$.

The coverage of total binder (inclusive of water-soluble polymer and latex polymer) (per 1 $m^2$ of support) in the surface protective layer (per one layer) is preferably in the range from 0.3 $g/m^2$ to 5.0 $g/m^2$, and more preferably, from 0.3 $g/m^2$ to 2.0 $g/m^2$.

2) Antihalation Layer

The photothermographic material of the present invention may comprise an antihalation layer provided to the side farther from the light source with respect to the photosensitive layer.

Descriptions on the antihalation layer can be found in paragraph Nos. 0123 to 0124 of JP-A No. 11-65021, in JP-A Nos. 11-223898,9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the bleaching dye is determined depending on the use of the dye. In general, it is used at an amount as such that the optical density (absorbance) exceeds 0.1 when measured at the desired wavelength. The optical density is preferably in the range from 0.15 to 2, and more preferably from 0.2 to 1. The addition amount of dyes to obtain optical density in the above range is generally from 0.001 $g/m^2$ to 1 $g/m^2$.

By thermal bleaching the dye in such a manner, the optical density after thermal development can be lowered to 0.1 or lower. Two types or more of thermal bleaching dyes may be used in combination in a photothermographic material. Similarly, two types or more of base precursors may be used in combination.

In the case of thermal decolorization by the combined use of a decoloring dye and a base precursor, it is advantageous from the viewpoint of thermal decolorization efficiency to further use the substance capable of lowering the melting point by at least 3° C. when mixed with the base precursor (e.g., diphenylsulfone, 4-chlorophenyl(phenyl)sulfone) as disclosed in JP-A No. 11-352626.

3) Back Layer

Back layers usable in the invention are described in paragraph Nos. 0128 to 0130 of JP-A No. 11-65021.

In the invention, coloring matters having maximum absorption in the wavelength range from 300 nm to 450 nm may be added in order to improve a color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in the range from 0.1 $mg/m^2$ to 1 $g/m^2$, preferably to the back layer which is provided to the side opposite to the photosensitive layer.

Further, in order to control the basic color tone, it is preferred to use a dye having an absorption peak in the wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming surface side, or in the back surface side.

The photothermographic material of the invention is preferably a so-called one-side photosensitive material, which comprises at least one layer of a photosensitive layer containing silver halide emulsion on one side of the support, and a back layer on the other side.

4) Matting Agent

A matting agent may be preferably added to the photothermographic material of the invention in order to improve transportability. Description on the matting agent can be found in paragraphs Nos. 0126 to 0127 of JP-A No.11-65021. The addition amount of the matting agents is preferably in the range from 1 $mg/m^2$ to 400 $mg/m^2$, more preferably, from 5 $mg/m^2$ to 300 $mg/m^2$, with respect to the coating amount per one $m^2$ of the photosensitive material.

There is no particular restriction on the shape of the matting agent usable in the invention and it may fixed form or non-fixed form. Preferred is to use those having fixed form and globular shape. Average particle size is preferably in the range of from 0.5 μm to 10 μm, more preferably, from 1.0 μm to 8.0 μm, and most preferably, from 2.0 μm to 6.0 μm. Furthermore, the particle distribution of the matting agent is preferably set as such that the variation coefficient may become 50% or lower, more preferably, 40% or lower, and most preferably, 30% or lower. The variation coefficient, herein, is defined by (the standard deviation of particle diameter)/(mean diameter of the particle)×100. Furthermore, it is preferred to use by blending two types of matting agents having low variation coefficient and the ratio of their mean diameters is more than 3.

The matness on the image forming layer surface is not restricted as far as star-dust trouble occurs, but the matness of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matt degree of the back layer in the invention is preferably in the range of 1200 seconds or less and 10 seconds or more; more preferably, 800 seconds or less and 20 seconds or more; and further preferably, 500 seconds or less and 40 seconds or more, as expressed by Beck smoothness.

In the invention, the matting agent is incorporated preferably in the outermost surface layer on the photosensitive layer plane or a layer functioning as the outermost surface layer, or a layer near to the outer surface, and a layer that functions as the so-called protective layer.

5) Polymer Latex

In the case of the photothermographic material of the invention for graphic arts in which changing of dimension is critical, it is preferred to incorporate polymer latex in the surface protective layer and the back layer. As such polymer latexes, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Ouyou (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid copolymer, a latex of methyl methacrylate (64.0% by weight)/styrene (9.0% by weight)/butyl acrylate (20.0% by weight)/2-hydroxyethyl methacrylate (5.0% by weight)/acrylic acid copolymer, and the like.

Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer preferably is contained in an amount of 10% by weight to 90% by weight, particularly preferably, of 20% by weight to 80% by weight of the total weight of binder.

6) Surface pH

The surface pH of the photothermographic material according to the invention preferably yields a pH of 7.0 or lower, more preferably, 6.6 or lower, before thermal development treatment. Although there is no particular restriction concerning the lower limit, the pH value is about 3, and the most preferred surface pH range is from 4 to 6.2.

From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbun, 1989), and the like.

8) Surfactant

As the surfactant, the solvent, the support, antistatic agent or the electrically conductive layer, and the method for obtaining color images applicable in the invention, there can be mentioned those disclosed in paragraph Nos. 0132, 0133, 0134, 0135, and 0136, respectively, of JP-A No. 11-65021. The lubricant is described in paragraph Nos. 0061 to 0064 of JP-A No. 11-84573.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably. For the photothermographic material in the invention, the fluorocarbon surfactants described in JP-A Nos. 200282411 and 2003-57780 are preferably used. Especially, the usage of the fluorocarbon surfactants described in JP-A No. 2003-57780 in an aqueous coating solution is preferred viewed from the standpoint of capacity in static control, stability of the coating side state and sliding facility.

According to the invention, the fluorocarbon surfactant can be used on either side of image forming layer side or back layer side, but is preferred to use on the both sides. Further, it is particularly preferred to use in combination with electrically conductive layer including aforementioned metal oxides. In this case the amount of the fluorocarbon surfactant on the side of the electrically conductive layer can be reduced or removed.

The amount of the fluorocarbon surfactant used is preferably in the range from 0.1 $mg/m^2$ to 100 $mg/m^2$ on each side of image forming layer and back layer, more preferably from 0.3 $mg/m^2$ to 30 $mg/m^2$, further preferably from 1 $mg/m^2$ to 10 $mg/m^2$.

9) Antistatic Agent

The photothermographic material of the invention preferably contains an electrically conductive layer including metal oxides or electrically conductive polymers.

The antistatic layer can be laid on either side of the image forming layer side or the back layer side, it is preferred to set between the support and the back layer. The antistatic layer may serve as an undercoat layer, or a back surface protective layer, and the like, but can also be placed specially.

As an electrically conductive material of the antistatic layer, metal oxides having enhanced electric conductivity by the method of introducing oxygen defects or different types of metallic atoms into the metal oxides are preferably for use.

Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like; Particularly preferred for use is $SnO_2$ combined with Sb. The addition amount of different types of atoms is preferably in the range from 0.01 mol % to 30 mol %, and particularly preferably, in the range from 0.1 mol % to 10 mol %.

The shape of the metal oxides can include, for example, spherical, needle-like, or plate-like shape. The needle-like particles, with the rate of (the major axis)/(the minor axis) is 2.0 or more, and more preferably, 3.0 to 50, is preferred viewed from the standpoint of the electric conductivity effect.

The metal oxides is used preferably in the range from 1 $mg/m^2$ to 1000 $mg/m^2$, more preferably from 10 $mg/m^2$ to 500 $mg/m^2$, and further preferably from 20 $mg/m^2$ to 200 $mg/m^2$.

Examples of the antistatic layer in the invention include described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

10) Support

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development.

In the case of a photothermographic material for medical use, the transparent support may be colored with a blue dye (for instance, dye-1 described in the example of JP-A No. 8-240877), or may be uncolored.

Example of the support is described in paragraph No. 0134 of JP-A No.11-65021.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and the like. The moisture content of the support is preferably 0.5% by weight or less when coating for image forming layer and back layer is conducted on the support.

11) Other Additives

Furthermore, antioxidant, stabilizing agent, plasticizer, UV absorbent, or a coating aid may be added to the photothermographic material. Solvents described in paragraph No. 0133 of JP-A No. 11-65021 may be added. Each of the additives is added to either of the photosensitive layer or the non-photosensitive layer. Reference can be made to WO No. 98/36322, EP-A No. 803764A1, JP-A Nos. 10-186567 and 10-18568, and the like.

12) Coating Method

The photothermographic material of the invention may be coated by any method. More specifically, various types of coating operations inclusive of extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11*b*.1, page 427, of the same literature. If desired, two or more layers can be coated simultaneously by the method described in pages 399 to 536 of the same literature, or by the method described in U.S. Pat. No. 2,761,791 and British Patent No. 837095.

The coating solution for the layer containing organic silver salt in the invention is preferably a so-called thixotropic fluid. For the details of this technology, reference can be made to JP-A No. 11-52509.

Viscosity of the coating solution for the layer containing organic silver salt in the invention at a shear velocity of $0.1S^{-1}$ is preferably from 400 mPa·s to 100,000 mPa·s, and more preferably, from 500 mPa·s to 20,000 mPa·s. At a shear velocity of $1000S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in the range from 60° C. to 100° C. at the film surface, and heating time is preferably in the range from 1 second to 60 seconds. More preferably, the temperature of the heat treatment is in the range 70° C. to 90° C. at the film surface and heating time is 2 seconds to 10 seconds. A preferred method of heat treatment for the invention is described in JP-A No. 2002-107872.

Furthermore, the production methods described in JP-A Nos. 2002-156728 and 2002-182333 are favorably used in the invention in order to stably and continuously produce the photothermographic material of the invention.

The photothermographic material is preferably of monosheet type (i.e., a type which can form image on the photothermographic material without using other sheets such as an image-receiving material).

13) Wrapping Material

In order to suppress variation from occurring in the photographic property during a preservation of the photosensitive material of the invention before thermal development, or in order to improve curling or winding tendencies, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and most preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and most preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos.8-254793 and 2000-206653.

14) Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064 and 2000-171936.

15) Color Image Forming

Constitution of the multi-color photothermographic material may include a combination of these two layers for each color. Alternatively, all ingredients may be included into a single layer as described in U.S. Pat. No. 4,708,928.

In instances of multi-color photothermographic materials, each photosensitive layer is in general, held distinctively each other by using a functional or nonfunctional barrier layer between each photosensitive layer as described in U.S. Pat. No. 4,460,681.

2. Image Forming Method 2-1. Exposure

Although the photosensitive material of the invention may be subjected to exposure by any methods, laser beam is preferred as an exposure light source. It made clear that it needs small amount of energy to record an image. Using thus strong light in a short time made it possible to achieve photosensitivity to the purpose.

As laser beam according to the invention, preferably used are gas laser ($Ar^+$, He—Ne, He—Cd), YAG laser, pigment laser, semiconductor laser. Semiconductor laser and second harmonics generator element can also be used. Preferred laser is determined corresponding to the peak absorption wavelength of spectral sensitizer and the like.

He—Ne laser of red through infrared emission, red laser diode, or $Ar^+$, He—Ne, He—Cd laser of blue through green emission, blue laser diode can be used. Preferred laser is red to infrared laser diode and the peak wavelength of laser beam is 600 nm to 900 nm, preferably 620 nm to 850 nm. In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future.

The peak wavelength of blue laser beam is preferably 300 nm to 500 nm, and more preferably 400 nm to 500 nm.

Laser beam which oscillates in a longitudinal multiple modulation by a method such as high frequency superposition is also preferably employed.

2-2. Thermal Development

Although any method may be used for this thermal development process, thermal development of the photothermographic material of the invention is usually performed by elevating the temperature of the photothermographic material exposed imagewise.

In the process for thermal development, either drum type heaters or plate type heaters may be used. However, plate type heater processes are more preferred.

The temperature for the development is preferably 80° C. to 250° C., preferably 100° C. to 140° C., and more preferably 110° C. to 130° C.

Fuji Medical Dry Laser Imager FM-DP L (produced by Fuji Photo Film Co. Ltd.) is one example of an image forming apparatus equipped with plate type heater system and applicable for the present invention. By modifying the length of four stages of the plate heaters (called as panel heater) of the said laser imager and by changing the transportation speed, namely, the line speed (mm/sec) of the photothermographic material during thermal development, heating of definite time can be maintained. When the length of the plate heater is long, the said line speed can become higher, and the increase of the line speed improves the processing efficiency of thermal development.

It is one of the features of this present invention that the line speed during thermal development is set at 20 mm/second or higher by using the photothermographic material of the present invention. From the viewpoint of improvement of the speed of thermal development processing, the line speed during thermal development is preferably 24 mm/second or higher, more preferably 28 mm/second or higher. The above results are achieved especially by using the photothermographic material of the present invention.

Time period for the development of the photothermographic material of the present invention is preferably 6 second to 14 seconds, more preferably 6 seconds to 12 seconds, and further preferably 6 seconds to 10 seconds.

Furthermore, by using the photothermographic material according to the present invention, an image can be obtained within 15 minutes after starting-up the image forming apparatus. Generally a pause after starting-up an apparatus is preferably required for the processing of materials to stabilize an exposure and a thermal development conditions. However, the photothermographic material containing at least one of compounds represented by formulae (1a) to (1c) of the present invention can save the waiting time after starting-up the image forming apparatus. Therefore the image forming method of the present invention can be accomplished. Hereto, a point of time to switch on electric power of an apparatus is referred to "start-up".

A thermal development process by a plate type heater may be a process described in JP-A No. 11-133572, which discloses an image forming apparatus in which a visible image is obtained by bringing a photothermographic material with a formed latent image into contact with a heating means at a thermal development portion, wherein the heating means comprises a plate heater, and plurality of press rollers are oppositely provided along one surface of the plate heater, the image forming apparatus is characterized in that thermal development is performed by passing the photothermographic material between the press rollers and the plate heater. It is preferred that the plate heater is divided into 2 to 6 portions, with the leading end having the lower temperature by 1° C. to 10° C. For example, four stages of plate heaters which can be independently subjected to the temperature control are used, and are controlled so that they respectively become 112° C., 119° C., 121° C., and 120° C.

Such a process is also described in JP-A No. 54-30032, which allows for excluding moisture and organic solvents included in the photothermographic material out of the system, and also allows for suppressing the change of shapes of the support of the photothermographic material upon rapid heating of the photothermographic material.

Upon thermal development, the silver salts in the coating layer of the photothermographic material are reduced to give the metallic silver by reducing agents and visible images are formed. The conversion rate how the developed silver is effectively contributed to form the image is generally expressed as a development efficiency.

In the present invention, the development efficiency is defined as B/A×100, where A is a total amount of silver by mole (the sum of organic silver salt and silver halide) per unit area of a photothermographic material, and B is an amount of reduced silver by mole per unit area on thermal development of the material.

In order to calculate the development efficiency, the amount B by mole of the reduced silver is first determined as follows; a photothermographic material is subjected to an uniform exposure of giving a maximum density and thermally developed, thereafter it is dipped for one hour in a 10% methanol solution of 2,2'-(ethylenedithio)diethanol to remove undeveloped organic silver salt and photosensitive silver halide. And then the material is rinsed in a methanol solution and dried. The amount of the residual silver per unit area is determined from measurement of intensity by fluorescent x-ray analysis. The silver amount is determined by the calibration curve obtained in advance by using samples coated with known silver amount. And also the total amount of coated silver A by mole of a photothermographic material is determined from measurement of intensity by fluorescent X-ray analysis using the undeveloped material.

According to the photothermographic material of the invention, the development efficiency at a maximum density (Dmax) part is preferably 70% or more, and more preferably 80% or more.

As the development efficiency is higher, the utility efficiency of the organic silver salts of the photothermographic material comes to be higher. Therefore for obtaining high maximum density with fewer amounts of organic silver salts, the high development efficiency is preferred. The inventors made eager investigations on the development efficiency, and as a result, the inventors have found out that some parts of the organic silver salts is converted into silver halide by organic polyhalogen compounds incorporated in the materials, and also that the full development of the material results in higher development efficiency, however the best photographic properties (for instance, fog, image tone, or contrast, or the like) are obtained under the thermal development condition giving somewhat less development efficiency. Therefore, it is a fundamental and lasting problem on the planning of photothermographic materials to maintain the photographic characteristics such as storage stability, photographic properties and rapid processing of the photothermographic material with raising the development efficiency simultaneously.

Especially among the said photographic properties, it is a very hard task to attain both high development efficiency and good image tone of the developed silver, because the image tone highly depends on the development efficiency.

As for the said image tone, the evaluation method by a sensory evaluation of the image tone are there, but the image tone is evaluated quantitatively by hue-angle hab as the quantitative evaluation according to the provisions of JIS Z 8729. Namely the hue-angle hab is expressed by the formula, $hab=\tan^{-1}(b^*/a^*)$ by using XYZ colorimetric system, or tri-stimulus values X, Y, and Z, or X10, Y10, and Z10 according to the provisions of JIS Z 8701, and chromaticity coordinates a*, b* of L*a*b* colorimetric system according to the provisions of JIS Z 8729.

For the present invention, the said hue-angle is measured from the sample that is subjected to uniform exposure giving an optical density of 1.0 and then thermally developed for a determined time. The hue-angle is preferably preferred from 180° to 270°, and more preferably from 2100 to 260°.

The reducing agent of the invention, that is, the compound represented by formulae (R1) and (R2), is very effective to give high development efficiency and to obtain excellent image tone.

For downsizing the image forming apparatus as well as reduction in thermal development time period, it is preferred that more stable control of the heater can be accomplished, and in addition, it is desired that light exposure is started from the leading end of one photosensitive material sheet followed by thermal development which is started before completing the light exposure up to the posterior end. Preferable imagers which enable a rapid treatment according to the invention are described in for example, JP-A Nos. 2002-289804 and 2002-287668. When such imagers are used, thermal developing treatment can be performed in 14 seconds with a plate type heater having three sections which are controlled to be 107° C.-121° C.-121° C. Thus, the output time period for the first sheet can be reduced to about 60 seconds. For such a rapid developing treatment, to use the photothermographic materials of the invention in combination, which are highly sensitive and less susceptible to the environmental temperature, is preferred.

2-3. System

Examples of a medical laser imager equipped with a light exposing portion and a thermal developing portion include Fuji Medical Dry Laser Imager FM-DP L and DRYPIX 7000. In connection with FM-DP L, description is found in Fuji Medical Review No. 8, pages 39 to 55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

3. Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film having such a thickness that the thickness should become 175 μm after tentered and thermal fixation.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

3) Undercoating

<Preparations of Coating Solution for Undercoat Layer>

| | |
|---|---|
| Formula (1) (for undercoat layer on the image forming layer side) | |
| Pesresin A-520 manufactured by Takamatsu Oil & Fat Co., Ltd. (30% by weight solution) | 59 g |
| polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| distilled water | 935 mL |
| Formula (2) (for first layer on the back surface) | |
| Styrene-butadiene copolymer latex (solid content of 40% by weight, styrene/butadiene weight ratio = 68/32) | 158 g |
| 8% by weight aqueous solution of 2,4-dichloro-6-hydroxy-S-triazine sodium salt | 20 g |
| 1% by weight aqueous solution of sodium laurylbenzenesulfonate | 10 mL |
| distilled water | 854 mL |
| Formula (3) (for second layer on the back surface) | |
| $SnO_2$/SbO (9/1 weight ratio, mean particle diameter of 0.038 μm, 17% by weight dispersion) | 84 g |
| gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |

-continued

| | |
|---|---|
| NaOH (1% by weight) | 6 mL |
| Proxel (manufactured by Imperial Chemical Industries PLC) | 1 mL |
| distilled water | 805 mL |

<Undercoating>

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse face (back surface) with a wire bar so that the amount of wet coating became 5.7 mL/m$^2$, and dried at 180° C. for 5 minutes. Furthermore, the aforementioned formula (3) of the coating solution for the undercoat was coated on the reverse face (back surface) with a wire bar so that the amount of wet coating became 7.7 mL/m$^2$, and dried at 180° C. for 6 minutes. Thus, an undercoated support was produced.

(Back Layer)

1) Preparations of Coating Solution for Back Layer

<Preparation of Dispersion of Solid Fine Particles (a) of Base Precursor>

A base precursor-1 in an amount of 2.5 kg, and 300 g of a surfactant (trade name: DEMOL N, manufactured by Kao Corporation), 800 g of diphenyl sulfone, 1.0 g of benzoisothiazolinone sodium salt and distilled water were added to give the total amount of 8.0 kg and mixed. The mixed liquid was subjected to beads dispersion using a horizontal sand mill (UVM-2: manufactured by IMEX Co., Ltd.). Process for dispersion included feeding the mixed liquid to UVM-2 packed with zirconia beads having the mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion ($D_{450}/D_{650}$) became 3.0 upon spectral absorption measurement. Thus resulting dispersion was diluted with distilled water so that the concentration of the base precursor became 25% by weight, and filtrated (with a polypropylene filter having the mean fine pore diameter of 3 μm) for eliminating dust to put into practical use.

<Preparation of Dispersion of Solid Fine Particle of Dye>

A cyanine dye-1 in an amount of 6.0 kg, and 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total liquid amount of 60 kg. The mixed liquid was subjected to dispersion with 0.5 mm zirconia beads using a horizontal sand mill (UVM-2: manufactured by IMEX Co., Ltd.).

The dispersion was dispersed until the ratio of the optical density at 650 nm and the optical density at 750 nm for the spectral absorption of the dispersion ($D_{650}/D_{750}$) became 5.0 or more upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

2) Preparation of Coating Solution for Antihalation Layer

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 490 mL of water to allow gelatin to be dissolved. Additionally, 2.3 mL of a 1 mol/L aqueous sodium hydroxide solution, 40 g of the aforementioned dispersion of the solid fine particle of the dye, 90 g of the aforementioned dispersion of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis (vinylsulfone acetamide) was admixed to give a coating solution for the antihalation layer.

3) Preparation of Coating Solution for Back Surface Protective Layer

A vessel was kept at 40° C., and thereto were added 40 g of gelatin, 35 mg of benzoisothiazolinone and 840 mL of water to allow gelatin to be dissolved. Additionally, 5.8 mL of a 1 mol/L aqueous sodium hydroxide solution, liquid paraffin emulsion at 1.5 g equivalent to liquid paraffin, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight solution of methyl methacrylate/styrene/butyl acrylate/hydroxyethyl methacrylate/acrylic acid copolymer (copolymer weight ratio of 57/8/28/5/2) latex were admixed. Just prior to the coating, 25 mL of a 4% by weight aqueous solution of N,N-ethylenebis (vinylsulfone acetamide) was admixed to give a coating solution for the back surface protective layer.

4) Coating of Back Layer

The back surface side of the undercoated support as described above was subjected to simultaneous double coating so that the coating solution for the antihalation layer gives the coating amount of gelatin of 0.52 g/m$^2$, and so that the coating solution for the back surface protective layer gives the coating amount of gelatin of 1.7 g/m$^2$, followed by drying to produce a back layer.

(Image Forming Layer, Intermediate Layer, and Surface Protective Layer)

1. Preparations of Materials for Coating

1) Silver Halide Emulsion

<<Preparation of Silver Halide Emulsion-1>>

To 1421 mL of distilled water was added 3.1 mL of a 1% by weight potassium bromide solution. Further, a liquid added with 3.5 mL of sulfuric acid having the concentration of 0.5 mol/L and 31.7 g of phthalated gelatin was kept at 30° C. while stirring in a stainless steel reaction pot, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Hexachloroiridium (III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron (II) hexacyanide aqueous solution was added at a total amount of $3\times10^{-4}$ mol per one mol of silver. The mixture was adjusted to the pH of 3.8 with sulfuric acid at the concentration of 0.5 mol/L. After stopping stirring, the mixture was subjected to precipitation/desalting/water washing steps. The mixture was adjusted to the pH of 5.9 with sodium hydroxide at the concentration of 1 mol/L to produce a silver halide dispersion having the pAg of 8.0.

The silver halide dispersion was kept at 38° C. with stirring, and thereto was added 5 mL of a 0.34% by weight methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per one mol of silver. At additional 5 minutes later, a tellurium sensitizer C in a methanol solution was added at $2.9\times10^{-4}$ mol per one mol of silver and subjected to aging for 91 minutes. Thereafter, a methanol solution of a spectral sensitizer A and a spectral sensitizer B with a molar ratio of 3:1 was added thereto at $1.2\times10^{-3}$ mol in total of the spectral sensitizer A and B per one mol of silver. At one minute later, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver, and 1-(3-methylureidophenyl)-5-mercaptotetrazole in an aqueous solution at $8.5\times10^{-3}$ mol per one mol of silver were added to produce a silver halide emulsion-1.

Grains in thus prepared silver halide emulsion were silver iodobromide grains having a mean sphere equivalent diameter of 0.042 μm, a variation coefficient of 20%, which uniformly include iodine at 3.5 mol %. Grain size and the like were determined from the average of 1000 grains using an electron microscope. The [100] face ratio of this grain was found to be 80% using a KubelkaMunk method.

<<Preparation of Silver Halide Emulsion-2>>

Preparation of silver halide emulsion-2 was conducted in a similar manner to the process in the preparation of the silver halide emulsion-1 except that: the temperature of the liquid upon the grain formation step was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium iron (II) hexacyanide was deleted. The precipitation/desalting/water washing/dispersion were carried out similarly to the silver halide emulsion-1. Furthermore, the spectral sensitization, chemical sensitization, and addition of 5-methyl-2-mercaptobenzimidazole and 1-phenyl-2-heptyl-5-mercapto-1,3,4-triazole was executed similarly to the emulsion-1 except that: the amount of the tellurium sensitizer C to be added was changed to $1.1\times10^{-4}$ mol per one mol of silver; the amount of the methanol solution of the spectral sensitizer A and a spectral sensitizer B with a molar ratio of 3:1 to be added was changed to $7.0\times10^{-4}$ mol in total of the spectral sensitizer A and the spectral sensitizer B per one mol of silver; the addition of 1-phenyl-2-heptyl-5-mercapto-1,3,4-triazole was changed to give $3.3\times10^{-3}$ mol per one mol of silver; and the addition of 1-(3-methylureidophenyl)-5-mercaptotetrazole was changed to give $4.7\times10^{-3}$ mol per one mol of silver to produce a silver halide emulsion-2. The emulsion grains in the silver halide emulsion-2 were pure cubic silver bromide grains having a mean sphere equivalent diameter of 0.080 μm and a variation coefficient of 20%.

<<Preparation of Silver Halide Emulsion-3>>

Preparation of a silver halide emulsion-3 was conducted in a similar manner to the process in the preparation of the silver halide emulsion-1 except that the temperature of the liquid upon the grain formation step was altered from 30° C. to 27° C. In addition, the precipitation/desalting/water washing/dispersion were carried out similarly to the silver halide emulsion-1. Silver halide emulsion-3 was obtained similarly to the emulsion-1 except that: the addition of the methanol solution of the spectral sensitizer A and the spectral sensitizer B was changed to the solid dispersion (aqueous gelatin solution) at a molar ratio of 1:1 with the amount to be added being $6.0\times10^{-3}$ mol in total of the spectral sensitizer A and spectral sensitizer B per one mol of silver; the amount of the tellurium sensitizer C to be added was changed to $5.2\times10^{-4}$ mol per one mol of silver; and bromoauric acid at $5\times10^{-4}$ mol per one mol of silver and potassium thiocyanate at $2\times10^{-3}$ mol per one mol of silver were added at 3 minutes following the addition of the tellurium sensitizer. The grains in the silver halide emulsion-3 were silver iodobromide grains having a mean sphere equivalent diameter of 0.034 μm and a variation coefficient of 20%, which uniformly include iodine at 3.5 mol %.

<<Preparation of Mixed Emulsion A for Coating Solution>>

The silver halide emulsion-1 at 70% by weight, the silver halide emulsion-2 at 15% by weight and the silver halide emulsion-3 at 15% by weight were dissolved, and thereto was added benzothiazolium iodide at $7\times10^{-3}$ mol per one mol of silver with a 1% by weight aqueous solution. Further, water was added thereto to give the content of silver of 38.2 g per one kg of the mixed emulsion for a coating solution, and 1-(3-methylureidophenyl)-5-mercaptotetrazole was added to give 0.34 g per 1 kg of the mixed emulsion for a coating solution.

Further, as "a compound that can be one-electron-oxidized to provide a one-electron oxidation product, which releases one or more electrons", the compounds Nos. 2, 20 and 26 were added respectively in an amount of $2\times10^{-3}$ mol per one mol of silver halide.

2) Preparations of Dispersion of Silver Salt of Fatty Acid

<<Preparation of Dispersion of Silver Salt of Fatty Acid A>>

87.6 kg of behenic acid (Henkel Co., trade name: Edenor C22-85R), 423 L of distilled water, 49.2 L of an aqueous sodium hydroxide solution at the concentration of 5 mol/L, 120 L of t-butyl alcohol were admixed, and subjected to a reaction with stirring at 75° C. for one hour to give a solution of a sodium behenate A. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of a sodium behenate A and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of a sodium behenate A was thereafter started, and during 14 minutes and 15 seconds following the completion of adding the aqueous silver nitrate solution, the added material was restricted to the solution of a sodium behenate A alone. The temperature inside of the reaction vessel was then set to be 30° C., and the temperature outside was controlled so that the liquid temperature could be kept constant. In addition, the temperature of a pipeline for the addition system of the solution of a sodium behenate A was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of a sodium behenate A was added and the position, at which the aqueous silver nitrate solution was added, was arranged symmetrically with a shaft for stirring located at a center. Moreover, both of the positions were adjusted to avoid contact with the reaction liquid.

After completing the addition of the solution of a sodium behenate A, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a flake crystal was revealed having a=0.14 μm, b=0.4 μm and c=0.6 μm on the average value, with a mean aspect ratio of 5.2, a mean sphere equivalent diameter of 0.52 μm and a variation coefficient of 15% (a, b and c are as defined aforementioned).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1260 kg/cm$^2$ to give a dispersion of the silver behenate (a dispersion of silver salt of fatty acid). For the cooling manipulation, coiled heat exchangers were equipped before and after of the interaction chamber respectively, and accordingly, the temperature for the dispersion was set to be 18° C. by regulating the temperature of the cooling medium.

<<Preparation of Dispersion of Silver Salt of Fatty Acid B>>

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. Thus resulting crystal was subjected to centrifugal filtration, and washing was performed with 100 kg of isopropyl alcoholy. Thereafter, the crystal was dried. Thus resulting crystal was esterified, and subjected to GC-FID analysis to give the results of the content of behenic acid being 96 mol %. In addition, arachidic acid was included at 2 mol %, lignoceric acid was included at 2 mol %, and erucic acid was included at 0.001 mol %.

<Preparation of Dispersion of Silver Salt of Fatty Acid B>

88 kg of recrystallized behenic acid, 422 L of distilled water, 49.2 L of an aqueous sodium hydroxide solution at the concentration of 5 mol/L, 120 L of t-butyl alcohol were admixed, and subjected to a reaction with stirring at 75° C. for one hour to give a solution of a sodium behenate B. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of a sodium behenate B and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of a sodium behenate B was thereafter started, and during 14 minutes and 15 seconds following the completion of adding the aqueous silver nitrate solution, the added material was restricted to the solution of a sodium behenate B alone. The temperature inside of the reaction vessel was then set to be 30° C., and the temperature outside was controlled so that the liquid temperature could be kept constant. In addition, the temperature of a pipeline for the addition system of the solution of a sodium behenate B was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of a sodium behenate B was added and the position at which the aqueous silver nitrate solution was added were arranged symmetrically with a shaft for stirring located at a center. Moreover, both of the positions were adjusted to avoid contact with the reaction liquid.

After completing the addition of the solution of a sodium behenate B, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1 and a variation coefficient of 11% (a, b and c are as defined aforementioned).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped fore and aft of the interaction chamber respectively, and accordingly, the temperature for the dispersion was set to be 18° C. by regulating the temperature of the cooling medium.

3) Preparations of Reducing Agent Dispersion

<<Preparation of Reducing Agent ($R_1$-1) Dispersion>>

To 10 kg of a reducing agent ($R_1$-1) of the invention and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to thermal treatment at 60° C. for 5 hours to obtain a reducing agent (R1-1) dispersion. Particles of the reducing agent included in the resulting reducing agent dispersion had a median diameter of 0.50 μm, and a maximum particle diameter of 1.6 μm or less. The resultant reducing agent dispersion was subjected to filtration with a polypropylene filter having a pore size of 3.0 μm to remove foreign substances such as dust, and stored.

<<Preparations of Comparative Reducing Agent (S-1) and (S-2) Dispersion and Other Reducing Agent Dispersion of the Invention>>

As for these dispersions, they were prepared in a similar manner to the preparation of aforementioned reducing agent (R1-1) dispersion. The reducing agents for comparision are illustrated below.

4) Preparation of Imagewise Coloring Compound-1 Dispersion

To 10 kg of an imagewise coloring compound-1 (the aforementioned example compound No. C-22) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the imagewise coloring compound to be 25% by weight. Accordingly, an imagewise coloring compound-1 dispersion was obtained. Particles of the imagewise coloring compound included in the resulting imagewise coloring compound dispersion had a median diameter of 0.45 μm, and a maximum particle diameter of 1.5 μm or less. The resultant imagewise coloring compound dispersion was subjected to filtration with a polypropylene filter having a pore size of 3.0 μm to remove foreign substances such as dust, and stored.

5) Preparation of Hydrogen Bonding Compound-1 Dispersion

To 10 kg of a hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent thermal treatment at 80° C. for one hour to obtain a hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

6) Preparations of Development Accelerator Dispersion

<<Preparation of Development Accelerator No. 1 Dispersion>>

To 10 kg of a development accelerator No. 1 and 20 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the development accelerating agent to be 20% by weight. Accordingly, a development accelerator No. 1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

<<Preparation of Development Accelerator No. 2 Dispersion>>

Also concerning a solid dispersion of development accelerator No. 2, dispersion was executed in a similar manner to the development accelerator No. 1, and thus dispersion of 20% by weight was obtained.

7) Preparations of Organic Polyhalogen Compound Dispersion

<<Preparation of Organic Polyhalogen Compound-1 Dispersion>>

An organic polyhalogen compound-1 (tribromomethane sulfonylbenzene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 26% by weight. Accordingly, an organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

An organic polyhalogen compound-2 (N-butyl-3-tribromomethane sulfonylbenzoamide) in an amount of 10 kg, 20 kg of a 10% by weight aqueous solution of modified polyvinyl alcohol (manufactured by Kuraray Co., Ltd., Poval MP203), and 0.4 kg of a 20% by weight aqueous solution of sodium triisopropylnaphthalenesulfonate were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Phthalazine Compound-1 Solution

Modified polyvinyl alcohol MP203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight phthalazine compound-1 solution.

9) Preparations of Mercapto Compound Solution

<<Preparation of an Aqueous Solution of Mercapto Compound-1>>

A mercapto compound-1 (1-(3-sulfophenyl)-5-mercaptotetrazole sodium salt) in an amount of 7 g was dissolved in 993 g of water to give a 0.7% by weight aqueous solution.

<<Preparation of an Aqueous Solution of Mercapto Compound-2>>

A mercapto compound-2 (1-(3-methylureidophenyl)-5-mercaptotetrazole) in an amount of 20 g was dissolved in 980 g of water to give a 2.0% by weight aqueous solution.

10) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4 G sand grinder mill: manufactured by IMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

11) Preparation of SBR Latex Solution

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Tereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had the mean particle diameter of 90 nm, Tg of 17° C., solid matter concentration of 44% by weight, the equilibrium moisture content at 25° C., 60% RH of 0.6% by weight, ionic conductance of 4.80 mS/cm (measurement of the ionic conductance performed using a conductivity meter CM-30S manufactured by To a Electronics Ltd. for the latex stock solution (44% by weight) at 25° C.).

2. Preparations of Coating Solutions

1) Preparation of Coating Solution for Image Forming Layer-1

The dispersion A of the silver salt of fatty acid obtained as described above in an amount of 500 g, the dispersion B of the silver salt of fatty acid obtained as described above in an amount of 500 g, 135 mL of water, 36 g of the pigment-1 dispersion, 28 g of organic polyhalogen compound-1 dispersion, 35 g of organic polyhalogen compound-2 dispersion, 171 g of the phthalazine compound-1 solution, 1060 g of the SBR latex (Tg: 17° C.) solution, 75 g of the reducing agent-1 dispersion, 157 g of the comparative reducing agent S-1 dispersion, 55 g of the hydrogen bonding compound-1 dispersion, 2.1 g of the imagewise coloring compound-1 dispersion, 4 mL of the mercapto compound-1 aqueous solution and 8 mL of the mercapto compound-2 aqueous solution were serially added. The coating solution for the image forming layer prepared by adding 140 g of the mixed emulsion A for coating solution thereto followed by thorough mixing just prior to the coating was fed directly to a coating die, and was coated.

Viscosity of the coating solution at 38° C. when it was measured using RheoStress RS150 manufactured by Haake was 31, 43, 42, 29, and 22 [mPa·s], respectively, at the shearing rate of 0.1, 1, 10, 100, 1000 [1/second].

The amount of zirconium in the coating solution was 0.30 mg per one g of silver.

2) Preparations of Coating Solution for Image Forming Layer-2 to -15

Preparations of coating solution for image forming layer-2 to -15 were conducted in a similar manner to the preparation of coating solution for image forming layer-1 except that changing the reducing agent dispersion to the dispersion shown in Table 1 and adding the development accelerator dispersion as shown in Table 1.

3) Preparation of Coating Solution for Intermediate Layer

To 1000 g of polyvinyl alcohol PVA-205 (manufactured by Kuraray Co., Ltd.), 163 g of the pigment-1 dispersion, 33 g of an aqueous solution of a blue dye-1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/$m^2$.

Viscosity of the coating solution was 58 [mPa·s] which was measured with a B type viscometer at 40° C. (No. 1 rotor, 60 rpm).

4) Preparation of Coating Solution for First Layer of Surface Protective Layers

In 840 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid and 5.4 mL of a 5% by weight aqueous solution of di(2-ethylhexyl) sodium sulfosuccinate, and were mixed. Immediately before coating, 40 mL of a 4% by weight chrome alum which had been mixed with a static mixer was fed to a coating die so that the amount of the coating solution became 26.1 mL/$m^2$.

Viscosity of the coating solution was 20 [mPa·s] which was measured with a B type viscometer at 40° C. (No. 1 rotor, 60 rpm).

5) Preparation of Coating Solution for Second Layer of Surface Protective Layers In 800 mL of water were dissolved 100 g of inert gelatin and 10 mg of benzoisothiazolinone, and thereto were added liquid paraffin emulsion at 8.0 g equivalent to liquid paraffin, 180 g of a 19% by weight solution of methyl methacrylate/styrene/butyl acrylate/hydroxyethyl methacrylate/acrylic acid copolymer (weight ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm), and were mixed to give a coating solution for the surface protective layer, which was fed to a coating die so that 8.3 mL/$m^2$ could be provided.

Viscosity of the coating solution was 19 [mPa·s] which was measured with a B type viscometer at 40° C. (No. 1 rotor, 60 rpm).

(Preparations of Photothermographic Materials)

1) Preparations of Photothermographic Material-101 to -115

Reverse surface of the back surface was subjected to simultaneous overlaying coating by a slide bead coating method in order of the image forming layer using the coating solution for image forming layer-1 to -15, intermediate layer, first layer of the surface protective layers and second layer of the surface protective layers starting from the undercoated face, and thus a sample of the photothermographic material-101 to -115 was produced. In this method, the temperature of the coating solution was adjusted to 31° C. for the image forming layer and intermediate layer, to 36° C. for the first layer of the surface protective layers, and to 37° C. for the second layer of the surface protective layers.

The coating amount of each compound for the image forming layer (g/$m^2$) is as follows. Furthermore, the coating amount of the reducing agent S-1 was 0.79 g/$m^2$, and the coating amounts of other reducing agents are shown in Table 1 below by relative mol % to S-1.

| | |
|---|---|
| Silver salt of fatty acid | 5.27 |
| Pigment-1 (C. I. Pigment Blue 60) | 0.036 |
| Organic polyhalogen compound-1 | 0.13 |
| Organic polyhalogen compound-2 | 0.21 |
| Phthalazine compound-1 | 0.18 |
| SBR latex | 9.43 |
| Reducing agent | (see Table 1) |
| Hydrogen bonding compound-1 | 0.28 |
| Imagewise coloring compound-1 | 0.04 |
| Development accelerator | (see Table 1) |
| Mercapto compound-1 | 0.001 |
| Mercapto compound-2 | 0.003 |
| Silver halide (on the basis of Ag content) | 0.13 |

Conditions for coating and drying are as follows.

Coating was performed at the speed of 160 n/min, with the clearance between the leading end of the coating die and the support being 0.10 mm to 0.30 mm, and with the pressure in the vacuum chamber set to be lower than atmospheric pressure by 196 Pa to 882 Pa. The support was decharged by ionic wind prior to coating.

In the subsequent cooling zone, the coating solution was cooled by wind having the dry-bulb temperature of 10° C. to 20° C. Thereafter, conveyance with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH. Then, the film surface was heated to be 70° C. to 90° C. After heating, the film surface was cooled to 25° C.

Thus prepared photothermographic material had the matness of 550 seconds on the image forming layer side surface, and 130 seconds on the back surface as Beck's smoothness. In addition, measurement of the pH of the film surface on the image forming layer side surface gave the result of 6.0.

Chemical structures of the compounds used in Examples of the invention are shown below.

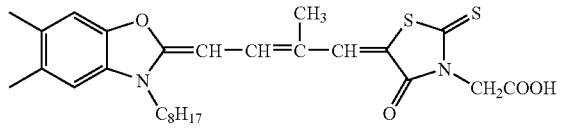

Spectral sensitizer A

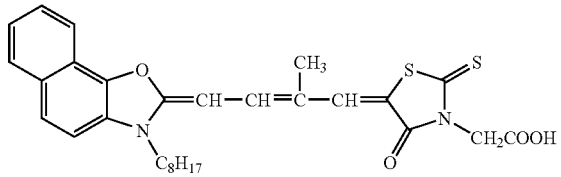

Spectral sensitizer B

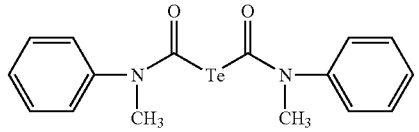

Tellulium sensitizer C

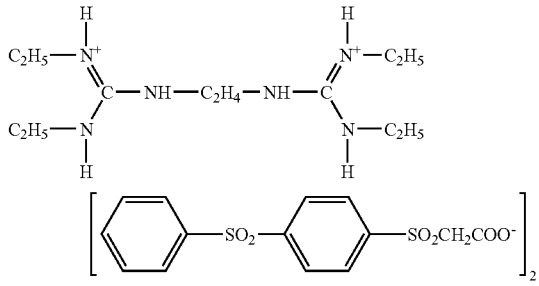

Base precusor-1

Cyanine dye-1

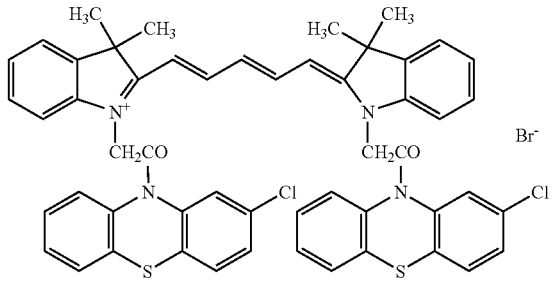

-continued

Blue dye-1

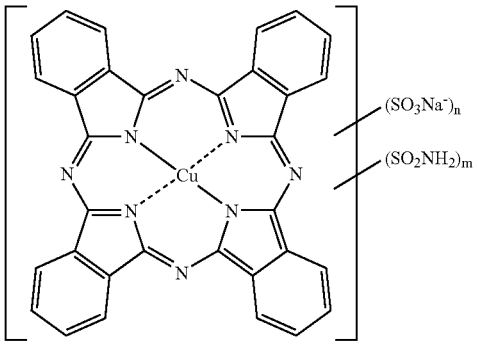

n = 0.5 ~ 2.0
m = 0.5 ~2.5

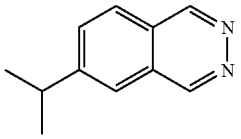

Phthalazine compound-1

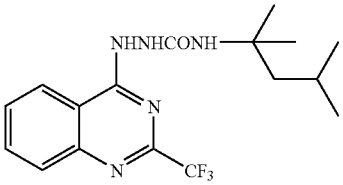

Development accelerator No. 1

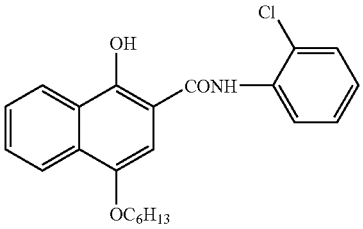

Development accelerator No. 2

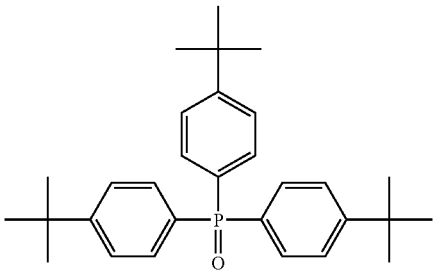

Hydrogen bonding compound-1

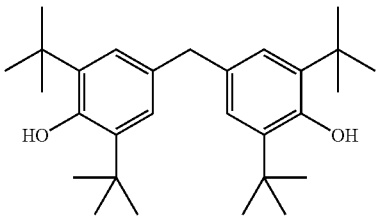

Imagewise coloring compound-1

-continued

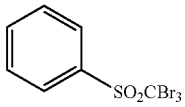

Organic polyhalogen compound-1

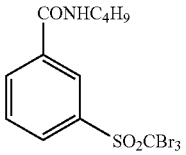

Organic polyhalogen compound-2

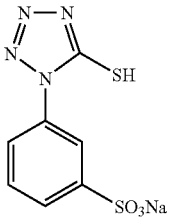

Mercapto compound-1

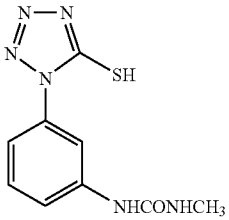

Mercapto compound-2

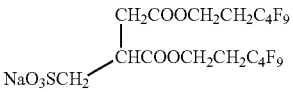

(F-1)

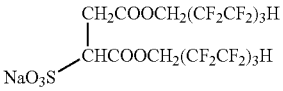

(F-2)

The resulting photothermographic material-101 to -115 was cut into a half-cut size (43 cm in length×35 cm in width), and was wrapped with the following packaging material under an environment of 25° C. and 50% RH, and stored for 2 weeks at an ambient temperature. Therafter they were subjected to the following evaluations.

<Packaging Material>

PET 10 μm/PE 12 μm/aluminum foil 9 μm/Ny 15 μm/polyethylene 50 μm containing carbon at 3% by weight; oxygen permeability at 25° C.: 0.02 $mL \cdot atm^{-1}m^{-2}day^{-1}$; vapor permeability at 25° C.: 0.10 $g \cdot atm^{-1}m^{-2}day^{-1}$.

(Conditions of Exposure and Thermal Development)

Exposure was performed to the sample-101 to -115 described above with Fuji Medical Dry Laser Imager FM-DP L (equipped with 660 nm laser diode having the maximum output of 60 mW (IIIB)). After that thermal development was performed at various line speed. The line speed of thermal development were controlled to be 17 mm/sec, 20-mm/sec, 24 mm/sec, 28 mm/sec and 33 mm/sec, by changing the 4 panel heaters to those differ in length. In this process, all of the 4 panel heaters were set to be 121° C. In this condition, 20 sheets prepared from the same sample of the photothermographic material were continuously thermally developed.

(Evaluation of Photographic Properties)

Image densities of the 1st sheet that was first processed in the aforementioned thermal process and the 20th processed sheet were measured using a densitometer. As an increment of 20th processed sheet against 1st processed sheet, ΔDmin, $\Delta S_{2.0}$, and ΔDmax were calculated and evaluated. Results are shown in Table 1.

<Evaluation Items>

(1) Fog (Dmin)

Fog (Dmin) is indicated by the dentisy of the unexposed part. The increment in fog of 20th processed sheet against 1st processed sheet is defined as ΔDmin. As for the permitted range of preformance change, ΔDmin preferably is 0.02 or less.

(2) Sensitivity ($S_{2.0}$)

A sensitivity is defined as a reciprocal of an exposure value at which an optical density of 2.0 is obtained, and the increment in sensitivity of 20th processed sheet against 1st processed sheet is defined as $\Delta S_{20}$. As for the permitted range of preformance change, $\Delta S_{2.0}$ preferably is 0.05 or less.

(3) Maximum Density (Dmax)

A maximum density is defined as a saturated image density when the exposure value is increased, and the increment in maximum density of 20th processed sheet against 1st processed sheet is defined as ΔDmax. As for the permitted range of preformance change, ΔDmax preferably is 0.05 or less.

Furthermore, as the value comes closer to zero, the change of 1st processed sheet and 20th processed sheet is smaller and therfore results in excellent performance.

S-1

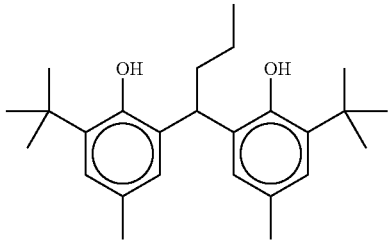

S-2

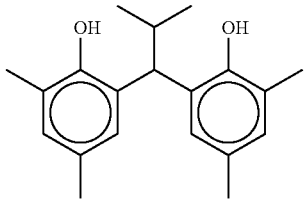

In Table 1, as for comparative sample No. 101 to -103, fog (Dmin) was increased together with continuously processing with the line speed of 17 mm/sec. And, when processed with the line speed of 24 mm/sec, the change in fog was small but the change in sensitivity was getting larger.

Further, as for comparative sample No. 104, the change in fog was rather large when processed with the line speed of 17 mm/sec, even using the reducing agent of the invention. On the other hand, processing with the line speed of 24 mm/sec according to the invention, the change in fog was controlled small. Furthermore, processing at line speed of 20 mm/sec or more of a photothermographic material which comprises the reducing agent of the invention and an development accelarator in combination can suppress the increase of fog and change of sensitivity in continuously processing.

Therefore the present invention can provide an image forming method using a photothermographic material which can quickly thermally developed not accompanying deterioration of properties, and particularly which can be thermally developed stably and quickly at all times although when plural sheets of the material are processed simultaneously.

TABLE 1

| Test | Sample | Coating solution for image forming | Reducing agent | | Development accelerator | | Line speed | Difference in photographic properties | | |
|---|---|---|---|---|---|---|---|---|---|---|
| | | | Compound | Addition amount | Compound | Addition amount | | | | |
| No. | No. | layer No. | No. | (mol %) | No. | (mol %) | mm/sec | $\Delta D_{min}$ | $\Delta S_{2.0}$ | $\Delta D_{max}$ |
| 1 | 101 | 1 | S-1 | 100 | — | — | 17 | 0.04 | 0.07 | 0.02 |
| 2 | 101 | 1 | S-1 | 100 | — | — | 24 | 0.01 | 0.15 | 0.11 |
| 3 | 102 | 2 | S-1 | 100 | No. 2 | 5 | 17 | 0.06 | 0.03 | 0.02 |
| 4 | 102 | 2 | S-1 | 100 | No. 2 | 5 | 24 | 0.01 | 0.09 | 0.06 |
| 5 | 103 | 3 | S-2 | 140 | No. 1 | 2 | 24 | 0.01 | 0.12 | 0.06 |
| | | | | | No. 2 | 3 | | | | |
| 6 | 104 | 4 | R1-1 | 140 | — | — | 17 | 0.03 | 0.03 | 0.02 |
| 7 | 104 | 4 | R1-1 | 140 | — | — | 24 | 0 | 0.05 | 0.05 |
| 8 | 105 | 5 | R1-1 | 140 | No. 2 | 5 | 24 | 0.01 | 0.02 | 0.02 |
| 9 | 106 | 6 | R1-11 | 140 | No. 2 | 5 | 24 | 0 | 0.03 | 0.03 |
| 10 | 107 | 7 | R1-31 | 100 | No. 2 | 5 | 17 | 0.04 | 0.01 | 0.02 |
| 11 | 107 | 7 | R1-31 | 100 | No. 2 | 5 | 20 | 0.02 | 0.01 | 0.02 |
| 12 | 107 | 7 | R1-31 | 100 | No. 2 | 5 | 24 | 0.01 | 0.02 | 0.02 |
| 13 | 107 | 7 | R1-31 | 100 | No. 2 | 5 | 28 | 0 | 0.02 | 0.03 |
| 14 | 107 | 7 | R1-31 | 100 | No. 2 | 5 | 33 | 0 | 0.03 | 0.03 |
| 15 | 108 | 8 | R2-1 | 140 | No. 2 | 5 | 24 | 0 | 0.03 | 0.02 |
| 16 | 109 | 9 | R2-13 | 140 | No. 2 | 5 | 24 | 0 | 0.03 | 0.02 |

TABLE 1-continued

| Test No. | Sample No. | Coating solution for image forming layer No. | Reducing agent Compound No. | Reducing agent Addition amount (mol %) | Development accelerator Compound No. | Development accelerator Addition amount (mol %) | Line speed mm/sec | Difference in photographic properties $\Delta D_{min}$ | $\Delta S_{2.0}$ | $\Delta D_{max}$ |
|---|---|---|---|---|---|---|---|---|---|---|
| 17 | 110 | 10 | R2-21 | 100 | No. 2 | 5 | 24 | 0 | 0.01 | 0.02 |
| 18 | 111 | 11 | R2-23 | 100 | No. 2 | 5 | 24 | 0.01 | 0.02 | 0.02 |
| 19 | 112 | 12 | R2-24 | 100 | No. 2 | 5 | 24 | 0.01 | 0.03 | 0.02 |
| 20 | 113 | 13 | R2-17 | 100 | No. 2 | 5 | 24 | 0 | 0.01 | 0.02 |
| 21 | 114 | 14 | R2-19 | 100 | No. 2 | 5 | 24 | 0.01 | 0.02 | 0.02 |
| 22 | 115 | 15 | R2-30 | 100 | No. 2 | 5 | 24 | 0.01 | 0.01 | 0.02 |

Example 2

(Preparation of PET Support)

Film manufacturing, surface corona discharge treatment, and undercoating were conducted in a similar manner to Example 1.

(Back Layer)

1) Preparation of coating solution for back layer, 2) preparation of dispersion solution of solid fine particle of dye, 3) preparation of coating solution for antihalation layer, 4) preparation of coating solution for back surface protective layer, and 5) coating of back layer were conducted in a similar manner to Example 1.

(Image Forming Layer, Intermediate Layer and Surface Protective Layer)

1. Preparations of Materials for Coating

<<Preparation of Reducing Agent-1 Dispersion>>

To 10 kg of a reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to thermal treatment at 60° C. for 5 hours to obtain a reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of a reducing agent-2 (6,6'-di-tbutyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 80° C. for one hour to obtain a reducing agent-2 dispersion. Particles of the reducing agent included in the resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

<<Preparation of Reducing Agent-3 Dispersion>>

To 10 kg of a reducing agent-3 (compond No. R1-32) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 60° C. for 5 hours to obtain a reducing agent-3 dispersion. Particles of the reducing agent included in the resulting reducing agent-3 dispersion had a median diameter of 0.45 μm, and a maximum particle diameter of 1.8 μm or less. The resultant reducing agent-3 dispersion was subjected to filtration with a polypropylene filter having a pore size of 3.0 μm to remove foreign substances such as dust, and stored.

<<Preparation of Reducing Agent-4 Dispersion>>

To 10 kg of a reducing agent-4 (compond No. R1-45) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 60° C. for 5 hours to obtain a reducing agent-4 dispersion. Particles of the reducing agent included in the resulting reducing agent-4 dispersion had a median diameter of 0.50 μm, and a maximum particle diameter of 1.8 μm or less. The resultant reducing agent-4 dispersion was subjected to filtration with a polypropylene filter having a pore size of 3.0 μm to remove foreign substances such as dust, and stored.

<<Preparation of Reducing Agent-5 Dispersion>>

To 10 kg of a reducing agent-5 (compond No. R2-21) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 60° C. for 5 hours to obtain a reducing agent-5 dispersion. Particles of the reducing agent included in the resulting reducing agent-5 dispersion had a median diameter of 0.40 μm, and a maximum particle diameter of 1.6 μm or less. The resultant reducing agent-5 dispersion was subjected to filtration with a polypropylene filter having a pore size of 3.0 μm to remove foreign substances such as dust, and stored.

<<Preparation of Reducing Agent-6 Dispersion>>

To 10 kg of a reducing agent-6 (compond No. R2-44) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 60° C. for 5 hours to obtain a reducing agent-6 dispersion. Particles of the reducing agent included in the resulting reducing agent-6 dispersion had a median diameter of 0.35 μm, and a maximum particle diameter of 1.6 μm or less. The resultant reducing agent-5 dispersion was subjected to filtration with a polypropylene filter having a pore size of 3.0 μm to remove foreign substances such as dust, and stored.

<<Preparation of Dispersion of Color-Tone-Adjusting Agent-1>>

Also concerning solid dispersion of a color-tone-adjusting agent-1, dispersion was executed in a similar manner to the development accelerator-1, and thus dispersion of 15% by weight was obtained.

2. Preparations of Coating Solution

1) Preparation of Coating Solution for Image Forming Layer

<<Preparation of Coating Solution for Image Forming Layer-21>>

The dispersion B of the silver salt of fatty acid obtained as described above in an amount of 1000 g, 143 mL of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) solution, 75 g of the reducing agent-1 dispersion, 67 g of the reducing agent-2 dispersion, 55 g of the hydrogen bonding compound-1 dispersion, 4.8 g of the development accelerator No. 1 dispersion, 5.2 g of the development accelerator No. 2 dispersion, 2.1 g of color-tone-adjusting agent-1 dispersion, and 8 mL of the mercapto compound-2 aqueous solution were serially added. The coating solution for the image forming layer prepared by adding 140 g of the mixed emulsion A for coating solution thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 30, 43, 41, 28, and 20 [mPa·s], respectively, at the shearing rate of 0.1, 1, 10, 100, 1000 [1/second].

The amount of zirconium in the coating solution was 0.30 mg per one g of silver.

<<Preparation of Coating Solution for Image Forming Layer-22>>

The dispersion B of the silver salt of fatty acid obtained as described above in an amount of 1000 g, 127 mL of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) solution, 83 g of the reducing agent-3 dispersion, 75 g of the reducing agent-4 dispersion, 55 g of the hydrogen bonding compound-1 dispersion, 4.8 g of the development accelerator No. 1 dispersion, 5.2 g of the development accelerator No. 2 dispersion, 2.1 g of color-tone-adjusting agent-1 dispersion, and 8 mL of the mercapto compound-2 aqueous solution were serially added. The coating solution for the image forming layer prepared by adding 140 g of the mixed emulsion A for coating solution thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 30, 41, 39, 26, and 20 [mPa·s], respectively, at the shearing rate of 0.1, 1, 10, 100, 1000 [1/second].

The amount of zirconium in the coating solution was 0.32 mg per one g of silver.

<<Preparation of Coating Solution for Image Forming Layer-23>>

The dispersion B of the silver salt of fatty acid obtained as described above in an amount of 1000 g, 135 mL of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) solution, 75 g of the reducing agent-5 dispersion, 75 g of the reducing agent-6 dispersion, 55 g of the hydrogen bonding compound-1 dispersion, 4.8 g of the development accelerator No. 1 dispersion, 5.2 g of the development accelerator No. 2 dispersion, 2.1 g of color-tone-adjusting agent-1 dispersion, and 8 mL of the mercapto compound-2 aqueous solution were serially added. The coating solution for the image forming layer prepared by adding 140 g of the mixed emulsion A for coating solution thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 29, 42, 40, 28, and 20 [mPa·s], respectively, at the shearing rate of 0.1, 1, 10, 100, 1000 [1/second].

The amount of zirconium in the coating solution was 0.32 mg per one g of silver.

2) Preparation of Coating Solution for Intermediate Layer

A coating solution similar to Example 1 was prepared.

3) Preparation of Coating Solution for First Layer of Surface Protective Layers

A coating solution similar to Example 1 was prepared.

4) Preparation of Coating Solution for Second Layer of Surface Protective Layers A coating solution similar to Example 1 was prepared.

(Preparations of Photothermographic Material-201 to -203)

1) Preparation of Photothermographic Material-201

Reverse surface of the back surface was subjected to simultaneous overlaying coating by a slide bead coating method in order of the image forming layer, first layer of the surface protective layers and second layer of the surface protective layers starting from the undercoated face, and thus sample of photothermographic material was produced. As for the coating solution for image forming layer, the coating solution for image forming layer-21 was used. In this method, the temperature of the coating solution was adjusted to 31° C. for the image forming layer and intermediate layer, to 36° C. for the first layer of the surface protective layers, and to 37° C. for the second layer of the surface protective layers.

The coating amount of each compound for the image forming layer (g/m$^2$) is as follows.

| | |
|---|---|
| Silver salt of fatty acid | 5.42 |
| Pigment-1 (C. I. Pigment Blue 60) | 0.036 |
| Organic polyhalogen compound-1 | 0.10 |
| Organic polyhalogen compound-2 | 0.20 |
| Phthalazine compound-1 | 0.18 |
| SBR latex | 9.70 |
| Reducing agent-1 | 0.45 |
| Reducing agent-2 | 0.40 |
| Hydrogen bonding compound-1 | 0.58 |
| Development accelerator No. 1 | 0.02 |
| Development accelerator No. 2 | 0.016 |
| Color-tone-adjusting agent-1 | 0.006 |
| Mercapto compound-2 | 0.012 |
| Silver halide (on the basis of Ag content) | 0.10 |

Conditions for coating and drying are similar to those in Example 1.

Thus prepared photothermographic material had the matness of 550 seconds on the image forming layer side surface, and 130 seconds on the back surface as Beck's smoothness. In addition, measurement of the pH of the film surface on the image forming layer side surface gave the result of 6.0.

2) Preparation of Photothermographic Material-202

Preparation of phoththermographic material-202 was conducted in a similar manner to the preparation of phoththermographic material-201, except that using the coating solution for image forming layer-22 instead of using the coating solution for image forming layer-21.

The coating amount of each compound for this image forming layer (g/m$^2$) is as follows.

| | |
|---|---|
| Silver salt of fatty acid | 5.42 |
| Pigment-1 (C. I. Pigment Blue 60) | 0.036 |
| Organic polyhalogen compound-1 | 0.10 |
| Organic polyhalogen compound-2 | 0.20 |
| Phthalazine compound-1 | 0.18 |
| SBR latex | 9.70 |
| Reducing agent-3 | 0.50 |
| Reducing agent-4 | 0.45 |
| Hydrogen bonding compound-1 | 0.58 |
| Development accelerator No. 1 | 0.02 |
| Development accelerator No. 2 | 0.016 |
| Color-tone-adjusting agent-1 | 0.006 |
| Mercapto compound-2 | 0.012 |
| Silver halide (on the basis of Ag content) | 0.10 |

3) Preparation of Photothermographic Material-203

Preparation of phoththermographic material-203 was conducted in a similar manner to the preparation of phoththermographic material-201, except that using the coating solution for image forming layer-23 instead of using the coating solution for image forming layer-21.

The coating amount of each compound for this image forming layer (g/m$^2$) is as follows.

| | |
|---|---|
| Silver salt of fatty acid | 5.42 |
| Pigment-1 (C. I. Pigment Blue 60) | 0.036 |
| Organic polyhalogen compound-1 | 0.10 |
| Organic polyhalogen compound-2 | 0.20 |
| Phthalazine compound-1 | 0.18 |
| SBR latex | 9.70 |
| Reducing agent-5 | 0.45 |
| Reducing agent-6 | 0.45 |
| Hydrogen bonding compound-1 | 0.58 |
| Development accelerator No. 1 | 0.02 |
| Development accelerator No. 2 | 0.016 |
| Color-tone-adjusting agent-1 | 0.006 |
| Mercapto compound-2 | 0.012 |
| Silver halide (on the basis of Ag content) | 0.10 |

Chemical structures of the compounds used in Examples of the invention are shown below.

Reducing agent-1

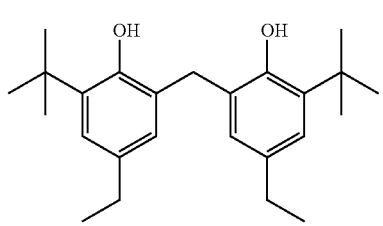

Reducing agent-2

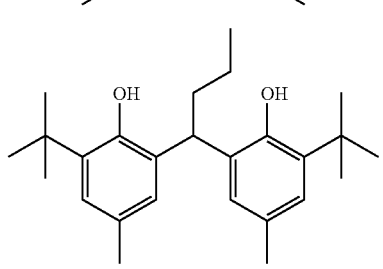

-continued

Color-tone-adjusting agent-1

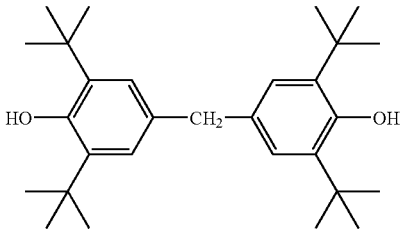

(Evaluation of Photographic Properties)

The resulting photothermographic material-201 to -203 were subjected to the following evaluations.

1) Preparation of Photothermographic Material

The samples for evaluation were prepared by the following procedures; the resulting sample was cut into a size of half-cut size, wrapped with the following packaging material under an environment of 25° C. and 50% RH and stored at 25° C. and 50% RH over a period of 2 weeks (named as Material Nos. 201a, 202a, and 203a, and hereafter called as "Fresh Sample"). The sample wrapped in the similar manner was stored at 30° C. and 40% RH over a period of 2 months (named as Material Nos. 201b, 202b, and 203b and called as "Aged Sample").

2) Packaging Material

PET 10 μm/PE 12 μm/aluminum foil 9 μm/Ny 15 μm/polyethylene 50 μm containing carbon at 3% by weight; oxygen permeability at 25° C.: 0.02 $mL \cdot atm^{-1}m^{-2}day^{-1}$; vapor permeability at 25° C.: 0.10 $g \cdot atm^{-1}m^{-2}day^{-1}$.

3) Conditions of Exposure and Thermal development

<Exposure>

Exposure was performed to each sample with a laser imager described in JP-A No. 2003-285455 and the like (equipped with 660 nm laser diode having the maximum output of 50 mW (IIIB)). Exposure conditions were as follows.

Exposure of a photothermographic material was performed for $10^{-8}$ sec with a photothermographic material surface intensity at 0 $mW/mm^2$ and at various values from 1 $mW/mm^2$ to 1000 $mW/mm^2$.

<Thermal development>

Thermal development of the sample exposed as described above was performed with the aforementioned laser imager (equipped with 660 nm laser diode having the maximum output of 50 mW (IIIB)). Thermal development was performed in conditions that 3 panel heaters were set to 107° C.-118° C.-121° C., and a total thermal development time was set to 14 sec by controlling the transportation line speed.

4) Evaluation of Samples (1) Evaluation of Stability of Sensitivity

As shown in FIG. 2, regarding to "Fresh Sample" (Material Nos. 201a, 202a, and 203a) stored at 20° C. and 50% RH (for 2 weeks) and "Aged Sample" (Material Nos. 201b, 202b, and 203b) stored at 30° C. and 40% RH (for 2 months), 20 sheets of the said material were processed continuously at each time point of 12 minutes, 15 minutes, 30 minutes and 60 minutes after starting-up the apparatus. The density of the obtained image of the processed sheet was measured by a densitometer and thereafter plotted against a logarithm of the exposure value to draw a photographic characteristic curve. Sensitivity was determined as a reciprocal of the exposure value necessary for giving optical density of 2.0. And then the sensitivity ratio ⊿S (S 1/S2) was determined from the ratio of sensitivity of the first sheet (S1) to the sensitivity of the $20^{th}$ sheet (S2). The values obtained are shown in Table 2. As the said sensitivity ratio come close to one, the stable processing may be attained and therefore result in excellent performance.

<Evaluation Criteria>

The above mentioned sensitivity ratio ⊿S was evaluated generally by the following criteria;

◎: Within 15 minutes, ⊿S reaches to more than 0.99, and therefore no variation in sensitivity is seen.

○: Within 15 minutes, ⊿S reaches to from 0.97 to 0.99, and slightly variation in sensitivity is seen, and of no problem in practical use.

Δ: Within 15 minutes, ⊿S reaches to from 0.95 to 0.97, and some variation in sensitivity is seen. It is in a non-negligible level.

X: Within 15 minutes, ⊿S reaches to less than 0.95, and marked variation in sensitivity is seen. It is in an unacceptable level.

(2) Evaluation of Color Difference

As shown in Table 2, the color difference at medium density area (D=1.5) on each image of the first sheet and the 20th sheet processed continuously were calculated from the following equation (E). The said color difference was determined from a measurement of L*, a*, b* based on CIELAB colorimetric system defined by Commission International de l'Eclairage (CIE) using a spectrophotometer under illumination of an experimental light F5 (Daylight fluorescent lamp) according to the provisions of JIS Z8719.

The above mentioned color difference ΔE was determined as follows.

For instance, the color difference ΔE of Sample 1 to Sample 2 is expressed as the following Equation (E);

$$\Delta E=[(L_2^*-L_1^*)^2+(a_2^*-a_1^*)^2+(b_2^*-b_1^*)^2]^{1/2} \quad \text{Equation (E)}$$

Where $L_1^*$, $a_1^*$, $b_1^*$ and $L_2^*$, $a_2^*$, $b_2^*$ refer to the amounts (Chromaticity coordinates) concerning the metric brightness, hue, and color saturation in the CIELAB color space of Sample 1 and Sample 2.

<Evaluation Criteria>

The color difference is evaluated by the following criteria;

◎: within 15 minutes, ⊿E reaches to less than 0.2, and variation in image tone is scarecely seen.

○: within 15 minutes, ⊿E reaches to from 0.2 to 0.4 and slight variation in image tone is seen, and of no problem in practical use.

Δ: within 15 minutes, ⊿E reaches to from 0.4 to 0.6 and some variation in image tone is seen, and of no problem in practical use.

X: within 15 minutes, ⊿E reaches to more than 0.6 and marked variation in image tone is seen, and unacceptable level for practical use.

TABLE 2

| Sample No. | Photothermographic material No. | Fresh or aged sample | Sensitivity ratio Δ S 12 min | 15 min | 30 min | 60 min | Evaluation | Color difference Δ E 12 min | 15 min | 30 min | 60 min | Evaluation |
|---|---|---|---|---|---|---|---|---|---|---|---|---|
| 201 | 201 | Fr | 0.91 | 0.94 | 1.00 | 1.00 | X | 0.51 | 0.25 | 0.06 | 0.02 | ○ |
| 202 | 201 | Aged sample | 0.87 | 0.91 | 0.99 | 1.00 | X | 0.99 | 0.41 | 0.07 | 0.03 | Δ |
| 203 | 202 | Fr | 0.98 | 1.00 | 1.00 | 1.00 | ◎ | 0.28 | 0.19 | 0.01 | 0.01 | ◎ |
| 204 | 202 | Aged sample | 0.97 | 1.00 | 1.00 | 1.00 | ◎ | 0.33 | 0.22 | 0.02 | 0.01 | ○ |
| 205 | 203 | Fr | 0.98 | 1.00 | 1.00 | 1.00 | ◎ | 0.31 | 0.23 | 0.03 | 0.02 | ○ |
| 206 | 203 | Aged sample | 0.98 | 1.00 | 1.00 | 1.00 | ◎ | 0.36 | 0.22 | 0.03 | 0.01 | ○ |

Notes)
Sensitivity ratio*1: The sensitivity ratio of the first sheet to the 20th sheet when 20 sheets were processed continuously at the determined time points after starting-up the apparatus;
Color difference*2: The color difference between the first sheet and the 20th sheet when 20 sheets were processed continuously at the determined time points after starting-up the apparatus;
The data obtained at 30 minutes and 60 minutes after starting-up the apparatus are given in Table 2 for reference.

It is apparent from the results shown in Table 2 that the variations in sensitivities of both fresh sample and aged sample of comparative photothermographic material No. 201 are remarkable when thermal development was performed in a short waiting time after starting-up the apparatus.

On the other hand, concerning fresh sample and aged sample of photothermographic material Nos. 202 and 203 according to the present invention, the stabilized image with little variation in sensitivity and color difference can be obtained even in a short waiting time like as 15 minutes or less after starting-up the apparatus The said advantage of the image stability in a short waiting time is apparent especially in case of the aged sample of the material according to the invention.

Therefore the image forming method for the pfotothermographic material of the present invention can provide stable images in a short time after starting-up the image forming apparatus.

Example 3

(Preparation of PET Support)

Film manufacturing, surface corona discharge treatment, and undercoating were conducted in a similar manner to Example 1.

(Black Layer)

1) Preparation of coating solution for back layer, 2) preparation of dispersion solution of solid fine particle of dye, 3) preparation of coating solution for antihalation layer, 4) preparation of coating solution for back surface protective layer, and 5) coating of back layer were conducted in a similar manner to Example 1.

(Image Forming Layer, Intermediate Layer and Surface Protective Layer)

1. Preparations of Materials for Coating

1) Preparations of Organic Polyhalogen Compound Dispersion

<<Preparation of Organic Polyhalogen Compound-11 Dispersion>>

An organic polyhalogen compound-11 (tribromomethane sulfonylbenzene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 26% by weight. Accordingly, an organic polyhalogen compound-11 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-12 Dispersion>>

An organic polyhalogen compound-12 (N-butyl-3-tribromomethane sulfonylbenzoamide) in an amount of 10 kg, 20 kg of a 10% by weight aqueous solution of modified polyvinyl alcohol (manufactured by Kuraray Co., Ltd., Poval MP203), and 0.4 kg of a 20% by weight aqueous solution of sodium triisopropylnaphthalenesulfonate were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound-12 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

<<Preparation of Organic Polyhalogen Compound-13 Dispersion>>

An organic polyhalogen compound-13 (compound No. 1a-6) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 26% by weight. Accordingly, an organic polyhalogen compound-13 dispersion was obtained. Particles of the organic polyhalogen compound included in the resulting organic polyhalogen compound dispersion had a median diameter of 0.41 μm, and a maximum particle diameter of 1.7 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-14 Dispersion>>

An organic polyhalogen compound-14 (compound No. 1b-30) in an amount of 10 kg, 20 kg of a 10% by weight aqueous solution of modified polyvinyl alcohol (manufactured by Kuraray Co., Ltd., Poval MP203), and 0.4 kg of a 20% by weight aqueous solution of sodium triisopropylnaphthalenesulfonate were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound-14 dispersion. Particles of the organic polyhalogen compound included in the resulting organic polyhalogen compound dispersion had a median diameter of 0.40 μm, and a maximum particle diameter of 1.2 μm or less. The resultant organic polyhalogen compound dispersion was subjected to filtration with a polypropylene filter having a pore size of 3.0 μm to remove foreign substances such as dust, and stored.

<<Preparation of Organic Polyhalogen Compound-15 Dispersion>>

An organic polyhalogen compound-15 (compound No. 1b-24) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto. Accordingly, an organic polyhalogen compound-15 dispersion was obtained. Particles of the organic polyhalogen compound included in the resulting organic polyhalogen compound dispersion had a median diameter of 0.39 μm, and a maximum particle diameter of 1.8 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-16 Dispersion>>

An organic polyhalogen compound-16 (compound No. 1c-7) in an amount of 10 kg, 20 kg of a 10% by weight aqueous solution of modified polyvinyl alcohol (manufactured by Kuraray Co., Ltd., Poval MP203), and 0.4 kg of a 20% by weight aqueous solution of sodium triisopropylnaphthalenesulfonate were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound-16 dispersion. Particles of the organic polyhalogen compound included in the resulting organic polyhalogen compound dispersion had a median diameter of 0.41 μm, and a maximum particle diameter of 1.6 μm or less. The resultant organic polyhalogen compound dispersion was subjected to filtration with a polypropylene filter having a pore size of 3.0 μm to remove foreign substances such as dust, and stored.

2. Preparations of Coating Solution

1) Preparation of Coating Solution for Image Forming Layer

<<Preparation of Coating Solution for Image Forming Layer-31>>

The dispersion B of the silver salt of fatty acid obtained as described above in an amount of 1000 g, 143 mL of water, 36 g of the pigment-1 dispersion, 25 g of the organic polyhalogen compound-11 dispersion, 39 g of the organic polyhalogen compound-12 dispersion, 171 g of the phthalazine compound-1 solution, 1060 g of the SBR latex (Tg: 17° C.) solution, 75 g of the reducing agent-1 dispersion, 67 g of the reducing agent-2 dispersion, 55 g of the hydrogen bonding compound-1 dispersion, 4.8 g of the development accelerator No. 1 dispersion, 5.2 g of the development accelerator No. 2 dispersion, 2.1 g of color-tone-adjusting agent-1 dispersion, and 8 mL of the mercapto compound-2 aqueous solution were serially added. The coating solution for the image forming layer prepared by adding 140 g of the mixed emulsion A for coating solution thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 30, 43, 41, 28, and 20 [mPa·s], respectively, at the shearing rate of 0.1, 1, 10, 100, 1000 [1/second].

The amount of zirconium in the coating solution was 0.30 mg per one g of silver.

<<Preparation of Coating Solution for Image Forming Layer-32>>

The dispersion B of the silver salt of fatty acid obtained as described above in an amount of 1000 g, 127 mL of water, 36 g of the pigment-1 dispersion, 25 g of the organic polyhalogen compound-13 dispersion, 39 g of the organic polyhalogen compound-14 dispersion, 171 g of the phthalazine compound-1 solution, 1060 g of the SBR latex (Tg: 17° C.) solution, 83 g of the reducing agent-1 dispersion, 75 g of the reducing agent-2 dispersion, 55 g of the hydrogen bonding compound-1 dispersion, 4.8 g of the development accelerator No. 1 dispersion, 5.2 g of the development accelerator No. 2 dispersion, 2.1 g of color-tone-adjusting agent-1 dispersion, and 8 mL of the mercapto compound-2 aqueous solution were serially added. The coating solution for the image forming layer prepared by adding 140 g of the mixed emulsion A for coating solution thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 30, 41, 39, 26, and 20 [mPa·s], respectively, at the shearing rate of 0.1, 1, 10, 100, 1000 [1/second].

The amount of zirconium in the coating solution was 0.32 mg per one g of silver.

<<Preparation of Coating Solution for Image Forming Layer-33>>

The dispersion B of the silver salt of fatty acid obtained as described above in an amount of 1000 g, 135 mL of water, 36 g of the pigment-1 dispersion, 25 g of the organic polyhalogen compound-15 dispersion, 39 g of the organic polyhalogen compound-16 dispersion, 171 g of the phthalazine compound-1 solution, 1060 g of the SBR latex (Tg: 17° C.) solution, 75 g of the reducing agent-1 dispersion, 75 g of the reducing agent-2 dispersion, 55 g of the hydrogen bonding compound-1 dispersion, 4.8 g of the development accelerator No. 1 dispersion, 5.2 g of the development accelerator No. 2 dispersion, 2.1 g of color-tone-adjusting agent-1 dispersion, and 8 mL of the mercapto compound-2 aqueous solution were serially added. The coating solution for the image forming layer prepared by adding 140 g of the mixed emulsion A for coating solution thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 29, 42, 40, 28, and 20 [mPa·s], respectively, at the shearing rate of 0.1, 1, 10, 100, 1000 [1/second].

The amount of zirconium in the coating solution was 0.32 mg per one g of silver.

2) Preparation of Coating Solution for Intermediate Layer

A coating solution similar to Example 1 was prepared.

3) Preparation of Coating Solution for First Layer of Surface Protective Layers

A coating solution similar to Example 1 was prepared.

4) Preparation of Coating Solution for Second Layer of Surface Protective Layers A coating solution similar to Example 1 was prepared.

(Preparations of Photothermographic Material-301 to -303)

1) Preparation of Photothermographic Material-301

Reverse surface of the back surface was subjected to simultaneous overlaying coating by a slide bead coating method in order of the image forming layer, first layer of the surface protective layers and second layer of the surface protective layers starting from the undercoated face, and thus sample of photothermographic material was produced. As for the coating solution for image forming layer, the coating solution for image forming layer-31 was used. In this method, the temperature of the coating solution was adjusted to 31° C. for the image forming layer and intermediate layer, to 36° C. for the first layer of the surface protective layers, and to 37° C. for the second layer of the surface protective layers.

The coating amount of each compound for the image forming layer (g/m$^2$) is as follows. The coating amount of silver was 1.41 g/m$^2$.

| | |
|---|---|
| Silver salt of fatty acid | 5.42 |
| Pigment-1 (C. I. Pigment Blue 60) | 0.036 |
| Organic polyhalogen compound-11 | 0.10 |
| Organic polyhalogen compound-12 | 0.20 |
| Phthalazine compound-1 | 0.18 |
| SBR latex | 9.70 |
| Reducing agent-1 | 0.45 |
| Reducing agent-2 | 0.40 |
| Hydrogen bonding compound-1 | 0.58 |
| Development accelerator No. 1 | 0.02 |
| Development accelerator No. 2 | 0.016 |
| Color-tone-adjusting agent-1 | 0.006 |
| Mercapto compound-2 | 0.012 |
| Silver halide (on the basis of Ag content) | 0.10 |

Conditions for coating and drying are similar to those in Example 1.

Thus prepared photothermographic material had the matness of 550 seconds on the image forming layer side surface, and 130 seconds on the back surface as Beck's smoothness. In addition, measurement of the pH of the film surface on the image forming layer side surface gave the result of 6.0.

2) Preparation of Photothermographic Material-302

Preparation of phothermographic material-302 was conducted in a similar manner to the preparation of phothermographic material-301, except that using the coating solution for image forming layer-32 instead of using the coating solution for image forming layer-31.

The coating amount of each compound for this image forming layer (g/m$^2$) is as follows. The coating amount of silver was 1.41 g/m$^2$.

| | |
|---|---|
| Silver salt of fatty acid | 5.42 |
| Pigment-1 (C. I. Pigment Blue 60) | 0.036 |
| Organic polyhalogen compound-13 | 0.11 |
| Organic polyhalogen compound-14 | 0.10 |
| Phthalazine compound-1 | 0.18 |
| SBR latex | 9.70 |
| Reducing agent-1 | 0.50 |
| Reducing agent-2 | 0.45 |
| Hydrogen bonding compound-1 | 0.58 |
| Development accelerator No. 1 | 0.02 |
| Development accelerator No. 2 | 0.016 |
| Color-tone-adjusting agent-1 | 0.006 |
| Mercapto compound-2 | 0.012 |
| Silver halide (on the basis of Ag content) | 0.10 |

3) Preparation of Photothermographic Material-303

Preparation of phothermographic material-303 was conducted in a similar manner to the preparation of phothermographic material-301, except that using the coating solution for image forming layer-33 instead of using the coating solution for image forming layer-31.

The coating amount of each compound for this image forming layer (g/m$^2$) is as follows. The coating amount of silver was 1.41 g/m$^2$.

| | |
|---|---|
| Silver salt of fatty acid | 5.42 |
| Pigment-1 (C. I. Pigment Blue 60) | 0.036 |
| Organic polyhalogen compound-15 | 0.11 |
| Organic polyhalogen compound-16 | 0.21 |
| Phthalazine compound-1 | 0.18 |
| SBR latex | 9.70 |
| Reducing agent-1 | 0.45 |
| Reducing agent-2 | 0.45 |
| Hydrogen bonding compound-1 | 0.58 |
| Development accelerator No. 1 | 0.02 |
| Development accelerator No. 2 | 0.016 |
| Color-tone-adjusting agent-1 | 0.006 |
| Mercapto compound-2 | 0.012 |
| Silver halide (on the basis of Ag content) | 0.10 |

(Evaluation of Photographic Properties)

The resulting photothermographic material-301 to -303 were subjected to the following evaluations.

1) Preparation of Photothermographic Material

It was done similar to Example 2.

2) Exposure and Thermal Development

It was done similar to Example 2.

3) Evaluation of Samples (1) Evaluation of Stability of Sensitivity

It was done similar to Example 2. Results are shown in Table 3.

(2) Evaluation of Color Difference

It was done similar to Example 2. Results are shown in Table 3.

formed in a short waiting time after starting-up the apparatus.

On the other hand, concerning fresh sample and aged sample of material Nos. 302 and 303 according to the present invention, a stable image with little variation in sensitivity and color difference can be obtained even in a short waiting time like as 15 minutes or less after starting-up the apparatus The said advantage of the image stability in a short waiting time is apparent especially in case of the aged sample of the photothermographic material according to the invention. Raw stock storability was improved in the photothermographic material according to the invention compared with the conventional photothermographic material, and it is obvious that the photothermographic material of the invention is excellent.

As for all of sample Nos. 302a, 302b, 303a, and 303b according to the invention, a hue-angle of the image at an optical density of 1.0 was within the range from 180° to 270°, and the image tone was favorable.

Therefore, by the invention, stable images can be obtained in a short time after starting-up the image forming apparatus and a quick image formation can be provided.

Example 4

Sample No. 101 and No. 104 were imagewise exposed and thermally processed at line speed 17 mm/sec and 24 mm/sec with keeping developing time as 10 sec, 14 sec, amd 25 by changing the length of heet panels as similar to Example 1. Development temperature was controled so as to be higher at shorter developing time, such that to 130° C. at 10 sec, 121° C. at 14 sec, and 115° C. at 25 sec, by changing heating temperature of four heat panels.

Evaluations of stability in sensitivity and fog were done similar to Example 1.

TABLE 3

| Sample | Photothermographic material | Fresh or aged | Sensitivity ratio Δ S | | | | | Color difference Δ E | | | | |
|---|---|---|---|---|---|---|---|---|---|---|---|---|
| No. | No. | sample | 12 min | 15 min | 30 min | 60 min | Evaluation | 12 min | 15 min | 30 min | 60 min | Evaluation |
| 301 | 301 | Fr | 0.91 | 0.94 | 1.00 | 1.00 | x | 0.51 | 0.25 | 0.06 | 0.02 | ○ |
| 302 | 301 | Aged sample | 0.87 | 0.91 | 0.99 | 1.00 | x | 0.99 | 0.41 | 0.07 | 0.03 | Δ |
| 303 | 302 | Fr | 0.98 | 0.99 | 1.00 | 1.00 | ⊙ | 0.32 | 0.21 | 0.02 | 0.01 | ○ |
| 304 | 302 | Aged sample | 0.97 | 0.99 | 1.00 | 1.00 | ⊙ | 0.34 | 0.24 | 0.04 | 0.01 | ○ |
| 305 | 303 | Fr | 0.98 | 1.00 | 1.00 | 1.00 | ⊙ | 0.33 | 0.27 | 0.03 | 0.02 | ○ |
| 306 | 303 | Aged sample | 0.97 | 0.99 | 1.00 | 1.00 | ⊙ | 0.39 | 0.32 | 0.05 | 0.02 | ○ |

The data obtained at 30 minutes and 60 minutes after starting-up the apparatus are given in Table 3 for reference.

It is apparent from the results shown in Table 3 that the variations in sensitivities of both fresh sample and aged sample of comparative photothermographic material No. 301 are remarkable when thermal development was per-

TABLE 4

| Test | Sample | Reducing agent | Development condittion | | | Difference in photographic properties | | | |
|---|---|---|---|---|---|---|---|---|---|
| | | Compd. No. | Temperature | Time | Line speed | | | | |
| No. | No. | (Addition amount) | (° C.) | (sec) | (mm/sec) | Δ $D_{min}$ | Δ $S_{2.0}$ | Δ $D_{max}$ | Note |
| 31 | 101 | S-1 (100 mol %) | 121 | 14 | 17 | 0.04 | 0.07 | 0.02 | Comparative |
| 32 | " | " | 121 | 14 | 24 | 0.01 | 0.15 | 0.11 | Comparative |
| 33 | 104 | R1-1 (140 mol %) | 121 | 14 | 17 | 0.03 | 0.05 | 0.02 | Comparative |

TABLE 4-continued

| Test No. | Sample No. | Reducing agent Compd. No. (Addition amount) | Development condition Temperature (° C.) | Time (sec) | Line speed (mm/sec) | Difference in photographic properties $\Delta D_{min}$ | $\Delta S_{2.0}$ | $\Delta D_{max}$ | Note |
|---|---|---|---|---|---|---|---|---|---|
| 34 | " | " | 121 | 14 | 24 | 0 | 0.03 | 0.05 | Invention |
| 35 | 101 | S-1 (100 mol %) | 115 | 25 | 17 | 0.05 | 0.09 | 0.02 | Comparative |
| 36 | " | " | 115 | 25 | 24 | 0.03 | 0.18 | 0.05 | Comparative |
| 37 | 104 | R1-1 (140 mol %) | 115 | 25 | 17 | 0.04 | 0.06 | 0.02 | Comparative |
| 38 | " | " | 115 | 25 | 24 | 0.01 | 0.05 | 0.03 | Invention |
| 39 | 101 | S-1 (100 mol %) | 130 | 10 | 17 | 0.03 | 0.05 | 0.15 | Comparative |
| 40 | " | " | 130 | 10 | 24 | 0.01 | 0.08 | 0.18 | Comparative |
| 41 | 104 | R1-1 (140 mol %) | 130 | 10 | 17 | 0.02 | 0.03 | 0.10 | Comparative |
| 42 | " | " | 130 | 10 | 24 | 0 | 0.02 | 0.05 | Invention |

Results are shown in Table 4. In the case of 121° C. development, test Nos. 31 to 33 (comparative) show larger $\Delta D_{min}$ or $\Delta S_{2.0}$ than test No. 34 (inventive) does and test No. 32 shows larger $\Delta D_{max}$ than test No. 34. In the case of 115° C. development, test Nos. 35 to 37 (comparative) show larger $\Delta D_{min}$ or $\Delta S_{2.0}$ than test No. 38 (inventive). In the case of 130° C. development, test Nos. 39 to 41 (comparative) show especially larger $\Delta D_{max}$ than test No. 42 (inventive).

It can be understood from above results that a present combination of the reducing agent and the line speed results excellent performances at every temperature and developing time.

What is claimed is:

1. An image forming method comprising imagewise exposing a photothermographic material comprising at least a photosensitive silver halide, a non-photosensitive organic silver salt, a reducing agent, and a binder, on at least one surface of a support, wherein the reducing agent is at least one selected from compounds represented by the following formulae (R1) or (R2), and the photothermographic material comprises an imagewise coloring compound, which forms a dye having an absorption at a yellow region or a cyan region, and thermally developing the photothermographic material at a line speed of 20 mm/sec or higher using an image forming apparatus:

Formula (R1)

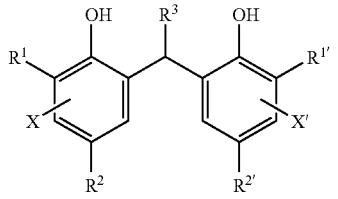

wherein, $R^1$ and $R^{1'}$ each independently represent an alkyl group having 1 to 20 carbon atoms; $R^2$ and $R^{2'}$ each independently represent a hydrogen atom, or a substituent which can be substituted for a hydrogen atom on a benzene ring; $R^3$ represents a substituent which can form a 3- to 7-membered ring which includes atoms selected from carbon, oxygen, nitrogen, sulfur and phosphorus atoms; and X and X' each independently represent a hydrogen atom, or a substituent which can be substituted for a hydrogen atom on a benzene ring;

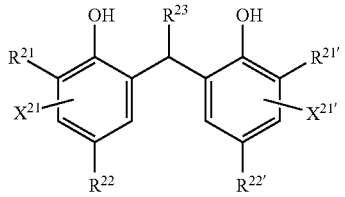

wherein, $R^{21}$ and $R^{21'}$ each independently represent an alkyl group having 1 to 20 carbon atoms; $R^{22}$ and $R^{22'}$ each independently represent a hydrogen atom, or a substituent which can be substituted for a hydrogen atom on a benzene ring; $R^{23}$ represents an alkenyl group, or an alkyl group having a substituent having an unsaturated bond; $X^{21}$ and $X^{21'}$ each independently represent a hydrogen atom, or a substituent which can be substituted for a hydrogen atom on a benzene ring.

2. An image forming method according to claim 1, wherein the line speed of thermal development is 24 mm/sec or higher.

3. An image forming method according to claim 1, wherein the line speed of thermal development is 28 mm/sec or higher.

4. An image forming method according to claim 1, wherein the photothermographic material comprises a development accelerator.

5. An image forming method according to claim 1, wherein at least one of $R^1$ and $R^{1'}$ in formula (R1) or at least one of $R^{21}$ and $R^{21'}$ in formula (R2) is a secondary or tertiary alkyl group.

6. An image forming method according to claim 5, wherein at least one of $R^1$ and $R^{1'}$ in formula (R1) or at least one of $R^{21}$ and $R^{21'}$ in formula (R2) is a tertiary alkyl group.

7. An image forming method according to claim 1, wherein the photothermographic material comprises a fluorocarbon surfactant.

8. An image forming method according to claim 1, wherein a hue-angle of the image at an optical density of 1.0 is from 180° to 270°.

9. An image forming method according to claim 1, wherein the photothermographic material has a silver coating amount of 0.9 g/m$^2$ to 1.9 g/m$^2$.

10. An image forming method according to claim 1, wherein thermal development is carried out for 6 seconds to 14 seconds.

11. An image forming method according to claim 1, wherein a development efficiency at a maximum density part is 70% or more.

12. An image forming method according to claim 1, wherein the imagewise coloring compound is a compound which develops a color alone or forms a dye by a coupling reaction through two or more compounds.

13. An image forming method according to claim 1, wherein the dye absorbs 70% or more in a yellow region of 350 nm to 500 nm, or in a cyan region of 600 nm to 700 nm.

14. An image forming method according to claim 12, wherein the compound which develops a color alone is a compound represented by formula (C);

Formula (C)

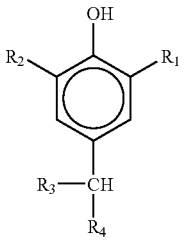

wherein, $R_1$ and $R_2$ each independently represent a halogen atom, an alkyl group, an alkoxy group, an amino group, an acylamino group, an acyloxy group, an acyl group, an acyloxycarbonyl group, a sulfide group, a sulfonyl group, a disulfide group, a sulfamoyl group or a carbamoyl group; and $R_3$ and $R_4$ each independently represent a hydrogen atom, a halogen atom, a hydroxyl group, an amino group, an alkoxy group, an aryloxy group, an acyloxy group, an acylamino group, a sulfide group, a disulfide group, an aryl group or a heterocyclic group.

15. An image forming method according to claim 12, wherein the compound which forms a dye by a coupling reaction through two or more compounds is a color coupler.

16. An image forming method according to claim 1, wherein an addition amount of the imagewise coloring compound is in an amount of 0.1 mol % to 50 mol % based on the reducing agent.

* * * * *